US011639647B2

(12) United States Patent
Gooneratne et al.

(10) Patent No.: US 11,639,647 B2
(45) Date of Patent: May 2, 2023

(54) SELF-POWERED SENSORS FOR DETECTING DOWNHOLE PARAMETERS

(71) Applicants: SAUDI ARABIAN OIL COMPANY, Dhahran (SA); Macquarie University, North Ryde (AU)

(72) Inventors: Chinthaka Pasan Gooneratne, Dhahran (SA); Subhas Mukhopadhyay, Beecroft (AU); Bodong Li, Dhahran (SA); Guodong Zhan, Dhahran (SA); Arturo Magana-Mora, Dhahran (SA); Timothy Eric Moellendick, Dhahran (SA)

(73) Assignees: SAUDI ARABIAN OIL COMPANY, Dhahran (SA); Macquarie University, Sydney (AU)

( * ) Notice: Subject to any disclaimer, the term of this patent is extended or adjusted under 35 U.S.C. 154(b) by 272 days.

(21) Appl. No.: 16/944,662

(22) Filed: Jul. 31, 2020

(65) Prior Publication Data

US 2022/0034173 A1 Feb. 3, 2022

(51) Int. Cl.
*E21B 41/00* (2006.01)
*E21B 47/01* (2012.01)
(Continued)

(52) U.S. Cl.
CPC ..... *E21B 41/0085* (2013.01); *E21B 47/01* (2013.01); *E21B 47/06* (2013.01); *E21B 47/085* (2020.05)

(58) Field of Classification Search
CPC ..... E21B 17/1014; E21B 47/0025; E21B 47/022; E21B 47/085; E21B 41/0085; E21B 47/01; E21B 47/06; E21B 47/12
See application file for complete search history.

(56) References Cited

U.S. PATENT DOCUMENTS 6,109,372 A * 8/2000 Dorel ..... E21B 7/06 175/269
6,830,379 B2 12/2004 Morita et al.
(Continued)

FOREIGN PATENT DOCUMENTS

CN 106130401 B 11/2017
CN 109267999 A 1/2019
(Continued)

OTHER PUBLICATIONS

International Search Report and Written Opinion issued in Application No. PCT/US2020/051518, dated Apr. 19, 2021 (13 pages).
(Continued)

*Primary Examiner* — Blake Michener
*Assistant Examiner* — Yanick A Akaragwe
(74) *Attorney, Agent, or Firm* — Osha Bergman Watanabe & Burton LLP

(57) ABSTRACT

A self-powered sensor array (SPSA) for sensing environmental parameters along a drillstring includes an outer collar having moveable member retainers with moveable members movably located in the moveable member retainers. An inner ring is rotatably supported within the outer collar with bearing elements on an outer surface of the inner ring positioned to displace the moveable members relative to the moveable member retainers in response to relative rotation between the inner ring and the outer collar. Shape memory material elements are arranged in a respective moveable member retainer. Distance sensors are configured to sense a gap responsive to a shape change of the respective shape memory material element and a displacement of the respective moveable member. Power generation components are configured such that, in response to the relative rotation, the bearing elements displace a particular moveable member
(Continued)

into a particular moveable member retainer, generating an electric charge.

20 Claims, 16 Drawing Sheets

(51) Int. Cl.
*E21B 47/06* (2012.01)
*E21B 47/085* (2012.01)

(56) References Cited

U.S. PATENT DOCUMENTS

| | | | | |
|---|---|---|---|---|
| 8,284,075 | B2 | 10/2012 | Fincher et al. | |
| 8,890,341 | B2 | 11/2014 | Ocalan et al. | |
| 9,847,738 | B2 * | 12/2017 | Kim | H02N 2/185 |
| 10,066,474 | B2 | 9/2018 | Rodney et al. | |
| 10,431,998 | B2 | 10/2019 | Olah | |
| 2002/0148648 | A1 | 10/2002 | Schultz et al. | |
| 2005/0024231 | A1 | 2/2005 | Fincher et al. | |
| 2005/0051323 | A1 | 3/2005 | Fripp et al. | |
| 2006/0016606 | A1 | 1/2006 | Tubel et al. | |
| 2006/0086498 | A1 | 4/2006 | Wetzel et al. | |
| 2008/0247273 | A1 | 10/2008 | Chemali et al. | |
| 2010/0133006 | A1 | 6/2010 | Shakra et al. | |
| 2010/0219646 | A1 * | 9/2010 | Hay | E21B 41/0085 290/1 A |
| 2011/0210645 | A1 | 9/2011 | Mason | |
| 2012/0145461 | A1 * | 6/2012 | Cravatte | E21B 25/00 175/239 |
| 2013/0026766 | A1 | 1/2013 | Ocalan et al. | |
| 2013/0328442 | A1 * | 12/2013 | Hay | H01L 41/06 310/300 |
| 2014/0069720 | A1 | 3/2014 | Gray | |
| 2015/0096744 | A1 | 4/2015 | Signorelli et al. | |
| 2015/0176344 | A1 | 6/2015 | McLoughlin et al. | |
| 2015/0240632 | A1 | 8/2015 | Heinonen et al. | |
| 2016/0090821 | A1 | 3/2016 | Kim | |
| 2016/0164437 | A1 | 6/2016 | Kim et al. | |
| 2016/0258254 | A1 | 9/2016 | Guo et al. | |
| 2017/0067333 | A1 | 3/2017 | Peters et al. | |
| 2018/0066513 | A1 | 3/2018 | Sugiura et al. | |
| 2018/0094685 | A1 | 4/2018 | Marya et al. | |
| 2018/0262127 | A1 | 9/2018 | Gooneratne et al. | |
| 2018/0347319 | A1 | 12/2018 | Feluch et al. | |
| 2019/0112919 | A1 | 4/2019 | Song et al. | |
| 2019/0284907 | A1 | 9/2019 | Loh et al. | |
| 2019/0361139 | A1 | 11/2019 | Palmer et al. | |
| 2020/0165905 | A1 * | 5/2020 | Gooneratne | E21B 49/00 |

FOREIGN PATENT DOCUMENTS

| | | | |
|---|---|---|---|
| CN | 110474559 | A | 11/2019 |
| CN | 110518826 | A | 11/2019 |
| EP | 1250512 | A1 | 10/2002 |
| JP | 2004212347 | A | 7/2004 |
| NL | 7907085 | A | 3/1981 |
| SU | 1434088 | A1 | 10/1988 |
| WO | 2009030925 | A2 | 3/2009 |
| WO | 2010008382 | A1 | 1/2010 |
| WO | 2017/160305 | A1 | 9/2017 |
| WO | 2018169906 | A1 | 9/2018 |
| WO | 2019169510 | A1 | 9/2019 |

OTHER PUBLICATIONS

Wei, Chongfeng and Xingjian Jing, "A comprehensive review on vibration energy harvesting: Modelling and realization", Renewable and Sustainable Energy Reviews, ScienceDirect, Elsevier Ltd., vol. 74, Feb. 2017, pp. 1-18 (18 pages).

Xie, Yuedong et al., "A self-powered radio frequency (RF) transmission system based on the combination of triboelectric nanogenerator (TENG) and piezoelectric element for disaster rescue/relief", Nano Energy, Author's Accepted Manuscript, Elsevier Ltd., Oct. 2018 (24 pages).

Yang, Zhengbao et al., "High-Performance Piezoelectric Energy Harvesters and Their Applications", Joule, CellPress, Elsevier Inc., vol. 2, Apr. 2018. pp. 642-697 (56 pages).

Zhang, Xingtian et al., "A portable high-efficiency electromagnetic energy harvesting system using supercapacitors for renewable energy applications in railroads", Energy Conversion and Management, ScienceDirect, Elsevier Ltd., vol. 118, Apr. 2016, pp. 287-294 (8 pages).

Zhao, Shulin et al., "Advances in Sn-Based Catalysts for Electrochemical CO2 Reduction", Nano-Micro Letters, Shanghai Jiao Tong University Press, Springer, vol. 11, No. 62, Jul. 2019 (19 pages).

Zou, Hong-Xiang et al., "Mechanical modulations for enhancing energy harvesting: Principles, methods and applications", Applied Energy, ScienceDirect, Elsevier Ltd., vol. 255, No. 113871, Sep. 2019 (18 pages).

"Wireless environmental sensor: Wireless environmental sensor system integrated circuits and reference designs", Texas Instruments Incorporated, Access Date: Oct. 27, 2020, URL:<https://www.ti.com/solution/wireless-environmental-sensor (3 pages).

"MEMS and Sensors", ST Life.Augmented, STMicroelectronics, Access Date: Oct. 27, 2020, URL: https://www.st.com/en/mems-and-sensors.html> (2 pages).

"SQ-MIN-200: Tilt & Vibration Sensor, Ultra Low Power, Omnidirectional", SignalQuest: Precision Microsensors, SignalQuest, LLC, Access Date: Oct. 27, 2020, URL:<https://signalquest.com/product/components/sq-min-200/> (3 pages).

"Solutions for sensor networks for the Internet of Things", IMEC, Access Date: Oct. 27, 2020, URL:<https://www.imec-int.com/en/sensor-networks-for-IoT> (11 pages).

"Ultrasocic Time of Flight Sensing: Introducing the CH201 Long-Range Ultrasonic Time-of-Flight Sensor", TDK Chirp Microsystems, Chirp Microsystems, Inc., Access Date: Oct. 27, 2020, URL:<https://www.chirpmicro.com/> (10 pages).

"URM07-UART Low-Power Consumption Ultrasonic Sensor (20~750cm)", DFROBOT: Drive the Future, DFRobot, Date Accessed: Oct. 27, 2020, URL:<https://www.dfrobot.com/product-1057.html> (4 pages).

"PTC2202UK: Ultra-low-power, 1.8V, 1 deg. C accuracy, digital temperature sensor with I2C bus interface", NXP, NXP Semiconductors, Access Date: Oct. 27, 2020, URL:<https://www.nxp.com/products/sensors/ic-digital-temperature-sensors/ultra-low-power-1-8-v-1-deg-c-accuracy-digital-temperature-sensor-with-ic-bus-interface:PCT2202UK> (2 pages).

"STMicroelectronics Outlines Always-On 6-Axis Ultra-Performance Accelerometer/Gyroscope Combo that Drops the Power/Space Bar", ST Life.Augmented, STMicroelectronics, Sep. 2014, URL:<https://www.st.com/content/st_com/en/about/media-center/press-item.html/p3610d.html> (2 pages).

"Ultra-low Power Management", EnOcean Self-powered IoT, EnOcean GmbH, Access Date: Oct. 27, 2020, URL:<https://www.enocean.com/en/technology/energy-harvesting-wireless/> (2 pages).

"Self-Powered Industrial IoT", Everactive, Access Date: Oct. 27, 2020, URL:<https://everactive.com/#tech-page> (7 pages).

"Ultra-Low Power Management for IoT Devices", Article Library, Digi-Key Electronics, Jan. 2018, URL:<https://www.digikey.com/en/articles/ultra-low-power-management-for-iot-devices> (8 pages).

"Smaller, Smarter, Ultra-Low-Power Sensors Raise Potential for Energy Harvesting in Medical Implants", Article Library, Digi-Key Electronics, Sep. 2013, URL:<https://www.digikey.com/en/articles/smaller-smarter-ultralowpower-sensors-raise-potential-for-energy-harvesting-in-medical-implants> (7 pages).

"No Dilemma: Realtime Data, immediate Alerting and longest Battery Endurance", Technologies: Ultra Low Power Sensors, Pikkerton; Ein Unternehmen der Thelen-Gruppe, Pikkerton GmbH, Access Date: Oct. 27, 2020, URL:<https://www.pikkerton.com/Technologies/UltraLowPowerSensors/UltraLowPowerSensors.htm> (2 pages).

Kanegaonkar, Hari B., "Smart Technology Applications in Offshore Structural Systems: Status and Needs", Proceedings of the Ninth

(56) References Cited

OTHER PUBLICATIONS (1999) International Offshore and Polar Engineering Conference, The International Society of Offshore and Polar Engineers, May 1999, pp. 231-236 (6 pages).
Gilbertson, Eric et al., "A Thermally Actuated Gas-Lift Safety Valve", SPE 161930, SPE Production & Operations, Society of Petroleum Engineers, Feb. 2013, pp. 77-84 (8 pages).
Wang, Lei and F G Yuan, "Vibration energy harvesting by magnetostrictive material", Smart Materials and Structures, IOP Publishing, vol. 17, No. 045009, Jun. 2008 (14 pages).
Beidaghi, Majid and Yury Gogotsi, "Capacitive energy storage in micro-scale devices: recent advances in design and fabrication of micro-supercapacitors", Energy & Environmental Science, Royal Society of Chemistry, vol. 7, Jan. 2014, pp. 867-884 (18 pages).
Liu, Wei et al., "Flexible and Stretchable Energy Storage: Recent Advances and Future Perspectives", Materials Views, Advanced Materials, Wiley-VCH Verlag GmbH & Co. KGaA, 2016 (34 pages).
Wang, Peihong et al., "Complementary Electromagnetic-Triboelectric Active Sensor for Detecting Multiple Mechanical Triggering", Advanced Functional Materials, Wiley-Verlag GbmH & Co. KGaA, vol. 28, No. 1705808, 2018 (9 pages).
Wang, Faxing et al., "Latest advances in supercapacitors: from new electrode materials to novel device designs", Chemical Society Reviews, Royal Society of Chemistry, vol. 46, Sep. 2017, pp. 6816-6854 (39 pages).
Zhai, Shengli et al., "1D Supercapacitors for Emerging Electronics: Current Status and Future Directions", Author Manuscript, doi: 10.1002/adma.201902387 (36 pages).
Zhang, Xu et al., "MXene-based materials for electrochemical energy storage", Journal of Energy Chemistry, ScienceDirect, Elsevier B.V., vol. 27, Aug. 2017, pp. 73-85 (13 pages).
Zhang, Panpan et al., "Two-dimensional materials for miniaturized energy storage devices: from individual devices to smart integrated systems", Chemical Society Reviews, Royal Society of Chemistry, vol. 47, Sep. 2018, pp. 7426-7451 (26 pages).
Lin, Zong-Hong et al., "Triboelectric Nanogenerator as an Active UV Photodetector", Material Views, Advanced Functional Materials, Wiley-VCH Verlag GmbH & Co. KGaA, vol. 24, 2014, pp. 2810-2816 (7 pages).
Hu, Youfan and Zhong Lin Wang, "Recent Progress in Piezoelectric Nanogenerators as Sustainable Power Source in Self-powered Systems and Active Sensors", Nano Energy, ScienceDirect, Elsevier Ltd., vol. 14, May 2015 (26 pages).
Wen, Xiaonan et al., "Development and progress in piezoelectronics", Nano Energy, ScienceDirect, Elsevier Ltd., 2015 (20 pages).
Zhang, Xiao-Sheng et al., "High performance triboelectric nanogenerators based on large-scale mass-fabrication technologies", Nano Energy, ScienceDirect, Elsevier Ltd , vol. 11, Nov. 2014, pp. 304-322.
Kim, Dong Hyun et al., "In Vito Self-Powered Wireless Transmission Using Biocompatible Flexible Energy Harvesters", Energy Harvesting, Advanced Functional Materials, Wiley-VCH Verlag GmbH & Co. KGaA, vol. 27, No. 1700341, 2017 (8 pages).
Zhu, Dibin et al., "A credit card sized self powered smart sensor node", Sensors and Actuators A: Physical, ScienceDirect, Elsevier B.V., 2011, doi:10.1016/j.sna.2011.01.015 (9 pages).
Zhu, Guang et al., "Self-Powered, Ultrasensitive, Flexible Tactile Sensors Based on Contact Electrification", Nano Letters, ACS Publications, American Chemical Society, vol. 14, May 2014, pp. 3208-3213 (6 pages).
Chen, Yandong et al., "Energy Harvesting and Wireless Power Transmission by a Hybridized Electromagnetic-triboelectric Nanogenerator", Energy & Environmental Science, 2019, doi:10.1039-C9EE01245A, (8 pages).
Yang, Hongmei et al., "A full-packaged rolling triboelectric-electromagnetic hybrid nanogenerator for energy harvesting and building up self-powered wireless systems", Nano Energy, Nov. 2018, https://doi.org/10.1016/j.nanoen.2018.11.043 (26 pages).
Zhang, Shuo et al., "Strain-controlled power devices as inspired by human reflex", Nature Communications, 2020, https://doi.org/10.1038/s41467-019-14234-7 (9 pages).
Liu, Guanlin et al., "Wireless Electric Energy Transmission through Various Isolated Solid Media Based on Triboelectric Nanogenerator", Triboelectric Nanogenerators, Advanced Energy Materials, Wiley-VCH Verlag GmbH & Co. KGaA, No. 1703086, 2018 (7 pages).
Cao, Shengli et al., "Wireless Power Transmission Enabled by a Triboelectric Nanogenerator via a Magnetic Interaction", Energy Technology, Wiley-VCH Verlag GmbH & Co. KGaA, vol. 7, No. 1900503, 2019 (6 pages).
"STMicroelectronics LIS2D MEMS Digital Output Motion Sensors", ST life.augmented, Sep. 2018, URL: <https://www.mouser.com/new/sensors/motion-position-sensors/stm-lis2dh/n-6g7q6Z28tvc4> (3 pages).
Arms, S.W. et al., "Power Management for Energy Harvesting Wireless Sensors", SPIE Int'l Symposium on Smart Structures & Materials, Society of Photo-Optical Instrumentation Engineers, Mar. 2005 (9 pages).
Mallineni, Sai Sunil Kumar et al., "A Wireless Triboelectric Nanogenerator", 1702736, Communication: Triboelectric Nanogenerators, Advanced Energy Materials, Wiley-VCH Verlag GmbH & Co. KGaA, 2017 (7 pages).
Babayo, Aliyu Aliyu et al., "A Review on energy management schemes in energy harvesting wireless sensor networks". Renewable and Sustainable Energy Reviews, ScienceDirect, Elsevier Ltd., vol. 76, Mar. 2017, pp. 1176-1184 (9 pages).
Beeby, S P et al., "Energy harvesting vibration sources for microsystems applications", Review Article, Measurement Science and Technology, Institute of Physics Publishing, vol. 17, Oct. 2006, pp. R175-R195 (21 pages).
Briscoe, Joe and Steve Dunn, "Piezoelectric nanogenerators—a review of nanostructured piezoelectric energy harvesters", Nano Energy, ScienceDirect, Elsevier Ltd., vol. 14, Jan. 2015, pp. 15-29 (15 pages).
Lethien, Christophe et al., "Challenges and prospects of 3D micro-supercapacitors for powering the internet of things", Energy & Environmental Science, Royal Society of Chemistry, Oct. 2018 (20 pages).
Cheng, Gang et al., "Managing and maximizing the output power of a triboelectric nanogenerator by controlled tip-electrode air-discharging and application for UV sensing", Nano Energy, ScienceDirect, Elsevier Ltd., vol. 44, Dec. 2017, pp. 208-216 (9 pages).
Cook-Chennault, K A et al., "Topical Review: Powering MEMS portable devices—a review of non-regenerative and regenerative power supply systems with special emphasis on piezoelectric energy harvesting systems", Smart Materials and Structures, IOP Publishing, vol. 17, No. 043001, Jun. 2008 (33 pages).
Dong, Lin et al., "Vibration-Energy-Harvesting System: Transduction Mechanisms, Frequency Tuning Techniques, and Biomechanical Applications", Review: Energy Harvesting, Advanced Materials Technologies, Wiley-VCH Verlag GmbH & Co. KGaA, Aug. 2019 (28 pages).
Elvin, N et al., "A self-powered damage detection sensor", S07401, J. Strain Analysis, IMechE, vol. 38, No. 2, 2003, pp. 115-124 (10 pages).
Wang, Xianfu et al., "Flexible Energy-Storage Devices: Design Consideration and Recent Progress", Material Views, Advanced Materials, Wiley-VCH Verlag GmbH & Co. KGaA, vol. 26, 2014, pp. 4763-4782 (20 pages).
Guan, Mingjie and Wei-Hsin Liao, "Design and analysis of a piezoelectric energy harvester for rotational motion system", Envery Conversion and Management, ScienceDirect, Elsevier Ltd., vol. 111, Jan. 2016, pp. 239-244 (6 pages).
Han, Mengdi et al., "Magnetic-assisted triboelectric nanogenerators as self-powered visualized omnidirectional tilt sensing system", Scientific Reports, vol. 4, No. 4811, Apr. 2014 (7 pages).
Hester, Josiah and Jacob Sorber, "Flicker: Rapid Prototyping for the Batteryless Internet-of-Things", SenSys '17, Association for Computing Machinery, Nov. 2017 (13 pages).

(56) References Cited

OTHER PUBLICATIONS

Huang, Jun et al., "Wireless Power Transfer and Energy Harvesting: Current Status and Future Prospects", IEEE Wireless Communications, Aug. 2019, pp. 163-169 (7 pages).
Jeerapan, Itthipon and Sujittra Poorahong, "Review—Flexible and Stretchable Electrochemical Sensing Systems Materials, Energy Sources, and Integrations", Journal of the Electromechanical Society, The Electromechanical Society, IOP Publishing, vol. 167, No. 037573, Mar. 2020 (19 pages).
Jia, Rui et al., "Flexible on-chip micro-supercapacitors: Efficient power units for wearable electronics", Energy Storage Materials, ScienceDirect, Elsevier B.V., vol. 27, Jan. 2020, pp. 169-186 (18 pages).
Kang, Min-Gyu et al., "Review: Recent Progress on PZT Based Piezoelectric Energy Harvesting Technologies", Actuators, MDPI, vol. 5, No. 5, Feb. 2016 (17 pages).
Kyerematen, Nana Amponash et al., "Microsupercapacitors as miniturized energy-storage components for on-chip electronics". Nature Nanotechnology, Macmillan Publishers Limited, vol. 12, Nov. 2016, pp. 7-15 (9 pages).
Chen, Zheng et al., "Combustion and emissions characteristics of high n-butanol/diesel ratio blend in a heavy-duty diesel engine and EGR impact", Energy Conversion and Management, ScienceDirect, Elsevier Ltd., vol. 78, Dec. 2013, pp. 787-795 (9 pages).
Lee, Jae Won et al., "Robust nanogenerators based on graft copolymers via control of dielectrics for remarkable output power enhancement", Applied Sciences and Engineering, Science Advances, American Association for the Advancement of Science, vol. 3, May 2017 (10 pages).
LaCost, Eddie, "Battery-Less NFC/RFID Temperature Sensing Patch", Application Report, SLOA212A, Texas Instruments Incorporated, Dec. 2014; Revised Feb. 2016 (12 pages).
"TI Designs: Multi-Standard CC2650 SensorTag Design Guide", TIDU862, Texas Instruments Incorporated, Mar. 2015 (40 pages).
"ADXL362 Data Shee", Analog Devices: Micropower, 3-Axis, ±2 gl±4 gl±8 g Digital Output MEMS Accelerometer, Analog Devices, Inc., Aug. 2012 (43 pages).
Frantzke, Andre, "A Low-Power Battery-Less Wireless Temperature and Humidity Sensor for the TI PALFI Device", Application Report: SWRA395, Texas Instruments Incorporated, Nov. 2011 (21 pages).
"DRV5032 Ultra-Low-Power Digital-Switch Hall Effect Sensor", SLVSDC7E, Texas Instruments Incorporated, Apr. 2017, Revised Jan. 2020 (40 pages).
"MEMS digital output motion sensor: ultra-low-power- high-performance 3-axis 'nano' accelerometer", LIS3DH, Datasheet—production data, DocID17530, Rev. 2, ST: life.augmented, Dec. 2016 (54 pages).
Liu, Qi et al., "Wireless Single-Electrode Self-Powered Piezoelectric Sensor for Monitoring", ACS Applied Materials & Interfaces, American Chemical Society, vol. 12, Jan. 2020, pp. 8288-8295 (8 pages).
Najaf, K. et al., "Microsystems for Energy Harvesting", W1D.001, Transducers'11, IEEE, Jun. 2011, pp. 1845-1850 (6 pages).
Yang, Peihua and Wenjie Mai, "Flexible solid-state electrochemical supercapacitors", Nano Energy, ScienceDirect, Elsevier Ltd , vol. 8, Jun. 2014, pp. 274-290 (17 pages).
Khan, Asif Abdullah et al., "A self-powered multi-broadcasting wireless sensing system realized with an all-in-one triboelectric nanogenerator", Nano Energy, ScienceDirect, Elsevier Ltd., vol. 62, Jun. 2019, pp. 691-699 (9 pages).
Nechibvute, Action et al., "Review Article: Piezoelectric Energy Harvesting Devices: An Alternative Energy Source for Wireless Sensors", Article ID 853481, Smart Materials Research, Hindawi Publishing Corporation, 2012 (13 pages).
Park, Kwi-Il et al., "Highly-Efficient, Flexible Piezoelectric PZT Thin Film Nanogenerator on Plastic Substrates", Advanced Materials, Materials Views, Wiley-VCH Verlang GmbH & Co. KGaA, vol. 26, 2014, pp. 2514-2520 (7 pages).
Patil, Swati and Dong-Weon Lee, "Topical Review: Status review on the MEMS-based flexible supercapacitors", Journal of Micromechanics and Microengineering, IOP Publishing, vol. 29, No. 093001, Jun. 2019 (21 pages).
Selvan, Krishna Veni et al., "Micro-scale energy harvesting devices: Review of methodological performances in the last decade", Renewable and Sustainable Energy Reviews, ScienceDirect, Elsevier Ltd., vol. 54, Nov. 2015, pp. 1035-1047 (13 pages).
Shaikh, Faisal Karim and Sherali Zeadally, "Energy harvesting in wireless sensor networks: A comprehensive review", Renewable and Sustainable Energy Reviews, ScienceDirect, Elsevier Ltd., vol. 55, Dec. 2015, pp. 1041-1054 (14 pages).
Shenck, Nathan S. and Joseph A. Paradiso, "Energy Scavenging with Shoe-Mounted Piezoelectronics", IEEE Micro, IEEE, May-Jun. 2001, pp. 30-42 (13 pages).
Siddique, Abu Raihan Mohammad et al., "A comprehensive review on vibration based micro power generators using electromagnetic and piezoelectric transducer mechanisms", Energy Conversion and Management, ScienceDirect, Elsevier Ltd., vol. 106, Oct. 2015, pp. 728-747 (20 pages).
Li, Bodong et al., "Implementation of a Drilling Microchip for Downhole Data Aquisition", SPE-186330-MS, Society of Petroleum Engineers, Oct. 2017 (9 pages).
Tang, Wei et al., "A power-transformed-and-managed triboelectric nanogenerator and its applications in a self-powered wireless sensing node", Nanotechnology, IOP Publishing, vol. 25, No. 225402, May 2014 (7 pages).
Dekkers, Gert et al., "The Sins Database for Detection of Daily Activities in a Home Environment Using an Acoustic Sensor Network", Detection and Classification of Acoustic Scenes and Events, Nov. 2017 (5 pages).
Toprak, Alperen and Onur Tigli, "Piezoelectric energy harvesting: State-of-the-art and challenges", Applied Physics Reviews, AIP Publishing LLC, vol. 1, No. 031104, Sep. 2014 (14 pages).
Dubai, Deepak P. et al., "Towards flexible solid-state supercapacitors for smart and wearable electronics", Chemical Society Reviews, Royal Society of Chemistry, vol. 47, Feb. 2018, pp. 2065-2129 (65 pages).
Schaijk, R. van et al., "A MEMS vibration energy harvester for automotive applications", Smart Sensors, Actuators, and MEMS VI, Eds. Ulrich Schmid et al., SPIE, vol. 8763, No. 876305-1, 2013 (10 pages).
Vasandani, Paresh et al., "Using a synchronous switch to enhance output performance of triboelectric nanogeneratores", Nano Energy, ScienceDirect, Elsevier Ltd., vol. 43, Nov. 2017, pp. 210-218 (9 pages).
Peng, Limin et al., "Research Article: Mechanic and Acoustic Properties of the Sound-Absorbing Material Made from Natural Fiber and Polyester", Article ID 274913, Advances in Materials Science and Engineering, Hindawi Publishing Corporation, vol. 2015 (5 pages).
Wang, Zhong Lin et al., "Progress in triboelectric nanogenerators as new energy technology and self-powered sensors", Energy & Environmental Science, RSC Publishing, The Royal Society of Chemistry, Jan. 2014 (41 pages).
Wang, Zhong Lin et al., "Progress in nanogenerators for portable electronics", Materials Today, Elsevier Ltd., vol. 15, No. 12, Dec. 2012, pp. 532-543 (12 pages).
Wang, Sihong et al., "Nanoscale Triboelectric-Effect-Enabled Energy Conversion for Sustainability Powering Portable Electronics", Nano Letters, ACS Publications, American Chemical Society, vol. 12, Nov. 2012, pp. 6339-6346 (8 pages).
Wang, Zhong Lin and Wenzhou Wu, "Nanotechnolgy-Enabled Energy Harvesting for Self-Powered Micro-/Nanosystems", Angewandte Reviews, Angewandte Chemie: International Edition, Wiley-VCH Verlag GmbH & Co. KGaA, vol. 51, 2012, pp. 2-24 (23 pages).
International Search Report and Written Opinion of the International Searching Authority issued in corresponding International Application No. PCT/US2020/051526, dated Apr. 22, 2021 (15 pages).

(56) References Cited

OTHER PUBLICATIONS

International Search Report and Written Opinion of the International Searching Authority issued in corresponding International Application No. PCT/US2020/051531, dated Apr. 20, 2021 (17 pages).
International Search Report and Written Opinion of the International Searching Authority issued in corresponding International Application No. PCT/US2020/051539, dated Apr. 26, 2021 (15 pages).

* cited by examiner

SELF-POWERED SENSORS FOR DETECTING DOWNHOLE PARAMETERS

BACKGROUND

Obtaining logging data by wireline is a costly process since the drilling assembly has to be pulled out of the wellbore first to run the wireline assembly. This also means that logging data cannot be obtained while drilling. There is also a risk of the wireline assembly getting stuck inside the hole along with all its expensive sensors, instrumentation thereby significantly adding to the cost of drilling a well.

More recent surveying and logging tools used in downhole environments consist of Measurement While Drilling (MWD) tools and Logging While Drilling (LWD) tools. The basic MWD tool measures wellbore parameters such as tool face orientation, inclination, azimuth, as well as environmental data such as internal temperature, tool vibration. Some dedicated near bit tools provide measurements of additional drilling parameters such as weight on bit (WOB), bit torque, etc. Typical LWD tools measure formation parameters such as gamma ray, neutron density/porosity, resistivity and nuclear magnetic resonance. The LWD tools come in combo packages, where the drilling engineer has the option of choosing the LWD tools required for a given well section.

However, data obtained by the MWD/LWD might not stay constant and may change over time due to drilling and other operations performed inside a wellbore. For example, data acquired by MWD/LWD sensors at certain depths along a wellbore may change over time. Therefore, it is not possible to obtain real-time information of these parameters at these depths unless the MWD/LWD sensors are run again at these depths, which is very costly and not feasible.

In wireline operations, the power to the wireline sensors and instrumentation are provided by a wired power line that extends from the power source at the surface all the way down to the well depth. The power to MWD and LWD is provided by rechargeable lithium battery packs and/or turbine/alternator. One of the major drawbacks of lithium batteries is their cost. Moreover, lithium batteries suffer from ageing, which depends on the number of charge-discharge cycles the battery has undergone. Also, lithium batteries expire resulting in large volumes of contaminated waste. Therefore, the usage of lithium batteries not only has significant costs in their production life cycle but also has a negative impact on the environment. Mechanical failure rates of batteries are also generally high and can be expected to be higher downhole given the harsh environments they are exposed to. Turbines/alternators harness the kinetic energy of a fluid flow to generate electricity. Therefore, they can only generate electricity when there is a fluid flow inside a drillstring, and the power produced depends on the speed of the fluid flow. Heavy muds and lost circulation material in a drillstring, for example, can significantly reduce the speed of flow in a drillstring and might even block the pathway through the turbines/alternators.

SUMMARY

One or more embodiments may be directed toward a sensor array for sensing environmental parameters along a drillstring. In some embodiments, the sensor array may include an outer collar having a plurality of moveable member retainers formed therein. A plurality of moveable members may be movably disposed in the plurality of moveable member retainers. An inner ring may be rotatably supported within the outer collar. A plurality of bearing elements may be retained on an outer surface of the inner ring, the plurality of bearing elements positioned to displace the plurality of moveable members relative to the plurality of moveable member retainers in response to relative rotation between the inner ring and the outer collar. A plurality of shape memory material elements may be provided, each shape memory material element arranged in one of the plurality of moveable member retainers. The sensor array may also include a plurality of distance sensors, each distance sensor disposed in a respective moveable member retainer of the plurality of moveable member retainers and between a respective shape memory material element in the respective moveable member retainer and a respective moveable member movably disposed in the moveable member retainer. Each distance sensor may include a first sensing element and a second sensing element arranged in opposing relation, the first sensing element and the second sensing element separated by a gap that is responsive to a shape change of a respective shape memory material element and a displacement of the respective moveable member.

In some embodiments of the sensor array, the shape change of each shape memory material element may reflect the environmental parameters.

In some embodiments of the sensor array, the plurality of shape memory material elements may be formed of multiple shape memory materials having different responses to the environmental parameters.

In some embodiments of the sensor array, the first sensing element may include a magnetic detector and the second sensing element may include a magnetic target. In some embodiments of the sensor array, the magnetic detector may be configured to detect a magnetic field across the gap between the magnetic detector and the magnetic target. In some embodiments of the sensor array, an output of the magnetic detector may be a function of the magnetic field.

In some embodiments of the sensor array, the first sensing element may include a ground electrode detector and the second sensing element may include a drive electrode target. In some embodiments of the sensor array, the ground electrode detector may be configured to detect a capacitance across the gap between the ground electrode detector and the drive electrode target. In some embodiments of the sensor array, an output of the ground electrode detector may be a function of the capacitance.

In some embodiments of the sensor array, the first sensing element may include an optical transducer detector and the second sensing element may include an optical reflector target. In some embodiments of the sensor array, the optical transducer detector may be configured to generate an emitted optical signal, the emitted optical signal may traverse the gap, the emitted optical signal may be reflected from the optical reflector target, the reflected optical signal may traverse the gap, and the optical transducer detector may detect the emitted optical signal after an optical elapsed time. In some embodiments of the sensor array, an output of the optical transducer detector may be a function of the optical elapsed time.

In some embodiments of the sensor array, the first sensing element may include an acoustic transducer detector and the second sensing element may include an acoustic reflector target. In some embodiments of the sensor array, the acoustic transducer detector may be configured to generate an emitted acoustic signal, the emitted acoustic signal may traverse the gap, the emitted acoustic signal may be reflected from the acoustic reflector target, the reflected acoustic signal may traverse the gap, and the acoustic transducer detector may detect the emitted acoustic signal after an acoustic elapsed time. In some embodiments of the sensor array, an output of the acoustic transducer detector may be a function of the acoustic elapsed time.

Some embodiments of the sensor array may further include a plurality of extension mechanisms positioned in each of the plurality of moveable member retainers, where each extension mechanism may be configured to return the respective moveable member to an extended position after contact between one of the plurality of bearing elements and the respective moveable member is released.

In some embodiments of the sensor array, each of the plurality of shape memory material elements may be formed of shape memory materials including at least one of a shape-memory alloy, a shape-memory polymer, a shape-memory gel, a shape-memory ceramic, a liquid crystal elastomer, or MXene, or combinations thereof.

In some embodiments of the sensor array, the shape change of the plurality of shape memory material elements may reflect at least one of temperature, pressure, stress, strain, current, voltage, magnetic field, pH, humidity, composition, or light, thereby changing the gap.

In some embodiments of the sensor array, the outer collar may include a first inner surface, a second inner surface portion in opposed relation to the first inner surface, and a third inner surface connecting the first inner surface to the second inner surface. In some embodiments of the sensor array, the plurality of bearing elements may be distributed among at least two of the inner surfaces.

In some embodiments of the sensor array, for each of the plurality of distance sensors, the first sensing element may be a detector and the second sensing element may be a target.

In some embodiments of the sensor array, for each of the plurality of distance sensors, the detector may be disposed on the respective shape memory material element and the target may be disposed on the respective moveable member.

In some embodiments of the sensor array, within the plurality of distance sensors, the first sensing elements may include at least two of a magnetic detector, a ground electrode detector, an optical transducer detector, and an acoustic transducer detector.

In some embodiments of the sensor array, the plurality of moveable members may have convex surfaces for contact with the plurality of bearing elements.

Some embodiments of the sensor array may further include a plurality of extension mechanisms positioned in each of the plurality of moveable member retainers, where each extension mechanism may be configured to apply a biasing force to the respective moveable member in a direction towards the inner ring.

In some embodiments of the sensor array, the extension mechanisms may include one or more springs disposed within the moveable member retainer and arranged to apply the biasing force to the moveable members.

In some embodiments of the sensor array, the plurality of bearing elements may be positioned to support rotation of the inner ring relative to the outer collar.

In some embodiments of the sensor array, at least one raceway may be formed in the outer collar to receive the plurality of bearing elements and guide movement of the plurality of bearing elements.

In some embodiments of the sensor array, at least a portion of the plurality of moveable member retainers may intersect the at least one raceway to enable the plurality of bearing elements to releasably contact at least a portion of the plurality of moveable members.

Some embodiments of the sensor array may further include at least one communications device for transmitting and receiving signals. In some embodiments of the sensor array, the at least one communications device may be carried by the outer collar.

In some embodiments of the sensor array, a first fraction of the plurality of moveable member retainers may be disposed on an inner surface of the outer collar. In some embodiments of the sensor array, a first fraction of the plurality of bearing elements may be configured and arranged such that, during rotation, the first fraction of the plurality of bearing elements travels along the inner surface of the outer collar and contacts a first fraction of the plurality of moveable members within the first fraction of the plurality of moveable member retainers.

In some embodiments of the sensor array, the first fraction of the plurality of moveable member retainers may be disposed within a first raceway on the inner surface of the outer collar such that the first fraction of the plurality of moveable members extend into the first raceway. In some embodiments of the sensor array, the first fraction of the plurality of bearing elements may be configured and arranged such that, during rotation, the first fraction of the plurality of bearing elements travels along the first raceway and contacts the first fraction of the plurality of moveable members.

In some embodiments of the sensor array, the first fraction of the plurality of moveable member retainers may be disposed on a middle inner surface of the outer collar. In some embodiments of the sensor array, a second fraction of the plurality of moveable member retainers may be disposed on a top inner surface of the outer collar. In some embodiments of the sensor array, a second fraction of the plurality of bearing elements may be configured and arranged such that, during rotation, the second fraction of the plurality of bearing elements travels along the top inner surface of the outer collar and contacts a second fraction of the plurality of moveable members within the second fraction of the plurality of moveable member retainers. In some embodiments of the sensor array, a third fraction of the plurality of moveable member retainers may be disposed a bottom inner surface of the outer collar. In some embodiments of the sensor array, a third fraction of the plurality of bearing elements may be configured and arranged such that, during rotation, the third fraction of the plurality of bearings travels along the bottom inner surface of the outer collar and contacts a third fraction of the plurality of moveable members within the third fraction of the plurality of moveable member retainers.

In some embodiments of the sensor array, a first fraction of the plurality of shape memory material elements in the first fraction of moveable member retainers may include a first shape memory material having a first response to the environmental parameters. In some embodiments of the sensor array, a second fraction of the plurality of shape memory material elements in the second fraction of moveable member retainers may include a second shape memory material having a second response to the environmental parameters. In some embodiments of the sensor array, a third fraction of the plurality of shape memory material elements in the third fraction of moveable member retainers may include a third shape memory material having a third response to the environmental parameters.

One or more embodiments may be directed toward a power array for generating power along a drillstring. In some embodiments, the power array may include an outer collar having a plurality of moveable member retainers formed therein. A plurality of moveable members may be movably disposed in the plurality of moveable member retainers. An inner ring may be rotatably supported within the outer collar. A plurality of bearing elements may be retained on an outer surface of the inner ring, the plurality of bearing elements positioned to displace the plurality of moveable members relative to the plurality of moveable member retainers in response to relative rotation between the inner ring and the outer collar. The power array may also include a plurality of power generation components. Each power generation component may be arranged and configured such that, in response to the relative rotation, the plurality of bearing elements displace a respective moveable member into a respective moveable member retainer, generating an electric charge.

In some embodiments of the power array, the plurality of power generation components may be configured to generate the electric charge via one or more of: a triboelectric effect resulting from contact between a first frictional material and a second frictional material having different polarities; a piezoelectric effect resulting from compression or flexion of a piezoelectric material; or a magnetostrictive effect resulting from compression of a magnetostrictive material to generate a magnetic field that is converted to the electric charge.

In some embodiments of the power array, the plurality of power generation components may include: the plurality of bearing elements formed of or coated with the first frictional material; and the plurality of the moveable members formed of or coated with the second frictional material.

In some embodiments of the power array, the plurality of power generation components may include: the plurality of moveable member retainers formed of or coated with the first frictional material; and the plurality of moveable members formed of or coated with the second frictional material.

In some embodiments of the power array, the plurality of power generation components may include: a piezoelectric base disposed in the respective moveable member retainer that generates the electric charge when compressed by the respective moveable member.

In some embodiments of the power array, the plurality of power generation components may include: a piezoelectric nanoribbon base disposed in the respective moveable member retainer that generates the electric charge when compressed or flexed by the respective moveable member.

In some embodiments of the power array, the plurality of power generation components may include: a magnetostrictive base disposed in the respective moveable member retainer that generates electricity when the compression of the magnetostrictive base by the respective moveable member generates the magnetic field and the magnetic field is converted to the electric charge by a planar pick-up coil or a solenoid disposed near the magnetostrictive base.

In some embodiments of the power array, the outer collar may include a first inner surface, a second inner surface portion in opposed relation to the first inner surface, and a third inner surface connecting the first inner surface to the second inner surface. In some embodiments of the power array, the plurality of bearing elements may be distributed among at least two of the inner surfaces.

In some embodiments of the power array, the plurality of moveable members may have convex surfaces for contact with the plurality of bearing elements.

Some embodiments of the power array may further include a plurality of extension mechanisms positioned in each of the plurality of moveable member retainers, where each extension mechanism may be configured to apply a biasing force to the respective moveable member in a direction towards the inner ring.

In some embodiments of the power array, the extension mechanisms may include a spring disposed within the respective moveable member retainer and arranged to apply the biasing force to the respective moveable member.

Some embodiments of the power array may further include a plurality of extension mechanisms positioned in each of the plurality of moveable member retainers, where each extension mechanism may be configured to return the respective moveable member to an extended position after contact between one of the plurality of bearing elements and the respective moveable member is released.

In some embodiments of the power array, the plurality of bearing elements may be positioned to support rotation of the inner ring relative to the outer collar.

In some embodiments of the power array, at least one raceway may be formed in the outer collar to receive the plurality of bearing elements and guide movement of the plurality of bearing elements.

Some embodiments of the power array may further include one or more power storage units.

Some embodiments of the power array may further include a sub shaped as a hollow pipe that defines a flow and has a connector on each axial end for connection to the drillstring. In some embodiments of the power array, the outer collar may be disposed radially around the sub.

One or more embodiments may include a self-powered sensor array for sensing environmental parameters along a drillstring. In some embodiments, the self-powered sensor array may include an outer collar having a plurality of moveable member retainers formed therein. A plurality of moveable members may be movably disposed in the plurality of moveable member retainers. An inner ring may be rotatably supported within the outer collar. A plurality of bearing elements may be retained on an outer surface of the inner ring. Each bearing element may be positioned to displace the moveable members relative to the moveable member retainers in response to relative rotation between the inner ring and the outer collar. A plurality of shape memory material elements may be provided, each shape memory material element arranged in a respective moveable member retainer of a first fraction of the plurality of moveable member retainers. The self-powered sensor array may also include a plurality of distance sensors. Each distance sensor may be disposed in the respective moveable member retainer and between the shape memory material element in the respective moveable member retainer and a respective moveable member movably disposed in the respective moveable member retainer. Each distance sensor may include a first sensing element and a second sensing element arranged in opposing relation, the first sensing element and the second sensing element separated by a gap that is responsive to a shape change of the respective shape memory material element and a displacement of the respective moveable member. The self-powered sensor array may also include a plurality of power generation components. Each power generation component may be arranged in relation to one of a second fraction of the plurality of moveable member retainers. The power generation component may be configured such that, in response to the relative rotation, the plurality of bearing elements displace a particular moveable member into a particular moveable member retainer, generating an electric charge.

In some embodiments of the self-powered sensor array, each of the plurality of shape memory material elements may be formed of shape memory materials including at least one of a shape-memory alloy, a shape-memory polymer, a shape-memory gel, a shape-memory ceramic, a liquid crystal elastomer, or MXene, or combinations thereof.

In some embodiments of the self-powered sensor array, the shape change of each shape memory material element may reflect the environmental parameters.

In some embodiments of the self-powered sensor array, the plurality of shape memory material elements may be formed of multiple shape memory materials having different responses to the environmental parameters.

In some embodiments of the self-powered sensor array, the plurality of distance sensors may include one or more of: a magnetic distance sensor including a magnetic detector and a magnetic target arranged in opposing relation, the magnetic distance sensor configured to detect a magnetic field across the gap and to generate an output of the magnetic distance sensor that is a function of the magnetic field; a capacitive distance sensor including a ground electrode detector and a drive electrode target, the capacitive distance sensor configured to detect a capacitance across the gap and to generate an output of the capacitive distance sensor that is a function of the capacitance; an acoustic distance sensor including an acoustic transducer detector and an acoustic reflector target, the acoustic distance sensor configured to measure an acoustic elapsed time across the gap and to generate an output of the acoustic distance sensor that is a function of the acoustic elapsed time; or an optical distance sensor including an optical transducer detector and an optical reflector target, the optical distance sensor configured to measure an optical elapsed time across the gap and to generate an output of the optical distance sensor that is a function of the optical elapsed time.

In some embodiments of the self-powered sensor array, the plurality of power generation components may include one or more of: a first triboelectric module including the plurality of bearing elements formed of or coated with a first frictional material and the particular moveable member formed of or coated with a second frictional material, that generates the electric charge via contact between the first frictional material and the second frictional material having different polarities; a second triboelectric module including the particular moveable member formed of or coated with the first frictional material and the particular moveable member retainer formed of or coated with the second frictional material, that generates the electric charge via contact between the first frictional material and the second frictional material having different polarities; a third triboelectric module including the particular moveable member retainer and the particular moveable member are each formed of or coated with alternating segments of the first frictional material and the second frictional material, that generates the electric charge via contact between the first frictional material and the second frictional material having different polarities; a piezoelectric base disposed in the particular moveable member retainer that generates the electric charge when compressed by the particular moveable member; a piezoelectric nanoribbon base disposed in the particular moveable member retainer that generates the electric charge when compressed or flexed by the particular moveable member; or a magnetostrictive base disposed in the particular moveable member retainer that generates the electric charge when compression of the magnetostrictive base by the particular moveable member generates a magnetic field and the magnetic field is converted to the electric charge by a planar pick-up coil or a solenoid disposed near the magnetostrictive base.

In some embodiments of the self-powered sensor array, the first fraction of the plurality of moveable member retainers may be disposed on a top inner surface of the outer collar and a bottom inner surface of the outer collar. In some embodiments of the sensor array, the second fraction of the plurality of moveable member retainers may be disposed on a middle inner surface of the outer collar.

In some embodiments of the self-powered sensor array, a first fraction of the plurality of shape memory material elements may be disposed in the plurality of moveable member retainers located on the top inner surface of the outer collar includes a first shape memory material having a first response to the environmental parameters. In some embodiments of the self-powered sensor array, a second fraction of the plurality of shape memory material elements may be disposed in the plurality of moveable member retainers located on the bottom inner surface of the outer collar includes a second shape memory material having a second response to the environmental parameters.

In some embodiments of the self-powered sensor array, the shape change of the plurality of shape memory material elements may reflect at least one of temperature, pressure, stress, strain, current, voltage, magnetic field, pH, humidity, composition, or light, thereby changing the gap.

In some embodiments of the self-powered sensor array, the outer collar may include a first inner surface, a second inner surface portion in opposed relation to the first inner surface, and a third inner surface connecting the first inner surface to the second inner surface. In some embodiments of the self-powered sensor array, the plurality of bearing elements may be distributed among at least two of the inner surfaces.

In some embodiments of the self-powered sensor array, for each of the plurality of distance sensors, the first sensing element may be a detector and the second sensing element may be a target.

In some embodiments of the self-powered sensor array, for each of the plurality of distance sensors, the detector may be disposed on the respective shape memory material element and the target may be disposed on the respective moveable member.

In some embodiments of the self-powered sensor array, the first fraction of the plurality of moveable member retainers may be disposed on a middle inner surface of the outer collar. In some embodiments of the sensor array, the second fraction of the plurality of moveable member retainers may be disposed on a top inner surface of the outer collar and a bottom inner surface of the outer collar.

One or more embodiments may be directed toward a sensing system for sensing environmental parameters along a drillstring. In some embodiments, the sensing system may include a plurality of sensor arrays and a receiver that receives the signal from the communications device within each of the plurality of sensor arrays. In some embodiments of the sensing system, each of the plurality of sensor arrays may include an outer collar having a plurality of moveable member retainers formed therein. A plurality of moveable members may be movably disposed in the plurality of moveable member retainers. An inner ring may be rotatably supported within the outer collar. A plurality of bearing elements may be retained on an outer surface of the inner ring, the plurality of bearing elements positioned to displace the plurality of moveable members relative to the plurality of moveable member retainers in response to relative rotation between the inner ring and the outer collar. A plurality of shape memory material elements may be provided, each shape memory material element arranged in one of the plurality of moveable member retainers. Each of the plurality of sensor arrays may also include a plurality of distance sensors, each distance sensor disposed in a respective moveable member retainer of the plurality of moveable member retainers and between a respective shape memory material element in the respective moveable member retainer and a respective moveable member movably disposed in the moveable member retainer. Each distance sensor may comprise a first sensing element and a second sensing element arranged in opposing relation, the first sensing element and the second sensing element separated by a gap that is responsive to a shape change of a respective shape memory material element and a displacement of the respective moveable member. Each of the plurality of sensor arrays may also include a communications device that transmits a signal that includes sensor data output from each distance sensor.

In some embodiments of the sensing system, the communications device within one or more of the plurality of sensor arrays may be further configured to receive at least one of an instructional signal from the receiver or an incoming data signal from other sensor arrays of the plurality of sensor arrays along the drillstring.

In some embodiments of the sensing system, each of the plurality of sensor arrays may serve as a node within a sensor network such that the nodes relay information between the plurality of sensor arrays and the receiver.

One or more embodiments may be directed toward a sensing system for sensing environmental parameters along a drillstring. In some embodiments, the sensing system may include a plurality of self-powered sensor arrays and a receiver that receives the signal from the communications device within each of the plurality of self-powered sensor arrays. In some embodiments of the sensing system, each of the plurality of self-powered sensor arrays may include an outer collar having a plurality of moveable member retainers formed therein. A plurality of moveable members may be movably disposed in the plurality of moveable member retainers. An inner ring may be rotatably supported within the outer collar. A plurality of bearing elements may be retained on an outer surface of the inner ring, each bearing element positioned to displace the moveable members relative to the moveable member retainers in response to relative rotation between the inner ring and the outer collar. A plurality of shape memory material elements may be provided, each shape memory material element arranged in a respective moveable member retainer of a first fraction of the plurality of moveable member retainers. Each of the plurality of self-powered sensor arrays may also include a plurality of distance sensors, each distance sensor disposed in the respective moveable member retainer and between the shape memory material element in the respective moveable member retainer and a respective moveable member movably disposed in the respective moveable member retainer. Each distance sensor may comprise a first sensing element and a second sensing element arranged in opposing relation, the first sensing element and the second sensing element separated by a gap that is responsive to a shape change of the respective shape memory material element and a displacement of the respective moveable member. Each of the plurality of self-powered sensor arrays may also include a plurality of power generation components. Each power generation component may be arranged in relation to one of a second fraction of the plurality of moveable member retainers. The power generation component may be configured such that, in response to the relative rotation, the plurality of bearing elements displace a particular moveable member into a particular moveable member retainer, generating an electric charge. Each of the plurality of self-powered sensor arrays may also include a communications device that transmits a signal that includes the gap of each distance sensor.

In some embodiments of the sensing system, each of the plurality of self-powered sensor arrays may serve as a node within a sensor network such that the nodes relay information between the plurality of self-powered sensor arrays and the receiver.

In some embodiments of the sensing system, the communications device within one or more of the plurality of self-powered sensor arrays may be further configured to receive at least one of an instructional signal from the receiver or an incoming data signal from other self-powered sensor arrays of the plurality of self-powered sensor arrays along the drillstring.

One or more embodiments may be directed to a method for sensing environmental parameters with a self-powered sensor array. In some embodiments, the method may include disposing a self-powered sensor array on a drillstring, wherein the self-powered sensor array includes an outer collar and an inner ring; disposing the drillstring with the self-powered sensor array in a wellbore; and rotating the outer collar with respect to the inner ring. The method may also include producing mechanical energy in the self-powered sensor array by bearing elements that physically interact with movable members as a result of the relative rotation between the outer collar and the inner ring and converting the mechanical energy to electrical energy by power generation components in the self-powered sensor array. The method may further include generating an output reflecting gaps probed by distance sensors in the self-powered sensor array, where the gaps are responsive to shape changes of shape memory material elements resulting from environmental parameters within the wellbore and displacements of moveable members resulting from the relative rotation.

One or more embodiments may be directed to a method for sensing of environmental parameters. In some embodiments, the method may include disposing a plurality of self-powered sensor arrays on a drillstring, wherein each of the self-powered sensor arrays comprise an outer collar and an inner ring; disposing the drillstring with the plurality of self-powered sensor arrays in a wellbore; and rotating the outer collar with respect to the inner ring of each of the plurality of self-powered sensor arrays. The method may also include producing mechanical energy in each of the plurality of self-powered sensor arrays by bearing elements of each of the plurality of self-powered sensor arrays that physically interact with movable members of the self-powered sensor array as a result of the relative rotation between the outer collar and the inner ring of each of the plurality of self-powered sensor arrays. The method may further include generating an output reflecting gaps probed by distance sensors in each of the plurality of self-powered sensor arrays, where the gaps are responsive to shape changes of shape memory material elements resulting from environmental parameters within the wellbore and displacements of moveable members resulting from the relative rotation between the outer collar and the inner ring of each of the plurality of self-powered sensor arrays.

In some embodiments, the method also includes storing the electrical energy in one or more power storage units in each of the plurality of self-powered sensor arrays and powering the plurality of distance sensors with at least a portion of the electrical energy stored in the energy storage of each respective self-powered sensor array.

Other aspects and advantages of the invention will be apparent from the following description and the appended claims.

BRIEF DESCRIPTION OF DRAWINGS

Throughout the figures, similar numbers are typically used for similar components.

DETAILED DESCRIPTION

Figure 1:
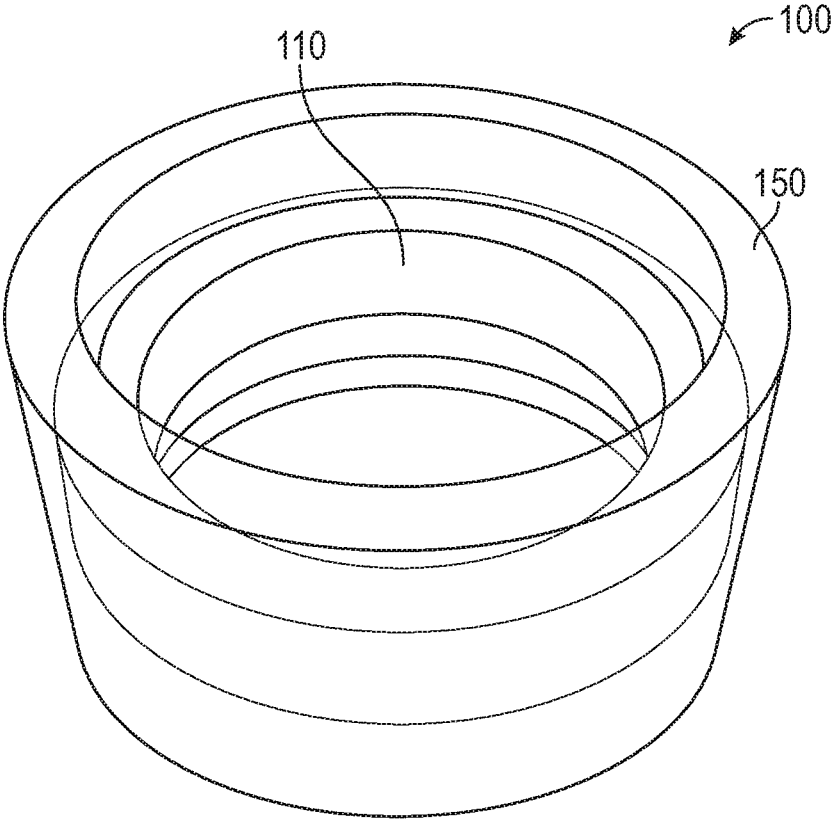
FIG. 1 depicts an embodiment of an array from multiple perspectives.

One or more embodiment may be directed toward a self-powered sensor array (SPSAs) for detecting downhole parameters. The SPSAs may consist of distance sensors and shape-memory materials (SMMs) to detect downhole parameters such as temperature, pressure, composition (e.g., concentration of gases), and pH. The distance sensors may utilize magnetic, capacitive, acoustic, or optical sensing, while the shape-memory material may be a shape-memory alloy, shape-memory polymer, shape-memory gel, shape-memory ceramic, liquid crystal elastomer, or MXene or combinations thereof. A distance detected by the distance sensor changes due to the shape reconfigurability of the SMM in response to external downhole stimuli. Therefore, the distance sensor output changes in response to external downhole stimuli.

Moreover, SPSAs may exploit the rotation of the drillstring assembly during drilling a hydrocarbon well and harvest the resulting energies to generate electricity to power the distance sensors and potentially other instrumentation. The SPSA provides clear advantages over current downhole power generation methods such as batteries and turbines with respect to size, cost, mobility, temperature/pressure tolerance, and potential downhole applications.

Broadly, the SPSA may be comprised of two structures: an inner ring fixedly coupled to a rotating member, such as a drill pipe or production tubing; and an outer collar that envelops the inner ring, may not contact the rotating member, may not change position relative to the rotating member, and frictionlessly couples with the inner member. The inner ring may further comprise a plurality of bearing elements fixedly connected to the outer surface(s). The outer collar may further comprise sensor(s) for detecting a downhole wellbore condition using SMM(s) and a moveable power generator that may generate power upon frictionless contact from a bearing element.

Moreover, the SPSA may improve upon the current limitations/challenges of automation/digitalization in drilling and the fourth industrial revolution (4IR). For example, batteries cannot power the Industrial internet-of-things (IoT) at scale. Since the SPSAs may be self-powered, they may be placed all along the drillstring assembly for distributed sensing of downhole parameters while drilling.

By deploying multiple SPSAs all along the drillstring, a real-time profile of the wellbore may be obtained during the drilling process. Such real-time data profiles may enable drilling operations to take advantage of emerging technologies aligned with the 41R, such as big data analytics and artificial intelligence to transform this data to high-value, actionable insights.

Disclosed here is an array that may be deployed along a drillstring. The array may be a sensor array, a power array, or an SPSA.

One or more embodiments of an array may be directed toward a sensor array for detecting downhole parameters. Each of the sensor arrays may include one or more pairs of distance sensor(s) and shape-memory material(s) (SMMs). The distance sensors may employ magnetic, capacitive, acoustic, or optical sensing. Additionally, the SMMs may change shape due to downhole parameters like temperature, pressure, composition (e.g., concentration of gases), or pH. When the SMM changes shape due to downhole parameters, a distance measured by the distance sensor changes. Therefore, the distance sensor output changes depending on the shape reconfigurability of the SMM in response to the external downhole stimuli.

One or more embodiments of an array may be directed toward as a power array for generating power. A power array may exploit the rotation of the drillstring assembly during drilling a hydrocarbon well by harvesting the resulting energies to generate electricity. Such electricity may power any device, such as distance sensors and other instrumentation.

One or more embodiments of an array may be an SPSA, which combines a sensor array and a power array to create a sensor device that that is self-powered. An SPSA may exploit the rotation of the drillstring assembly by harvesting the resulting energies to generate electricity to power a sensor array as well as other instrumentation.

In one or more embodiments, sensor arrays or SPSAs may be placed all along the drillstring forming a sensing system. This sensor system may obtain real-time distributed sensing data of downhole parameters while drilling. Such real-time data may be used to more effectively monitor the well, allowing more immediate response in the event of a status change. Moreover, such real-time data may enable drilling operations to utilize emerging technologies, such as big data analytics and artificial intelligence, to transform the data into high-value, actionable conclusions.

FIG. 1A depicts an embodiment of an array 100 from an isometric side view. Array 100 includes an inner ring 110 located radially within an outer collar 150. Array 100 may be a sensor array, a power array, or an SPSA.

Figure 2B:
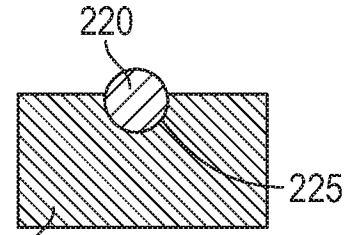
FIGS. 2B and 2C depict cross sections of an embodiment of a bearing element and an embodiment of a sensor moveable member.
Figure 2C:
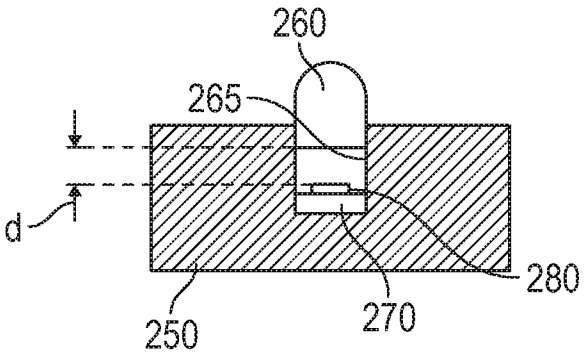
Figure 2A:
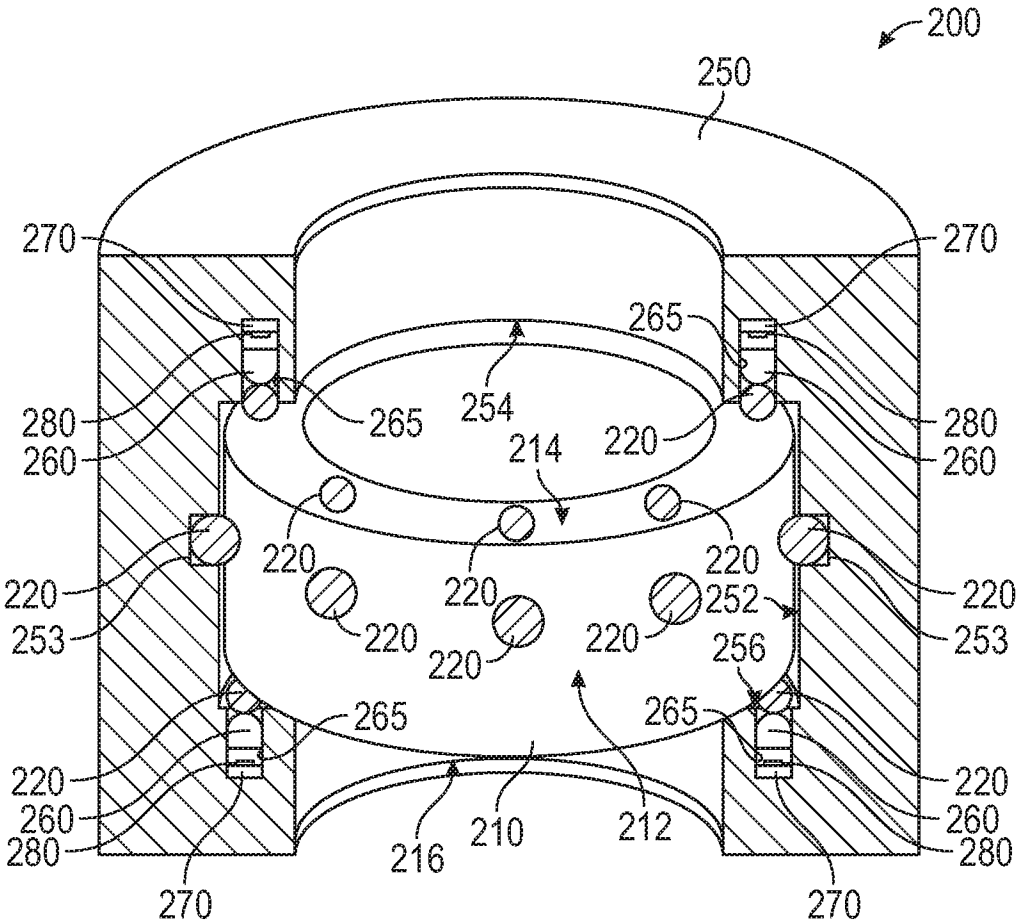
FIG. 2A depicts a cross section of an embodiment of a sensor array.

FIGS. 2A-2C depict an embodiment of an inner ring 210 and an outer collar 250.

FIG. 2A depicts an embodiment of a sensor array 200 where half of outer collar 250 is cut away. On inner ring 210 are bearing elements in the form of bearings 220 located on three outer surfaces: a top outer surface 214, a middle outer surface 212, and a bottom outer surface 216. Additionally, a first fraction of bearings 220 are on middle outer surface 212, a second fraction of bearings 220 are on top outer surface 214, and a third fraction of bearings 220 are on bottom outer surface 216. In some embodiments, bearings 220 may be positioned to support rotation of inner ring 210 relative to outer collar 250.

Within outer collar 250 are three surfaces: a top inner surface 254, a middle inner surface 252, and a bottom inner surface 256. Outer collar 250 has sensor moveable members 260 located on two surfaces: a top inner surface 254 and a bottom inner surface 256. A third surface, a middle inner surface 252 does not have sensor moveable members. Instead, middle inner surface 252 has a raceway 253. Raceway 253 serves to hold inner ring 210 in place relative to outer collar 250. The details of such a connection are detailed further.

Each sensor moveable member 260 is moveably located within a moveable member retainer in the form of a sensor moveable member retainer 265. Also within each sensor moveable member retainer 265 is a shape memory material element 270 and a distance sensor 280. Sensor moveable members 260 have convex surfaces for contact with bearings 220.

Sensor array 200 is a combination of inner ring 210 and outer collar 250. Inner ring 210 may be located radially within outer collar 250. First fraction of bearings 220 on middle outer surface 212 of inner ring 210 are in the raceway 253 on middle inner surface 252 of outer collar 250. Second fraction of bearings 220 on top outer surface 214 of inner ring 210 are in contact with top inner surface 254 of outer collar 250, while third fraction of bearings 220 on bottom outer surface 216 of inner ring 210 are in contact with bottom inner surface 256 of outer collar 250. This alignment allows second fraction of bearings 220 on top outer surface 214 of inner ring 210 to interact with a first fraction of sensor moveable members 260 on top inner surface 254 of outer ring 250. Additionally, this alignment allows third fractions of bearings 220 on top outer surface 214 of inner ring 210 to interact with a second fraction of sensor moveable members 260 on bottom inner surface 256 of outer ring 250.

FIG. 2B depicts a cross-section of a bearing 220 in inner ring 210. Bearing 220 is located in a corresponding bearing retainer 225 defined by inner ring 210. One having skill in the art will appreciate the relative sizes and geometries of bearing 220 and bearing retainer 225 to allow both free, low-friction movement and retention of bearing 220 within bearing retainer 225.

Further, bearing retainers 225 may not be indicated in each figure for clarity and brevity. One having skill in the art will appreciate each bearing 220 depicted in this disclosure may be located within a bearing retainer that may not be specifically depicted or described.

FIG. 2C depicts a cross section of sensor moveable member 260 in outer collar 250. Sensor moveable member 260 is held within a corresponding sensor moveable member retainer 265, which is defined by outer collar 250. Within sensor moveable member retainer 265 is a shape memory material element 270 and a distance sensor 280. An output of distance sensor 280 may be affected by an extension distance d between sensor moveable member 260 and distance sensor 280. Sensor moveable member 265 is configured to move up and down within corresponding sensor moveable member retainer 265. More details of sensor moveable member 260, shape memory material element 270, and distance sensor 280 will be discussed further.

One or more embodiments of inner ring 210 and outer collar 250 may be formed from one or more metallic, non-metallic, or composite materials, or a combination of more than one material. One or more embodiments of inner ring 210 and outer collar 250 may be formed from materials able to operate at conditions commonly experienced in the downhole environment, such as high temperatures (for example, >150° C.), high pressures (>5000 psi), or both. One or more embodiments of inner ring 210 and outer collar 250 may be formed from one or more low-friction materials. One or more embodiments of inner ring 210 and outer collar 250 may be formed from one or more materials having high abrasion resistance, high wear resistance, or both.

In one or more embodiments, sensor moveable member 260 may be formed of one or more elastomeric, polymeric, or composite materials, or a combination of more than one material. One or more embodiments of sensor moveable member 260 may be formed from one or more low-friction materials. One or more embodiments of sensor moveable member 260 may be formed from Teflon®, Kapton®, polyester, or a combination.

Figure 3B:
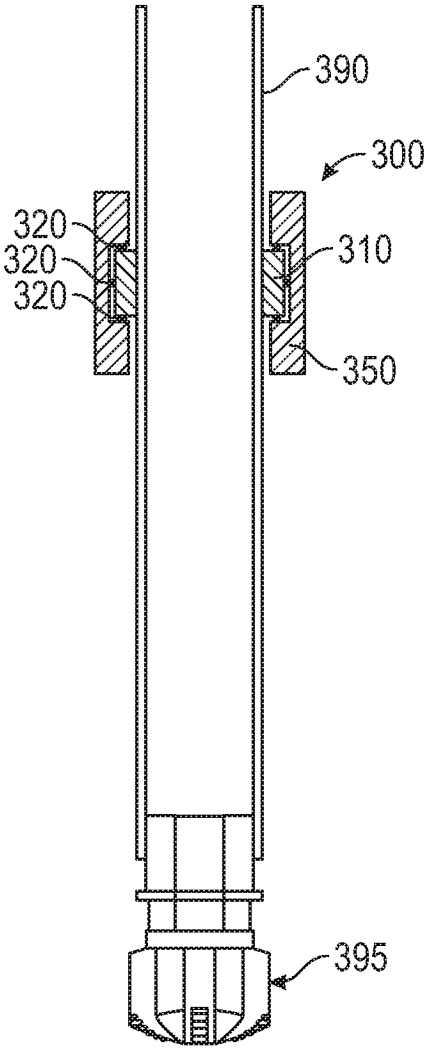
FIGS. 3A and 3B depict an embodiment of multiple arrays along a drillstring.
Figure 3A:
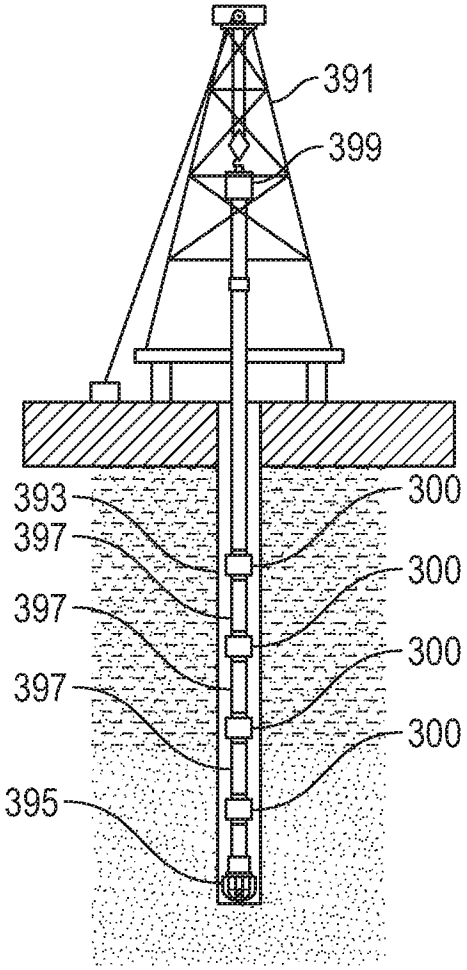

For illustration purposes, FIG. 3A shows a sensing system or a power system including multiple SPSMs, power arrays, or sensor arrays 300 placed along a drillstring 390 to allow distributed sensing of downhole parameters while drilling. Drillstring 390 is suspended in a wellbore 393 from a derrick 391. Drillstring 390 includes a drill bit 395 to cut rock formations and drill pipes 120 connected to form a conduit. Drill pipes 397 can interface with the subs (905 in FIG. 9A) attached to SPSMs 300. Drillstring 390 may have several other tools not specifically mentioned but known in the art. Drillstring 390 may be rotated within wellbore 393 by a top drive 399 (or by a rotary table on a rig floor in other implementations), which will result in rotation of drill bit 395, enabling drill bit 395 to advance cutting of the rock formation. As drillstring 390 is rotated, a structure of each SPSM 300 that is coupled to drillstring 390 via the crossover sub also rotates. Energy harvesters in SPSM 300 convert the mechanical energy from the rotation of the drillstring 390 into electrical energy. The energy harvesters may be triboelectric energy harvesters based on applying friction between two materials with opposed electron affinities, piezoelectric energy harvesters based on applying mechanical stresses to piezoelectric materials, or magnetostrictive energy harvesters based on applying mechanical stresses to magnetostrictive materials.

FIG. 3B depicts a cross-section of sensor array 300, with an inner ring 310 with bearings 320 and an outer collar 350, radially outside inner ring 310. Inner ring 310 is connected to a drillstring 390 that may be attached to a drill bit 395.

While drilling a well, drillstring 390 rotates. In one or more embodiments, inner ring 310 may be connected to drillstring 390. During drilling, inner ring 310 may then rotate with drillstring 390 within outer collar 350. Given the essentially negligible friction between inner ring 310 and outer collar 350 due to bearings 320, outer collar 350 may remain essentially rotationally stationary, while inner ring 310 may rotate with the drillstring 390. In one or more embodiments, outer collar 350 may be connected to drillstring 390. During drilling a well, outer collar 350 may rotate with drillstring 390 around inner ring 310. Given the essentially negligible friction between inner ring 310 and outer collar 350 due to bearings 320, inner ring 310 may remain essentially rotationally stationary, while outer collar 350 may rotate with drillstring 390.

Figure 4B:
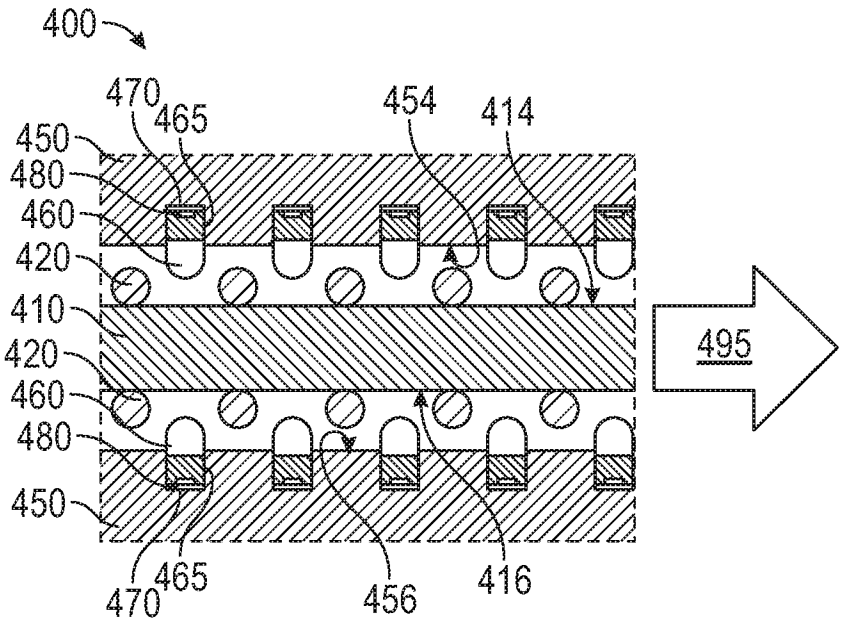
FIGS. 4A and 4B depict two views of an embodiment of a sensor array.
Figure 4A:
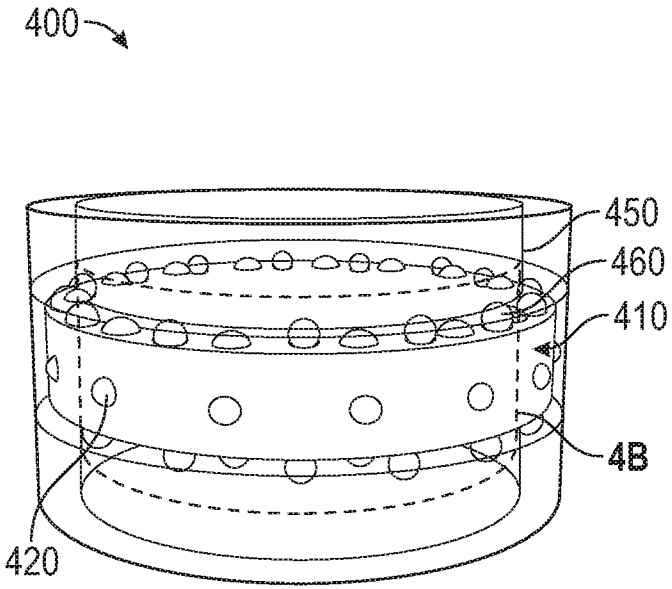

FIGS. 4A and 4B depict how an inner ring 410 and an outer collar 450 of a sensor array 400 interact when inner ring 410 rotates within outer collar 450 due to the rotation of the drillstring (FIG. 3A).

FIG. 4A shows inner ring 410 within outer collar 450 of sensor array 400. Inner ring 410 has bearings 420 and outer collar 450 has moveable members in the form of sensor moveable members 460. Curved surface A, indicated with a dashed line, shows the location of the curved cross-section of sensor array 400 depicted in FIG. 4B.

FIG. 4B depicts a curved cross section of sensor array 400 through inner ring 410 and outer collar 450 at dashed line A. Inner ring 410 has a top outer surface 414 and a bottom outer surface 416, both studded with bearings 420 within bearing retainers (not depicted). Outer collar 450 has a top inner surface 454 and a bottom inner surface 456 both studded with moveable members in the form of sensor moveable members 460 within sensor moveable member retainers 465 defined by outer collar 450. Opposite sensor moveable member 460 within each sensor moveable member retainer 465 is a distance sensor 480 associated with a shape memory material element 470 in the form of a shape memory material base. An arrow 495 indicates the rotational motion of inner ring 410 relative to outer collar 450.

In one or more embodiments, when a bearing 420 contacts a sensor moveable member 460, sensor moveable member 460 may be displaced into a corresponding sensor moveable member retainer 465 toward a respective distance sensor 480. Such movement decreases an extension distance (FIG. 2C) to a minimum extension distance between sensor moveable member 460 and respective distance sensor 480. After bearing 420 moves beyond sensor moveable member 460, sensor moveable member 460 returns to its original, extended position in corresponding sensor moveable member retainer 465.

In one or more embodiments, each sensor moveable member 460 located on top inner surface 454 of outer collar 450 may be configured and arranged such that, during rotation of inner ring 410, bearings 420 located on top outer surface 414 of inner ring 410 push each sensor moveable member 460 upward into a corresponding sensor moveable member retainer 465. Similarly, each sensor moveable member 460 located on bottom inner surface 456 of outer collar 450 may be configured and arranged such that, during rotation of inner ring 410, bearings 420 located on bottom outer surface 416 of inner ring 410 push each sensor moveable member 460 downward into a corresponding sensor moveable member retainer 465. In one or more embodiments, moveable members 460 of outer collar 450 move inward into/outward from corresponding sensor moveable member retainer 465 when in contact/not in contact with bearings 420 of inner ring 410.

Furthermore, recall how the movement of inner ring 410 in relation to outer collar 450 occurs as inner ring 410 rotates with the rotation of a drillstring (FIG. 3A). This rotation of inner ring 410 causes bearings 420 to make contact with moveable members 460 of outer collar 450, pushing sensor moveable members 460 into sensor moveable member retainers 465.

After bearings 420 are no longer contacting sensor moveable members 460, sensor moveable members 460 may move outward from sensor moveable member retainers 465 and return to their original, extended position. In one or more embodiments, sensor moveable members 460 may return to their original, outward, non-compressed position due to a spring beneath sensor moveable members 460, elasticity of the sensor moveable members 460, or some other possible means. One or more embodiments for returning sensor moveable members 460 to their original, extended position are depicted in FIGS. 12A-12F and discussed further.

This contact and release results in moveable members 460 moving in and out/out and in from sensor moveable member retainers 465 many times over the course of a drilling operation.

In one or more embodiments, moveable members 460, including any additional structures (such as a distance sensor component like a magnet, electrode, or reflector as discussed further), may not contact the shape memory material base 470 or distance sensor 480. In some embodiments, upon contact with bearings 420, moveable members 460 may deflect into sensor moveable member retainers 465 without contacting distance sensors 480.

As noted above, distance sensors herein may be associated with, disposed upon, or connected to a shape memory material element 470. Shape memory materials are a large class of materials that change shape in response to external stimulus, and then return to their original shape when the external stimuli is removed. Some examples of the external stimuli that can induce this recoverable shape change in shape memory materials include temperature, pressure, stress, strain, current, voltage, magnetic field, pH, humidity, electrochemicals, composition (e.g., concentration of gases), light, or radiation. Moreover, shape memory materials can be designed to respond and change shape due to only a single, particular stimulus. Additionally, the shape-changing property of shape memory materials does not require an external application of energy, such as electricity, making them useful for low-power applications. Other key advantages of shape memory materials may include chemical stability, biodegradability, recyclability, high strength to weight ratio, excellent extent of deformation, superior corrosion resistance, low density, adjustable degradation rate, high tolerance to fatigue, low cost, the ability to be three-dimensional (3D) or four-dimensional (4D) printed, or a combination of these properties.

FIGS. 5A-5F depict a cross-section of a bearing 520 on an inner ring 510 interacting with a moveable member in the form of a sensor moveable member 560 within a moveable member retainer 565 defined by an outer collar 550. Sensor moveable member 560 is opposite a distance sensor 580 atop a shape memory member element 570. Arrow 595 depicts the movement direction of inner ring 510 relative to outer collar 550.

Figure 5A:
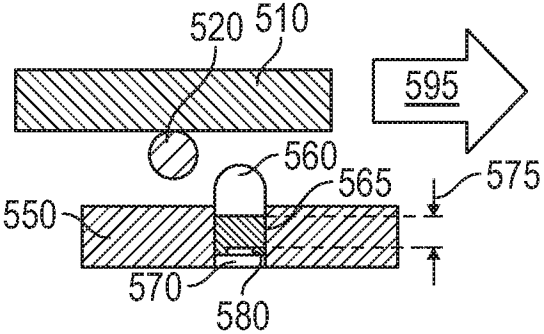
FIGS. 5A-5F depict cross sections of an embodiment of a sensor moveable member.
Figure 5B:
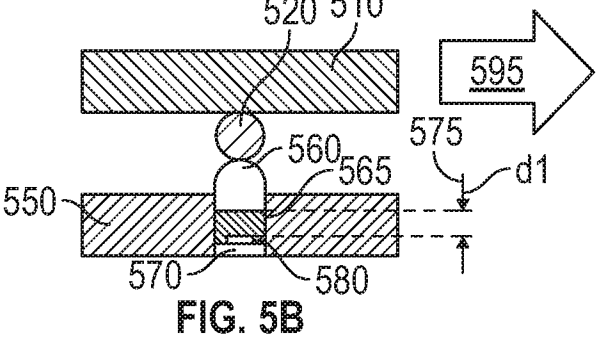
Figure 5C:
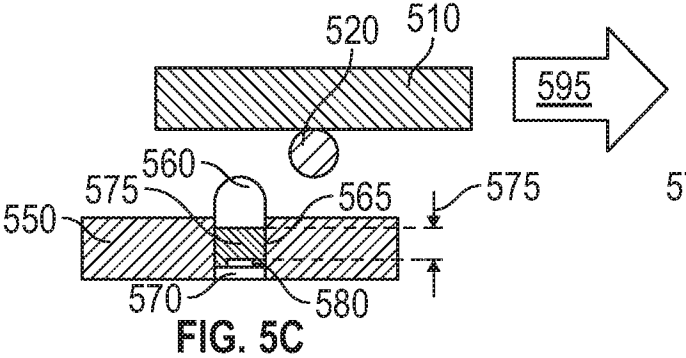

Comparing FIG. 4B with FIGS. 5A-C, various embodiments for the location of shape memory material elements 470, 570 are envisioned. For example, in FIG. 4B, the shape memory material element 470 is disposed within a moveable member retainer 465 having a base, where the shape memory material element 470 may be indirectly stimulated by wellbore conditions (temperature, etc.). In other embodiments, such as illustrated in FIGS. 5A-C, the shape memory element 570 may be disposed within moveable member retainer 565 lacking a base such that a portion of the shape memory material may be directly stimulated by wellbore conditions (pressure, composition, etc.).

FIGS. 5A-5C sequentially depict an interaction between sensor moveable member 560 and bearing 520 due to the rotation of inner ring 510. FIG. 5A depicts sensor moveable member 560 before being contacted by bearing 520. FIG. 5B depicts sensor moveable member 560 while being contacted by bearing 520. FIG. 5C depicts sensor moveable member 560 after being contacted by bearing 520. A gap 575 is depicted between sensor moveable member 560 and distance sensor 580 as may be detected by distance sensor 580 (detailed further). FIG. 5B indicates distance d1 between sensor moveable member 560 and distance sensor 580, as may be detected by distance sensor 580 (detailed further). In FIGS. 5A-5C, shape memory material element 570 is at a first state based on response to an external stimulus (such as an environmental parameter).

Figure 5D:
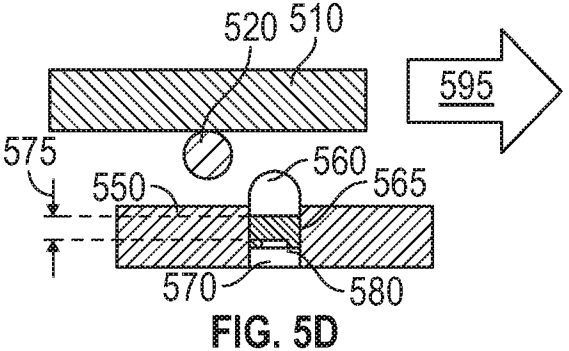
Figure 5E:
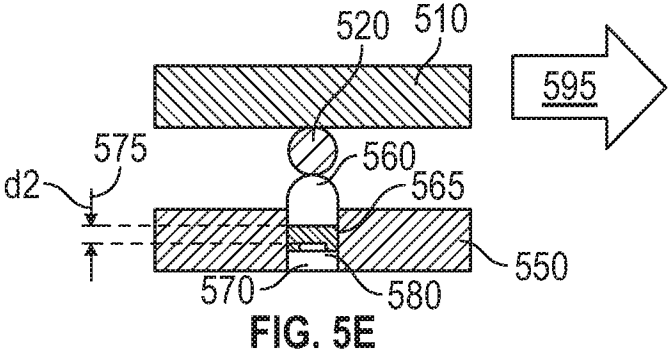
Figure 5F:
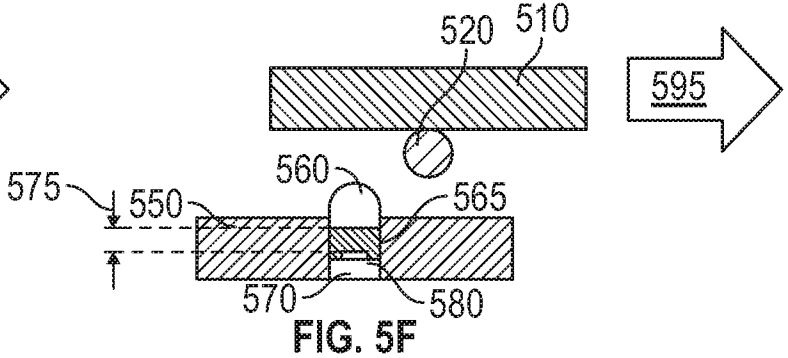

FIGS. 5D-5F depict a cross-section of the same components undergoing the same sequence of interactions between sensor moveable member 560 and bearing 520 due to the movement of inner ring 510. A gap 575 is again depicted between sensor moveable member 560 and distance sensor 580 as may be detected by distance sensor 580 (detailed further). However, due to a change in external stimulus (such as an environmental parameter), shape memory material element 570 may change dimensions (such as an increase in thickness). Therefore, in FIG. 5E, distance d2 between sensor moveable member 560 and distance sensor 580 is smaller than distance d1 in FIG. 5B.

In one or more embodiments, shape memory material element 570 may experience a recoverable shape change due to environmental parameters such as temperature, pressure, stress, strain, current, voltage, magnetic field, pH, humidity, electrochemicals, composition (such as gas content), light, radiation, or some other external stimulus. In one or more embodiments, shape memory material element 570 may be fine-tuned by precise control of microstructure, crystallographic texture, or both, to react predictably to external stimulus such as an environmental parameter.

In one or more embodiments, gap 575 between distance sensor 580 and sensor moveable member 560 (including any additional structures on sensor moveable member 560 discussed further below) may change due to both the change in dimension of shape memory material element 570 and the displacement of sensor moveable member 560 into sensor moveable member retainer 565 by bearing 520.

In one or more embodiments, the minimum extension distance d1, d2 between distance sensor 580 and sensor moveable member 560 (including any additional structures on sensor moveable member 560 discussed further below) may only change due to the change in dimension of shape memory material element 570.

In one or more embodiments, shape memory material element 570 may be tuned to be sensitive to a single external stimulus. In one or more embodiments, any shape change (such as expansion or contraction) of shape memory material element 570 may be due only to a single external stimulus. In one or more embodiments, a change in the minimum extension distance between distance sensor 580 and sensor moveable member 560 (say, from d1 to d2) may be due essentially only to the single, intended external stimulus.

In one or more embodiments, shape memory material element 570 may change shape many times during a single deployment if the external downhole stimuli (meaning the environmental parameter) changes throughout the deployment. In one or more embodiments, shape memory material element 570 may change shape many times during a single deployment if the external downhole stimuli repeats a cycle. In one or more embodiments, such a repeated cycle of external downhole stimuli may be: the external downhole stimuli begins at a first state, varies from the first state, and returns to the first state.

In one or more embodiments, shape change of a shape memory material may be essentially fully recoverable when the environmental parameter returns to a first state. Here, "essentially" may mean recovery of greater than 99% (for example, of greater than 99.9%, of greater than 99.99%, and on) of the shape change that occurred with the increase of the environmental parameter from the first state. One having skill in the art will appreciate, the absolute value of the "first state" of an environmental parameter may be equal to essentially zero (for example, for stress, strain, or voltage) or may be equal to a non-zero, baseline value (for example, for temperature, humidity, or nitrogen pressure) such as the value measured prior to entering the wellbore.

In one or more embodiments, shape memory material element 570 may be a coating applied to a base region within moveable member retainer 565. In one or more embodiments, shape memory material element 570 may be a shape memory material base formed from a shape memory material and inserted into a base region within moveable member retainer 565. In one or more embodiments, shape memory material element 570 may be enclosed in a flexible structure such as a diaphragm, a membrane, or a cavity.

In one or more embodiments, shape memory material element 570 may be formed of a shape memory material with a non-linear response to an environmental parameter. In one or more embodiments, minimum extension distance d1 may remain unchanged until a change in the magnitude of the environmental parameter triggers a shape change of shape memory material element 570. In one or more embodiments, shape memory material element 570 may be formed of a shape memory material with a step-wise response to an environmental parameter. In one or more embodiments, minimum extension distance d1 may change in essentially discrete steps because particular magnitudes of the environmental parameter trigger a shape change of shape memory material element 570 with a step-wise response to the environmental parameter.

In one or more embodiments, each shape memory material element 570 may be formed of one or more shape memory materials, such as a shape-memory alloy, a shape-memory polymer, a shape-memory gel, a shape-memory ceramic, a liquid crystal elastomer, an MXene, or a composite, alloy, derivative, or combination thereof. In some embodiments, each shape memory material element 570 may be formed of one or more shape memory materials, such as a shape memory polymer composite incorporating nanosized fillers such as carbon-based nanostructures (for example, carbon nanotubes, carbon fibers, carbon black, or graphene), metal oxide nanoparticles (for example, $Fe_3O_4$, $TiO_2$, or ZnO), noble metal-based nanostructures (for example, gold and silver), cellulose nanocrystals; Nitinol (Ni—Ti alloys), or a combination of multiple fillers; a copper-based alloy (for example, Cu—Zn—Al, Cu—Al—Ni, or Ti—Ni—Cu); an iron-based alloy (such as Fe—Ni—C, Fe—Mn—Si, or Fe—Mn—Si—Cr—Ni); or an elastomer (such as a dielectric or magnetic elastomer), or a composite, alloy, derivative, or combination thereof.

In one or more embodiments, each shape memory material element 570 may be formed of one or more shape memory materials in the form of smart material(s) that demonstrate a shape memory effect, superelasticity, or both. Such smart materials may undergo a solid state phase change similar that of a molecular re-arrangement, but with the molecules remaining closely packed. These materials may exist, for example, in two different phases (a austenitic "parent phase" and a martensitic "daughter phase") with three different crystal structures (twinned martensite, detwinned martensite, and austenite), resulting in a total of six possible transformations.

In one or more embodiments, each shape memory material element 570 may be formed from one or more commercially available smart structures, such as BioMetal Helix™; Mitsubishi Corporation Fashion, Co., Ltd. DiAPLEX®; CRG Industries Veriflex®, Verilyte™, and Veritex™; Lubrizol Advanced Materials Tecoflex®; Composite Technology Development, Inc. TEMBO®; Norland Products NOA-63; Furukawa Techno Material NT (Ni—Ti) alloys; Jameco Electronics Ni—Ti alloys; Shape Memory Medical shape memory polymers; G.Rau GMBH &Co. smart materials; Nitinol, Dynalloy, Inc. Flexinol® and Ni—Ti alloys; or SAES Getters SmartFlex®.

In one or more embodiments, each shape memory material element 570 may be formed of only one class of shape memory material per external parameter. In one or more embodiments, shape memory material elements 570 may be formed of only one class of shape memory material per external parameter.

In one or more embodiments, sensor array (FIG. 4A) may include shape memory material elements 570 of a single type at multiple radial locations (meaning within multiple sensor moveable members retainers 565) around inner ring 510. Such an arrangement may help detect wellbore conditions around a wellbore (FIG. 2A) in an oriented way. This embodiment is discussed further.

As discussed previously, FIGS. 5A-5F depicted how a sensor array (FIG. 4A, 4B) may sense environmental parameters during the drilling process. In summary, shape memory material element 570 may respond to an external downhole stimuli by altering (expanding or contracting) its structure. Consequently, there may be a change in the minimum extension distance between sensor moveable member 560 and distance sensor 580, from for example d1 to d2, as sensor moveable member 560 is pushed into moveable member retainer 565 by bearing 520 at the point of maximum displacement of sensor moveable member 560.

Figure 6A:
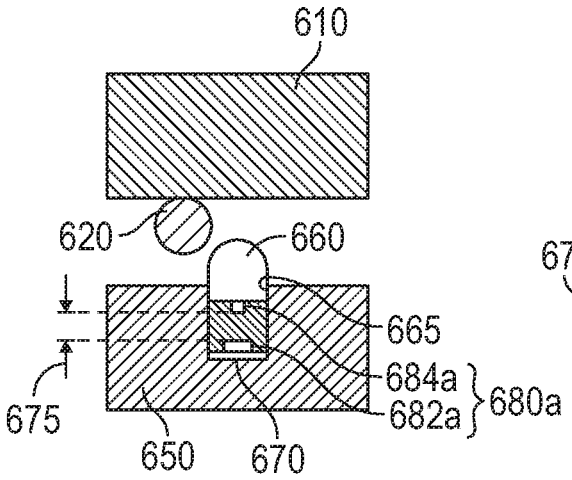
FIGS. 6A-6F depict cross sections of multiple embodiment of a sensor moveable member.
Figure 6B:
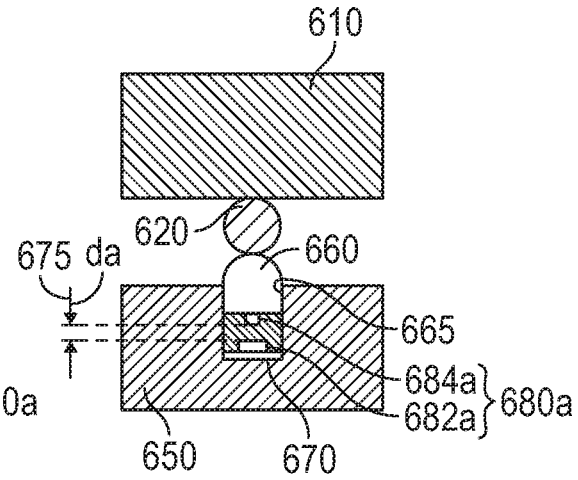
Figure 6C:
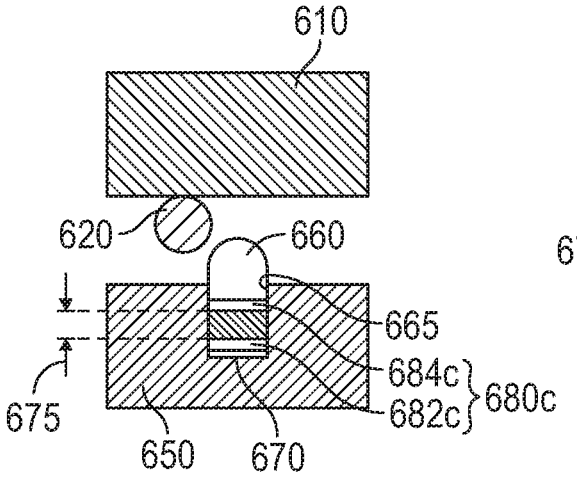

However, the distance sensor itself may employ one or more distance sensing methodology (for example, optical, electrode, magnetic, or others) to detect a minimum extension distance or a change of the minimum extension distance, or may have an output of the distance sensor affected by the minimum extension distance. FIGS. 6A-6C depict distance sensors employing three different distance sensor technologies (magnetic, capacitive, and optical/acoustic, respectively) that may be used in one or more embodiments. Additionally, one having skill in the art will appreciate many additional distance sensor methods that may be used in distance sensor 580.

Figure 6D:
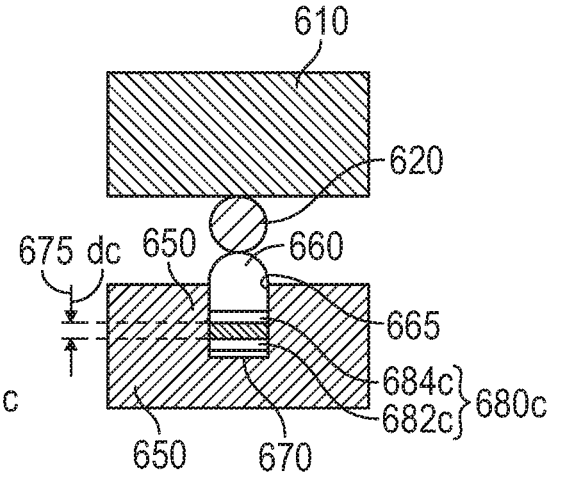
Figure 6E:
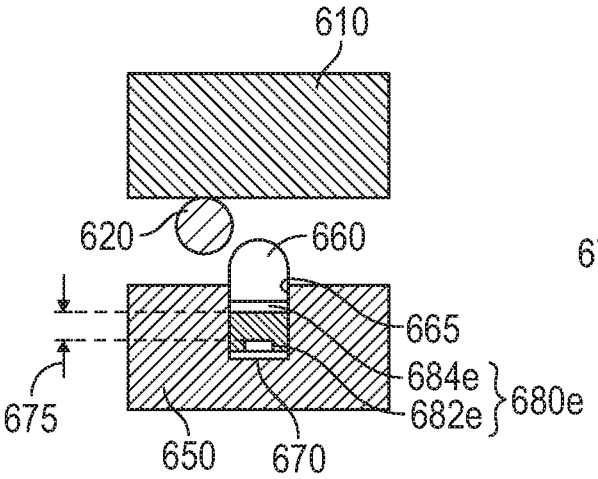
Figure 6F:
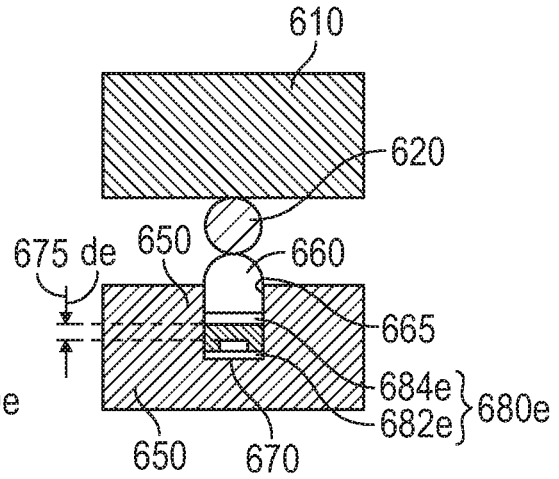

FIGS. 6A-6F each depict a cross-section of a bearing 620 on an inner ring 610 prior to interacting with a moveable member in the form of a sensor moveable member 660 on outer collar 650. Sensor moveable member 660 is located in a sensor moveable member retainer 665, opposite a distance sensor 680*a*, 680*c*, 680*e* atop a shape memory member base 670. A gap 675 between a first sensing element and a second sensing element of distance sensor 680*a*, 680*c*, 680*e* is measured by distance sensor 680*a*, 680*c*, 680*e*. FIGS. 6A, 6C, and 6E depict sensor moveable member 660 prior to engagement with bearing 620. FIGS. 6B, 6D, and 6F depict the same sensor moveable member 660 as in FIGS. 6A, 6C, and 6E at the point of maximum engagement with bearing 620 where gap 675 equals extension distance da, dc, de.

As a drillstring (FIG. 3A) rotates, bearing 620 of inner ring 610 contacts sensor moveable member 660 of outer collar 650. Such contact pushes sensor moveable member 660 into sensor moveable member retainer 665, decreasing gap 675 between the components of distance sensor 680*a*, 680*c*, 680*e*. Where sensor moveable member 660 has been fully pushed into sensor moveable member retainer 665, gap 675 may be the minimum extension distance da, dc, de between the components of distance sensor 680*a*, 680*c*, 680*e*.

In some embodiments, an output of distance sensor 680*a*, 680*c*, 680*e* may be based on a constant measure of gap 675, the minimum extension distance da, dc, de, or on a change of the minimum extension distance (FIGS. 5B and 5E). In one or more embodiments, sensor array (FIG. 3A) may evaluate the output of distance sensor 680*a*, 680*c*, 680*e* to determine the change of minimum extension distance da, dc, de from a first value d1 to a second value d2 as in FIGS. 5B and 5E, and ultimately calculate the environmental parameter(s) reflected in the shape memory material element 670 shape change. Thus, in some embodiments, sensor array (FIG. 3A) may employ one or more distance sensors 680*a*, 680*c*, 680*e* to indirectly detect one or more environmental parameter(s). One having skill in the art will appreciate how to adapt the process described here when the extension distance da, dc, de increases between d1 (without a stimulus) and d2 (with stimulus) (meaning, d2 is greater than d1) due to a contraction of shape memory material element 670.

As discussed above, stimulus such as an environmental parameter may change the size of shape memory material element 670. In one or more embodiments, a shape change of shape memory material element 670 may alter minimum extension distance da, dc, de, as was show in FIGS. 5B and 5E, previously. Thus, the output of distance sensor 680*a*, 680*c*, 680*e* may ultimately reflect a stimulus, such as an environmental parameter, that altered a shape of shape memory material element 670.

In one or more embodiments, each distance sensor 680*a*, 680*c*, 680*e* may include a first sensing element and a second sensing element. In one or more embodiments, a first sensing element may be a detector 682*a*, 682*c*, 682*e* and a second sensing element may be a target 684*a*, 684*c*, 684*e*. In one or more embodiments, the first sensing element and second sensing element (such as detector 682*a*, 682*c*, 682*e* and target 684*a*, 684*c*, 684*e*) may be arranged in opposing relation and may be separated by gap 675. In one or more embodiments, gap 675 may be responsive to expansion of shape memory material element 670 and displacement of sensor moveable member 660 by bearing 620. In one or more embodiments, at the point of maximum displacement of sensor moveable member 660, gap 675 may be equal to an extension distance da, dc, de.

FIGS. 6A and 6B depict a magnetic distance sensor 680*a*; FIGS. 6C and 6D depict a capacitive distance sensor 680*c*; and FIGS. 6E and 6F depict an optical or an acoustic distance sensor 680*e*.

FIGS. 6A and 6B depict magnetic distance sensor 680*a* employing a detector in the form of a magnetic detector 682*a* atop shape memory member base 670 opposite a target in the form of a magnetic target 684*a* (such as a permanent magnet) attached to sensor moveable member 660. In some embodiments, magnetic detector 682*a* and magnetic target 684*a* may be in opposing relation and may be separated by gap 675. FIG. 6A depicts magnetic distance sensor 680*a* prior to engagement between bearing 620 and moveable member 660. FIG. 6B depicts the same magnetic distance sensor 680*a* at the point of maximum displacement of sensor moveable member 660. Extension distance da between magnetic detector 682*a* and magnetic target 684*a* is also shown. One or more embodiments of sensor array (FIG. 4A) may include one or more magnetic distance sensors.

One or more embodiments of magnetic detector 682*a* may be a micro-electro-mechanical systems (MEMS)-type magnetic distance sensor. One or more embodiments of magnetic detector 682*a* may be a flexible MEMS device. A flexible magnetic detector 682*a* may change shape along with shape memory member base 670.

Magnetic target 684*a* attached to sensor moveable member 660 may be any component that is able to be detected by magnetic detector 682*a*. In one or more embodiments, magnetic target 684*a* may be a magnet attached to a base of sensor moveable member 660. In one or more embodiments, magnetic target 684*a* may be a permanent magnet attached to a base of sensor moveable member 660. In one or more embodiments, magnetic target 684*a* may be a magnetic material attached to a base of sensor moveable member 660. In one or more embodiments, magnetic target 684*a* may be a magnetic coating on a base of sensor moveable member 660.

In one or more embodiments, magnetic detector 682*a* may detect a magnetic field originating from magnetic target 684*a* across gap 675. In one or more embodiments, this magnetic field strength may be used to determine the size of gap 675 including the extension distance da between magnetic detector 682*a* and magnetic target 684*a*. In one or more embodiments, the output of magnetic distance sensor 680*a* may be used to determine the size of gap 675 including extension distance da between magnetic detector 682*a* and magnetic target 684*a*.

In one or more embodiments, magnetic distance sensor 680*a* may detect the magnetic field originating from magnetic target 684*a*. In one or more embodiments, prior to the introduction of an external stimulus, magnetic detector 682*a* may be closest to magnetic target 684*a* when sensor moveable member 660 is fully pushed into sensor moveable member retainer 665 as in FIG. 6*b*. In one or more embodiments, prior to the introduction of an external stimulus, magnetic detector 682*a* may thus detect a maximum magnetic field when sensor moveable member 660 is fully pushed into sensor moveable member retainer 665. In one or more embodiments, the output of magnetic distance sensor 680*a* may be used to determine extension distance da prior to the introduction of an external stimulus in the form of an environmental parameter.

In one or more embodiments, when shape memory material element 670 has expanded due to external parameters, the maximum magnetic field detected by magnetic detector 682*a* may be greater than a maximum magnetic field prior to expansion of shape memory material element 670. Consequently, in one or more embodiments, an increase in the maximum magnetic field detected by magnetic detector 682*a* may correlate with expansion of shape memory member element 670 due to changes in environmental parameter(s). In one or more embodiments, the output of magnetic distance sensor 680*a* may be used to determine the size of gap 675 including extension distance da between magnetic detector 682*a* and magnetic target 684*a*. In one or more embodiments, the output of magnetic distance sensor 680*a* may be used to determine extension distance da after the introduction of an external stimulus in the form of an environmental parameter.

In one or more embodiments, sensor array (FIG. 3A) may evaluate the output of magnetic distance sensor 680*a* to determine the change of extension distance da from d1 to d2, and ultimately calculate the environmental parameter(s) reflected in the shape memory material element 670 expansion. Thus, in some embodiments, sensor array (FIG. 3) may employ one or more magnetic distance sensors 680*a* to indirectly detect one or more environmental parameter(s). One having skill in the art will appreciate how to adapt the process described here when the extension distance da increases between d1 (without a stimulus) and d2 (with stimulus) (meaning, d2 is greater than d1) due to a contraction of shape memory material element 670.

In one or more embodiments, the output of magnetic distance sensor 680*a* may be transmitted to a receiver (FIG. 11), so the receiver may determines the change of extension distance da from d1 to d2, and ultimately calculate the environmental parameter(s) reflected in the shape memory material element 670 expansion.

In one or more embodiments, sensor array (FIG. 4A) may include multiple magnetic distance sensors 680*a*. Thus, in one or more embodiments, sensor array (FIG. 4A) may use multiple magnetic distance sensors 680*a* to repeatedly measure the maximum magnetic field between magnetic detector 682*a* and magnetic target 684*a* to determine a change in the extension distance da from d1, d2. In such a system, the multiple measurements of a change in the extension distance da may result in total distance sensor output that is stronger, less noisy, or both.

FIGS. 6C and 6D depict a capacitive distance sensor 680*c* employing a detector in the form of a ground electrode detector 682*c* atop shape memory member base 670 opposite a target in the form of a drive electrode target 684*c* on the base of sensor moveable member 660. FIG. 6C depicts capacitive distance sensor 680*c* prior to engagement between bearing 620 and moveable member 660. FIG. 6D depicts the same capacitive distance sensor 680*c* at the point of maximum displacement of sensor moveable member 660. Extension distance dc between ground electrode detector 682*c* and drive electrode target 684*c* is also shown. One or more embodiments of sensor array (FIG. 4A) may include one or more capacitive distance sensors.

In some embodiments, drive electrode target 684*c* may be formed of a conductive material, such as a metal, a conductive polymer, or a conductive ceramic. In some embodiments, drive electrode target 684*c* may be attached to or coated on the base of sensor moveable member 660. In some embodiments, drive electrode target 684*c* on the base of sensor moveable member 660 conducts electricity, thus serves as an electrode. In some embodiments, ground electrode 684*c* on the base of sensor moveable member 660 may serve as a drive electrode.

In some embodiments, ground electrode detector 682*c* may be located within sensor moveable member retainer 665. In some embodiments, ground electrode detector 682*c* may be located atop shape memory material element 670. In some embodiments, ground electrode detector 682*c* may serve as a ground electrode.

In some embodiments, drive electrode target 684*c* and ground electrode detector 682*c* may act as a parallel-plate capacitor, with drive electrode target 684*c* and ground electrode detector 682*c* separated by a non-conductive region (meaning, the air gap between drive electrode target 684*c* and ground electrode detector 682*c*). In some embodiments, drive electrode target 684*c* and ground electrode detector 682*c* may be in opposing relation and may be separated by gap 675. In some embodiments, when a voltage is applied to drive electrode target 684*c*, an electric field may be produced across gap 675 between drive electrode target 684*c* and ground electrode detector 682*c*, such that capacitive distance sensor 680*c* behaves as a parallel-plate capacitor. In one or more embodiments, this capacitance may be used to determine a size of gap 675 including an extension distance dc between drive electrode target 684*c* and ground electrode detector 682*c*. In one or more embodiments, the output of capacitive distance sensor 680*c* may be used to determine the size of gap 675 including extension distance dc between drive electrode target 684*c* and ground electrode detector 682*c*.

In one or more embodiments, capacitive distance sensor 680*c* may detect a capacitance between drive electrode target 684*c* and ground electrode detector 682*c* when a voltage is applied to drive electrode target 684*c*. In one or more embodiments, prior to the introduction of an external stimulus, ground electrode detector 682*c* may be closest to drive electrode target 684*c* when sensor moveable member 660 is fully pushed into sensor moveable member retainer 665 as in FIG. 6D. In one or more embodiments, prior to the introduction of an external stimulus, ground electrode detector 682*c* may thus detect a maximum capacitance when sensor moveable member 660 is fully pushed into sensor moveable member retainer 665. In one or more embodiments, the output of capacitive distance sensor 680*c* may be used to determine extension distance dc between ground electrode detector 682*c* and drive electrode target 684*c*. In one or more embodiments, the output of capacitive distance sensor 680*c* may be used to determine extension distance dc prior to the introduction of an external stimulus in the form of an environmental parameter.

In one or more embodiments, when shape memory material element 670 has expanded due to stimulus caused by environmental parameters, the maximum capacitance detected by ground electrode detector 682*c* may be greater than a maximum capacitance prior to expansion of shape memory material element 670. Consequently, in one or more embodiments, an increase in the maximum capacitance detected by ground electrode detector 682*c* may correlate with expansion of shape memory member base 670 due to changes in environmental parameter(s). In one or more embodiments, the output of capacitive distance sensor 680*c* may be used to determine extension distance dc after the introduction of an external stimulus in the form of an environmental parameter.

In one or more embodiments, sensor array (FIG. 3A) may evaluate the output of capacitive distance sensor 680*c* to determine the change of extension distance dc from d1 to d2, and ultimately calculate the environmental parameter(s) reflected in the shape memory material element 670 expansion. Thus, in some embodiments, sensor array (FIG. 3) may employ one or more capacitive distance sensor 680*c* to indirectly detect one or more environmental parameter(s).

In one or more embodiments, the output of capacitive distance sensor 680*c* may be transmitted to a receiver (FIG. 11), so the receiver may determines the change of extension distance dc from d1 to d2, and ultimately calculate the environmental parameter(s) reflected in the shape memory material element 670 expansion.

In one or more embodiments, sensor array (FIG. 4A) may include multiple capacitive distance sensors 680*c*. Thus, in one or more embodiments, sensor array (FIG. 4A) may use multiple capacitive distance sensor 680*c* to repeatedly measure the maximum capacitance between ground electrode detector 682*c* and drive electrode target 684*c* to determine a change in the extension distance dc from d1, d2. In such a system, the multiple measurements of a change in the extension distance dc may result in total distance sensor output that is stronger, less noisy, or both.

FIGS. 6E and 6F depicts an optical/acoustic distance sensor 680*e* employing a detector in the form of an optical/acoustic detector 682*e* atop shape memory member base 670 opposite a target in the form of an optical/acoustic target 684*e* (such as an optical or acoustic reflector) attached to sensor moveable member 660. In some embodiments, optical/acoustic transceiver detector 682*e* and optical/acoustic reflector target 684*e* may be in opposing relation and may be separated by gap 675. FIGS. 6E and 6F may depict either an optical or an acoustic distance sensor 680*e* because the overall geometry and function may be similar. FIG. 6E depicts optical/acoustic distance sensor 680*e* prior to engagement between bearing 620 and moveable member 660. FIG. 6F depicts the same optical/acoustic distance sensor 680*e* at the point of maximum displacement of sensor moveable member 660. Extension distance de between optical/acoustic detector 682*e* and optical/acoustic target 684*a* is also shown. One or more embodiments of sensor array (FIG. 4A) may include one or more optical distance sensors. One or more embodiments of sensor array (FIG. 4A) may include one or more acoustic distance sensors.

In one or more embodiments, optical/acoustic target 684*e* may be an optical reflector. In one or more embodiments, optical reflector target 684*e* may formed of any material that reflects a majority of transmitted light waves, such as a metallic, dielectric, or enhanced metallic material.

In one or more embodiments, optical/acoustic detector 684*e* may be an optical transceiver that incorporates both an optical emitter and an optical receiver. In one or more embodiments, optical transceiver detector 682*e* may emit and detect a reflected optical signal. In one or more embodiments, optical transceiver detector 682*e* may measure the duration elapsed between emission and detection of a light wave, specifically the time from transmission by the transmitter within optical transceiver detector 682*e*, propagate across gap 675, reflection off optical reflector target 684*e*, propagate across gap 675 again, and detection by the receiver within optical transceiver detector 682*e*. In one or more embodiments, this elapsed duration may be used to determine extension distance de between optical transceiver detector 682*e* and optical reflector target 684*e*. In one or more embodiments, the output of optical/acoustic distance sensor 680*e* may be used to determine the size of gap 675 including extension distance de between optical transceiver detector 684*e* and optical reflector target 684*e*.

In one or more embodiments, optical/acoustic target 684*e* may be an acoustic reflector. In one or more embodiments, acoustic reflector target 684*e* may be any surface that can be coated to be flat and rigid, so that acoustic waves bounce off acoustic reflector target 684*e* creating an echo. In one or more embodiments, acoustic reflector target 684*e* may be formed of any material that may be made sufficiently flat and rigid.

In one or more embodiments, optical/acoustic detector 684*e* may be an acoustic transceiver that incorporates both an acoustic emitter and an acoustic receiver. In one or more embodiments, acoustic transceiver detector 682*e* may emit and detect a reflected acoustic signal. In one or more embodiments, acoustic transceiver detector 682*e* may measure the duration elapsed between emission and detection of a sound wave, specifically the time from transmission by the transmitter within acoustic transceiver detector 682*e*, propagate across gap 675, reflection off acoustic reflector target 684*e*, propagate across gap 675 again, and detection by the receiver within acoustic transceiver detector 682*e*. In one or more embodiments, this elapsed duration may be used to determine a size of gap 675 including an extension distance de between acoustic transceiver detector 682*e* and acoustic reflector target 684*e*. In one or more embodiments, the output of acoustic distance sensor 680*e* may be used to determine extension distance de between acoustic transceiver detector 684*e* and acoustic reflector target 684*e*.

In one or more embodiments, optical/acoustic distance sensor 680*e* may detect the elapsed duration between emission of light/sound from optical/acoustic transceiver detector 682*e*, reflection off target 684*e*, and detection by optical/acoustic transceiver detector 682*e*. In one or more embodiments, prior to the introduction of an external stimulus, optical/acoustic transceiver detector 682*e* may be closest to target 684*e* when sensor moveable member 660 is fully pushed into sensor moveable member retainer 665 as in FIG. 6F. In one or more embodiments, prior to the introduction of an external stimulus, optical/acoustic transceiver detector 682*e* may thus detect a shortest elapsed time between emission and detection of light/sound when sensor moveable member 660 is fully pushed into sensor moveable member retainer 665. In one or more embodiments, the output of optical/acoustic distance sensor 680*e* may be used to determine extension distance de prior to the introduction of an external stimulus in the form of an environmental parameter.

In one or more embodiments, when shape memory material element 670 has expanded due to external parameters, a minimum duration between emission and detection detected by optical/acoustic transceiver detector 682*e* may be less than a minimum duration between emission and detection prior to expansion of shape memory material element 670. This change may be because the expansion of the shape memory material element 670 reduces the distance the light/acoustic wave has to travel from the optical/acoustic transceiver detector 682*e* to optical/acoustic reflector target 684*e* and back to optical/acoustic transceiver detector 682*e*.

Consequently, in one or more embodiments, a decrease in the minimum duration between emission and detection detected by optical/acoustic transceiver detector 682*e* may correlate with expansion of shape memory member base 670 due to changes in environmental parameter(s). In one or more embodiments, the output of optical/acoustic distance sensor 680*e* may be used to determine extension distance de after the introduction of an external stimulus in the form of an environmental parameter.

In one or more embodiments, sensor array (FIG. 3A) may evaluate the output of optical/acoustic distance sensor 680*e* to determine the change of extension distance de from d1 to d2, and ultimately calculate the environmental parameter(s) reflected in the shape memory material element 670 expansion. Thus, in some embodiments, sensor array (FIG. 3) may employ one or more optical/acoustic distance sensors 680*e* to indirectly detect one or more environmental parameter(s). One having skill in the art will appreciate how to adapt the process described here when the extension distance de increases between d1 (without a stimulus) and d2 (with stimulus) (meaning, d2 is greater than d1) due to a contraction of shape memory material element 670.

In one or more embodiments, the output of optical/acoustic distance sensor 680*e* may be transmitted to a receiver (FIG. 11), so the receiver may determines the change of extension distance de from d1 to d2, and ultimately calculate the environmental parameter(s) reflected in the shape memory material element 670 expansion.

In one or more embodiments, sensor array (FIG. 4A) may include multiple optical/acoustic distance sensors 680*e*. Thus, in one or more embodiments, sensor array (FIG. 4A) may use multiple optical/acoustic distance sensors 680*e* to repeatedly measure the duration between emission and detection using optical/acoustic transceiver detector 682*e* to determine a change in the extension distance de from d1, d2. In such a system, the multiple measurements of a change in the extension distance de may result in total distance sensor output that is stronger, less noisy, or both.

In one or more embodiments, sensor array (FIG. 4A) may include multiple distance sensors 680*a*, 680*c*, 680*e* of a single type at multiple locations (meaning within multiple sensor moveable members retainers 665) around inner ring 610. Such an arrangement may help detect wellbore conditions around a wellbore (FIG. 2A) in an oriented way. An additional discussion of the arrangement of distance sensors around sensor array can be found further.

In one or more embodiments, sensor array (FIG. 4A) may include one or more commercially available ultra-low power distance sensors with power consumptions in the range of 100 μW up to several W. In one or more embodiments, sensor array (FIG. 4A) including one or more distance sensors 680*a*, 680*c*, 680*e* may be powered by a power array that locally captures the rotational energy of a drillstring (FIG. 3) as discussed further.

In one or more embodiments, distance sensor 680*a*, 680*c*, 680*e* may continuously measure the output of detector 684*a*, 684*c*, 684*e*. Thus, in one or more embodiments, distance sensor 680*a*, 680*c*, 680*e* may continuously measure gap 675. In one or more embodiments, the cyclical displacement of sensor moveable member 660 within sensor moveable member retainer 665 (meaning, movement in and out of sensor moveable member retainer 665) may continually calibrate the output of each distance sensor 680*a*, 680*c*, 680*e*. In some embodiments, the output of detector 684*a*, 684*c*, 684*e* when sensor moveable member 660 is in the original, extended position may be used to calibrate distance sensor 680*a*, 680*c*, 680*e*.

In one or more embodiments, the cyclical displacement of sensor moveable member 660 within sensor moveable member retainer 665 (meaning, movement in and out of sensor moveable member retainer 665) may be utilized to generate a data time stamp. In one or more embodiments, the cyclical displacement of sensor moveable member 660 within sensor moveable member retainer 665 (meaning, movement in and out of sensor moveable member retainer 665) may be used to synchronize all distance sensor 680*a*, 680*c*, 680*e* within sensor array 400 (FIG. 4A).

In one or more embodiments, distance sensor 680*a*, 680*c*, 680*e* may include one or more flexible device. In one or more embodiments, distance sensor 680*a*, 680*c*, 680*e* may include one or more MEMS device. In one or more embodiments, detector 684*a*, 684*c*, 684*e* may be a flexible device. In one or more embodiments, detector 684*a*, 684*c*, 684*e* may reflect the shape change of shape memory material element 670.

Figure 7B:
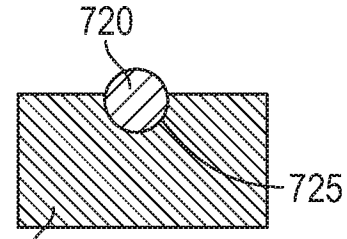
FIGS. 7B and 7C depict cross sections of an embodiment a bearing element and an embodiment a power moveable member.
Figure 7C:
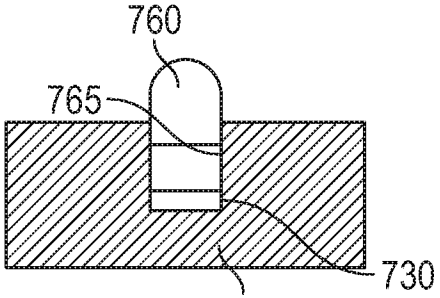
Figure 7A:
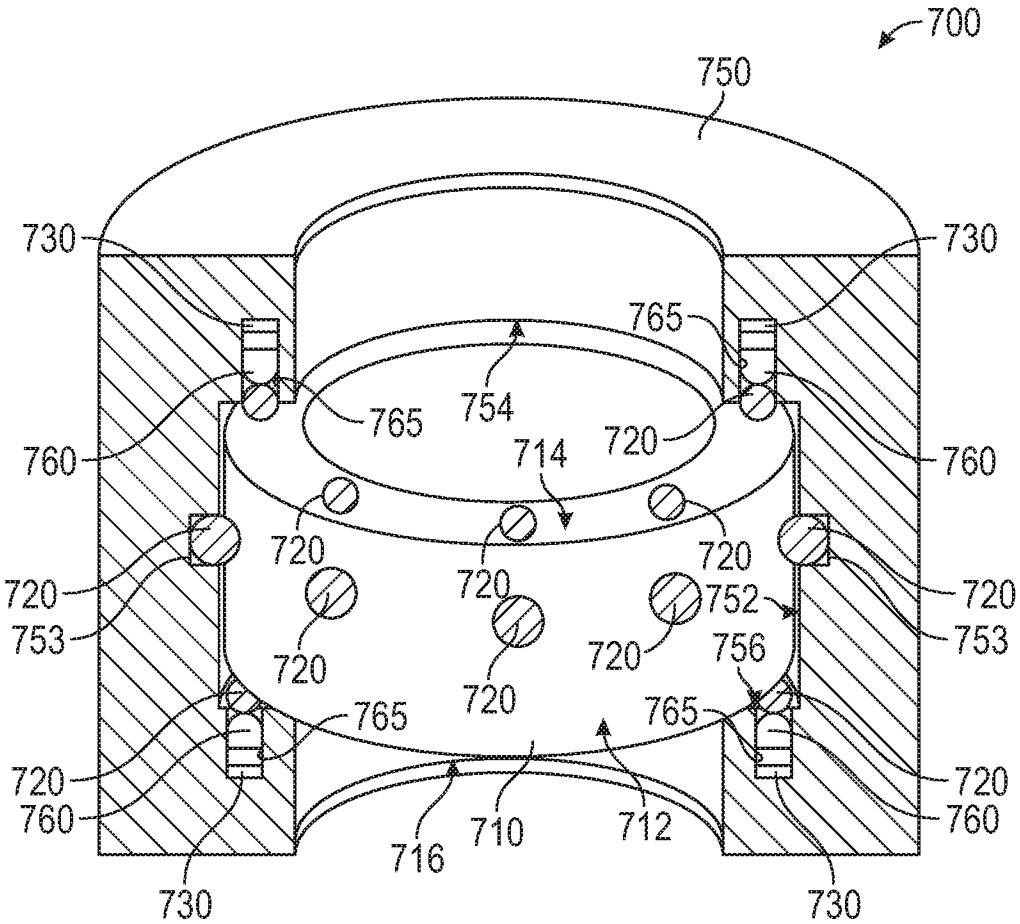
FIG. 7A depicts a cross section of an embodiment of a power array.

FIGS. 7A-7C depict an embodiment of an inner ring 710 and an outer collar 750 of a power array 700.

FIG. 7A depicts an embodiment of a power array 700 where half of outer collar 750 is cut away. On inner ring 710 are bearings 720 located on three outer surfaces: a top outer surface 714, a middle outer surface 712, and a bottom outer surface 716. Additionally, a first fraction of bearings 720 are on middle outer surface 712, a second fraction of bearings 720 are on top outer surface 714, and a third fraction of bearings 720 are on bottom outer surface 716. In some embodiments, bearings 720 may be positioned to support rotation of inner ring 710 relative to outer collar 750.

Within outer collar 750 are three surfaces: a top inner surface 754, a middle inner surface 752, and a bottom inner surface 756. Outer collar 750 has moveable members in the form of power moveable members 760 located on two surfaces: a top inner surface 754 and a bottom inner surface 756. A third surface, a middle inner surface 752 does not have power moveable members. Instead, middle inner surface 752 has a raceway 753. Raceway 753 serves to hold inner ring 710 in place relative to outer collar 750. The details of such a connection are detailed further.

Each power moveable member 760 is moveably located within a moveable member retainer in the form of a power moveable member retainer 765. Also within each power moveable member retainer 765 is a power generation component 730. Power moveable members 760 have convex surfaces for contact with bearings 720.

Power array 700 is a combination of inner ring 710 and outer collar 750. Inner ring 710 may be located radially within outer collar 750. First fraction of bearings 720 on middle outer surface 712 of inner ring 710 are in the raceway 753 on middle inner surface 752 of outer collar 760. Second fraction of bearings 720 on top outer surface 714 of inner ring 710 are in contact with top inner surface 754 of outer collar 750, while third fraction of bearings 720 on bottom outer surface 716 of inner ring 710 are in contact with bottom inner surface 756 of outer collar 750. This alignment allows the second and third fractions of bearings 720 on top outer surface 714 and bottom outer surface 716 of inner ring 710 to interact with a first fraction of power moveable members 760 located on top inner surface 754 of outer ring 750 and a second fraction of power moveable members 760 located on bottom inner surface 756 of outer ring 750.

FIG. 7B depicts a cross-section of a bearing 720 in inner ring 710. Bearing 720 is located in a corresponding bearing retainer 725 defined by inner ring 710. One having skill in the art will appreciate the relative sizes and geometries of bearing 720 and bearing retainer 725 to allow both free, low-friction movement and retention of bearing 720 within bearing retainer 725.

Further, bearing retainer 725 may not be indicated in each figure for clarity and brevity. One having skill in the art will appreciate each bearing 720 depicted in this disclosure may be located within a bearing retainer that may not be specifically indicated or described.

FIG. 7C depicts a cross section of power moveable member 760 in outer collar 750. Power moveable member 760 is held within a corresponding power moveable member retainer 765, which is defined by outer collar 750. Within power moveable member retainer 765 is a power generation component 730. Power moveable member 765 is configured to move up and down within corresponding power moveable member retainer 765. More details of power generation component 730 will be discussed further.

As above, after bearings 720 are no longer contacting power moveable members 760, power moveable members 760 may move outward from power moveable member retainers 765 and return to their original, extended position. In one or more embodiments, power moveable members 760 may return to their original, outward, non-compressed position due to a spring beneath sensor moveable members 760, elasticity of the sensor moveable members 460, or some other possible means. One or more embodiments for returning power moveable members 760 to their original, extended position are depicted in FIGS. 12A-12F and discussed further.

One or more embodiments of inner ring 710 and outer collar 750 may be formed from one or more metallic, non-metallic, or composite materials, or a combination of more than one material. One or more embodiments of inner ring 710 and outer collar 750 may be formed from materials able to operate at conditions commonly experienced in the downhole environment, such as high temperatures (for example, >150° C.), high pressures (>5000 psi), or both. One or more embodiments of inner ring 710 and outer collar 750 may be formed from one or more low-friction materials. One or more embodiments of inner ring 710 and outer collar 750 may be formed from one or more materials having high abrasion resistance, high wear resistance, or both.

In one or more embodiments, power moveable member 760 may be formed of one or more elastomeric, polymeric, or composite materials, or a combination of more than one material. One or more embodiments of power moveable member 760 may be formed from one or more low-friction materials. One or more embodiments of power moveable member 760 may be formed from Teflon®, Kapton®, polyester, or a combination.

In one or more embodiments, power array 700 may continue generating electricity as long as power moveable members 760 are in motion.

FIGS. 8A-8J depict a cross section of an inner ring 810 with a bearing 820 and an outer collar 850 with a moveable member in the form of a power moveable member 860. FIGS. 8A-8J depicts different power generation component 830*a*, 830*c*, 830*e*, 830*g*, 830*i*, according to one or more embodiments. FIGS. 8A, 8C, 8E, 8G, and 8I depict power generation component 830*a*, 830*c*, 830*e*, 830*g*, 830*i* before bearing 820 contacts power moveable member 860. FIGS. 8B, 8D, 8F, 8H, and 8J depict the same power generation component 830*a*, 830*c*, 830*e*, 830*g*, 830*i* at the point of maximum displacement of power moveable member 860 due to contact with bearing 820.

FIGS. 8A-8F generate electricity using friction resulting from contact between frictional material A and frictional material B via the triboelectric effect. Frictional material A and frictional material B may have a large difference in polarity, such as opposite polarities, in one or more embodiments. Generating electricity by friction is based on the triboelectric effect, where an object becomes electrically charged after it contacts another material through friction. When they contact, charges move from one material to the other. Some materials have a tendency to gain electrons, while others have a tendency to lose electrons. If frictional material A has a higher polarity than frictional material B, then electrons are injected from frictional material B into frictional material A. This results in oppositely charged surfaces. When these two materials are separated, there is a current flow, when a load is connected between the materials, due to the imbalance in charges between the two materials. The current flow continues until the potential of both the materials are equal. When the two materials move towards each other again, there will again be a current flow, although in the opposite direction. Therefore, in one or more embodiment, this contact and separation motion of two materials may be used to generate electricity.

In one or more embodiments, frictional material A and frictional material B may be materials such as polyamide, polytetrafluoroethylene (PTFE), polyethylene terephthalate (PET), polydimethylacrylamide (PDMA), polydimethylsiloxane (PDMS), Polyimide, Carbon Nanotubes, copper, silver, aluminum, lead, elastomer, Teflon, Kapton, nylon, polyester, or a combination, derivative, or composite thereof.

Figure 8A:
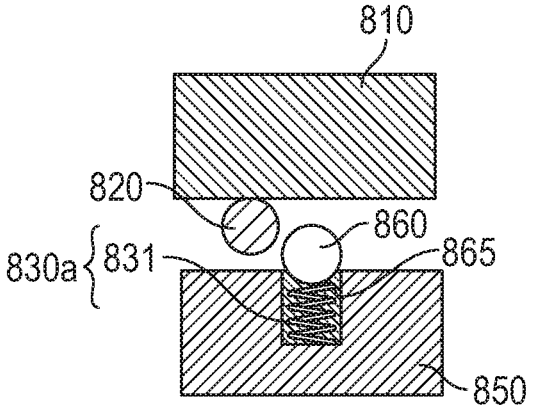
FIGS. 8A-8J depict cross sections of multiple embodiment of a power moveable member.
Figure 8B:
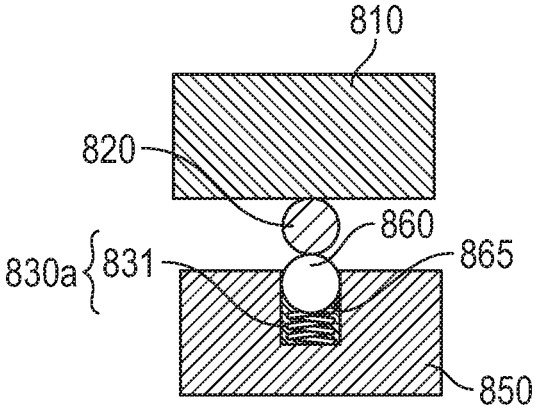

In FIGS. 8A and 8B, power moveable member 860 is connected to outer collar 850 by spring 831. In one or more embodiments, bearing 820 may be formed of or coated with frictional material A and power moveable member 860 may be formed of or coated with frictional material B. As the drillstring assembly rotates, bearing 820 makes contact with power moveable member 860, causing power moveable member 860 to move up and down within power moveable member retainer 865. In one or more embodiments, the power generation component 830*a* may be a bearing 860 formed of or coated with frictional material A and power moveable member 860 formed of or coated with frictional material B. In one or more embodiments, power moveable member 860 may be round such as a bearing. In one or more embodiments, spring 831 may ensure maximum contact between power moveable member 860 and bearing 820. In one or more embodiments, spring 831 may compress and expand multiple times over the course of a drilling operation. This movement may cause contact between frictional material A and frictional material B and therefore, the generation of electricity. In one or more embodiments, electricity may be generated via friction resulting from contact between power moveable member 860 and bearing 820.

Figure 8C:
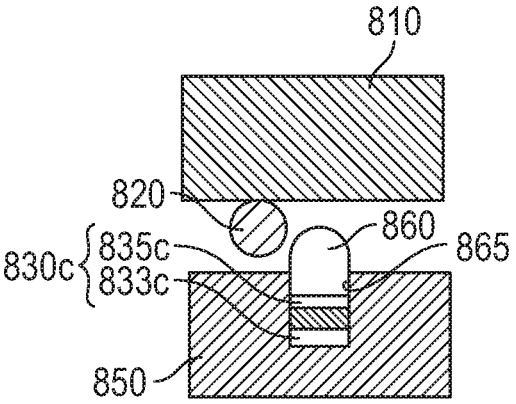
Figure 8D:
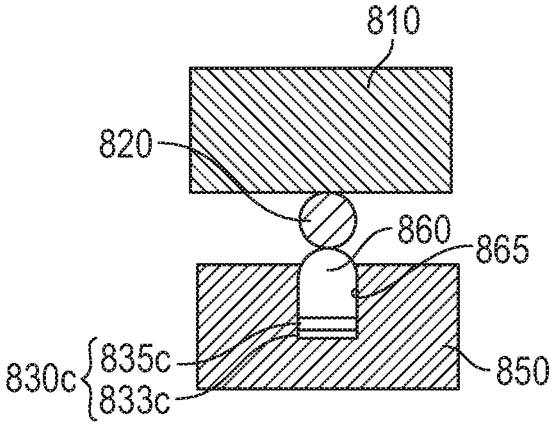

In FIGS. 8C and 8D, power moveable member 860 is partially coated with frictional material B 835*c* and power moveable member retainer 865 is partially coated with frictional material A 833*c*. As the drillstring assembly rotates, bearing 820 makes contact with power moveable member 860, causing power moveable member 860 to move up and down within power moveable member retainer 865. This movement results in contact between frictional material A and frictional material B, generating electricity. In one or more embodiments, the power generation component 830*c* may be power moveable member retainer 865 partially coated with frictional material A and power moveable member 860 formed of or coated with frictional material B. In one or more embodiments, power moveable member 860 may be formed of or coated with frictional material B and power moveable member retainer 865 may be formed of or coated with frictional material A. In one or more embodiments, electricity may be generated via friction resulting from contact between frictional material B of power moveable member 860 and frictional material B of power moveable member retainer 865.

Figure 8E:
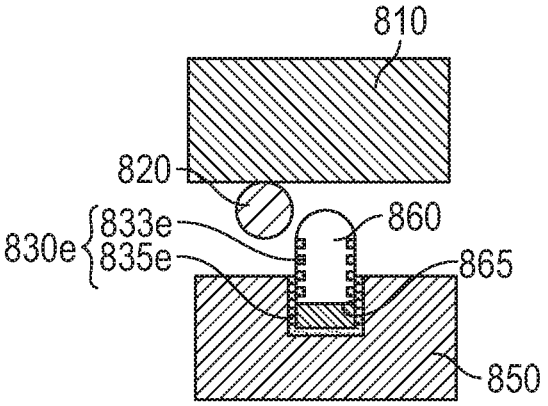
Figure 8F:
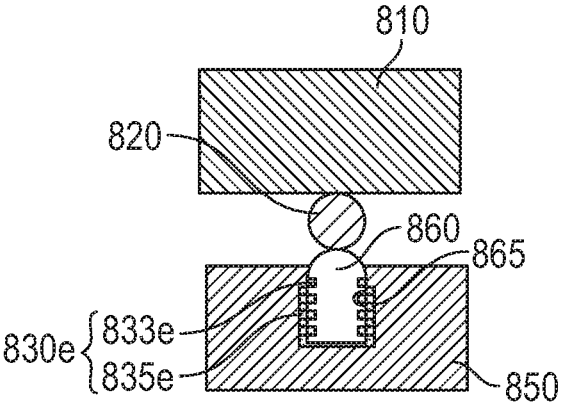

In FIGS. 8E and 8F, power moveable member 860 is coated with alternating segments of frictional material A and frictional material B 835*e*. Power moveable member retainer 865 is also coated with alternating segments of frictional material A and frictional material B 833*e*. As the drillstring assembly rotates, bearing 820 makes contact with power moveable member 860, causing power moveable member 860 to move up and down within power moveable member retainer 865. The sliding motion of the alternating segments on both power moveable member 860 and power moveable member retainer 865 triggers contact between frictional materials A and B, resulting in the generation of electricity. In one or more embodiments, the power generation component 830*e* may be alternating segments of frictional material A and frictional material B on power moveable member 860 and power moveable member retainer 865. In one or more embodiments, power moveable member 860 and power moveable member retainer 865 may each be formed of or coated with alternating segments of frictional material A and frictional material B. In one or more embodiments, electricity may be generated via friction resulting from contact between frictional material A and frictional material B on both power moveable member 860 and power moveable member retainer 865.

Instead of triboelectricity, FIGS. 8G-8J employ piezoelectric or magnetostrictive materials to generate electricity.

Figure 8G:
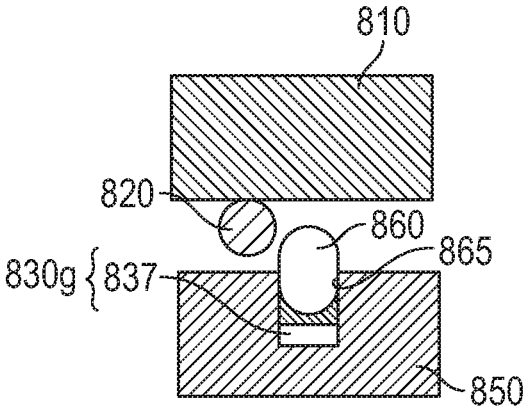
Figure 8H:
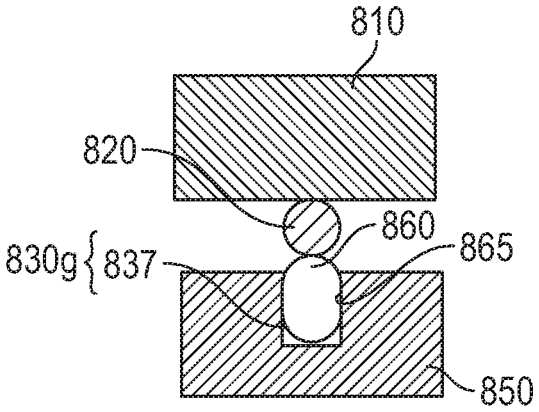

Piezoelectricity is the conversion of mechanical stress into electric charge. Piezoelectric materials are materials that exhibit piezoelectricity. FIGS. 8G and 8H depict power moveable member 860 connected to outer collar 850 by piezoelectric base 837 within power moveable member retainer 865. Power moveable member 860 has a curved surface at both ends. As the drillstring assembly rotates, bearing 820 makes contact with power moveable member 860, causing power moveable member 860 to move up and down within power moveable member retainer 865. This movement results in contact of power moveable member 860 with piezoelectric base 837 that stresses and unstresses piezoelectric base 837. This cycle of stress within piezoelectric base 837 generates electricity. In one or more embodiments, one or more power generation component 830*g* may be piezoelectric base 837. In one or more embodiments, electricity may be generated via piezoelectricity resulting from stress in piezoelectric base 837 by power moveable member 860. In one or more embodiments, piezoelectric base 837 may be formed of quartz, langasite, lithium niobate, titanium oxide, lead zirconate titanate, or any other material exhibiting piezoelectricity.

Figure 8I:
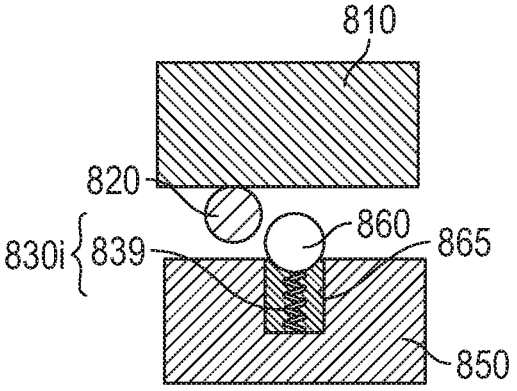
Figure 8J:
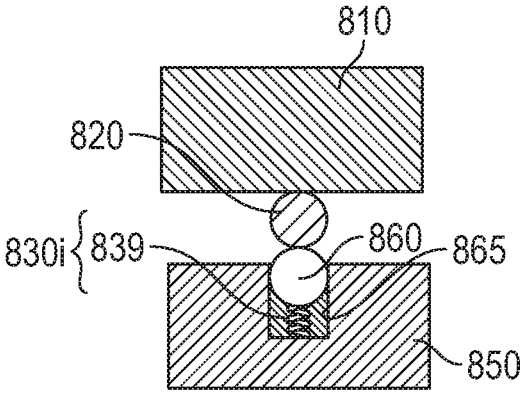

Piezoelectric nanoribbons generate electricity when flexed and stressed. FIGS. 8I and 8J depict power moveable member 860 connected to outer collar 850 by piezoelectric nanoribbon base 839. As the drillstring assembly rotates, bearing 820 makes contact with power moveable member 860, causing power moveable member 860 to move up and down within power moveable member retainer 865. Contact between bearing 820 and power moveable member 860 results in flexing, stressing, or both of piezoelectric nanoribbon base 839. In one or more embodiments, one or more power generation component 830*i* may be piezoelectric nanoribbon base 839. In one or more embodiments, piezoelectric nanoribbon base 839 may be formed of ceramic nanoribbons, such as lead zirconate titanate. In one or more embodiments, piezoelectric nanoribbon base 839 may be encased in a flexible elastomer (not depicted).

Magnetostrictive materials are materials that exhibit magnetostriction. Magnetostriction is the generation of a magnetic field due to mechanical stress. This induced magnetic field may be converted to a voltage by a planar pick-up coil or a solenoid placed in the vicinity of the magnetostrictive material. In one or more embodiments, one or more power generation component may be magnetostrictive base (not depicted). In one or more embodiments, Terfenol-D ($Tb_xDy_{1-x}Fe_2$ ($x \approx 0.3$)), galfenol (meaning predominantly Fe and Ga alloys), metallic glass alloys (such as Metglas® alloy), or any other material that show magnetostrictive properties may be employed in a power array. In some embodiments, the magnetostrictive material employed in a power array may be a commercially available product.

In one or more embodiments, generated analogue electrical signals may be converted from an analog to a digital signal. In one or more embodiments, analogue to digital conversion may be performed using electronics well known in the art, such as an analog-to-digital converter (ADC) or a bridge rectifier circuit employing diodes.

One or more embodiments of the power array may include one or more electrical storage units that store the electrical energy generated by the power array. In one or more embodiments, the storage unit may be used as a regulated power source even when the drillstring is not rotating. In one or more embodiments, the storage unit may be either a regular di-electric capacitor de-rated for use at high temperatures, a ceramic, an electrolytic, or a super capacitor.

In one or more embodiments, by storing the generated power in the storage unit(s), power may be provided continuously to the components, including the sensor(s), instrumentation, communication devices, or a combination thereof.

In some embodiments, an amount of power generated depends on the relative motion between inner ring and outer collar. Thus, factors such as rate of penetration in different formations of the drillstring, drilling hydraulics and rheology of the formation, wellbore cleaning efficiency, and vibration and shock may influence this relative motion.

In one or more embodiments, a power output of power array may depend on the principle of energy harvesting utilized (static electric, piezoelectric, magnetostrictive); size and design of the power array; materials used for energy harvesting; frequency of the energy trigger to drive the materials; or a combination of these factors. In one or more embodiments, a power output may depend on energy storage capacity of the electrical storage unit, power management and type; sampling rate of the distance sensors; type of distance sensors; or a combination of these factors. In one or more embodiments, a distance sensor included may be a magnetic distance sensor fabricated as a MEMS device, which may require much less power than some alternatives.

In one or more embodiments. the power array may generate power up to several watts instantaneously, depending on the frequency of interaction between bearings and power moveable members in power array. The particular design of a power array may provide a stable and continuous power supply to any power-requiring devices, including distance sensor(s) or instrumentation during drilling. Further, in one or more embodiments, the power array may store generated power that, in the absence of drilling that rotates the drillstring or any other relative motion, energy storage unit(s) such as the capacitor may act as a regulated power source.

In one or more embodiments. the power array may be optimized regarding size, design, advanced materials used for energy harvesting, frequency of operation, energy storage capacity of the energy storage unit(s), power management, sampling rate of the distance sensors, or a combination thereof. In one or more embodiments, the power array may power one or more distance sensors, such as magnetic distance sensors, optical distance sensors, acoustic distance sensors, capacitive distance sensors, or other distance sensors known in the art. In one or more embodiments. the power array may power one or more additional sensors, such as magnetic sensors, optical sensors, electrical sensors, pressure sensors, temperature sensors, acoustic sensors, accelerometers sensors, or gyroscopic sensors, or other sensors known in the art.

In one or more embodiments. the power array may power wireless communication as discussed further. In one or more embodiments, the power array may generate and store additional power during lower power mode(s) (such as sensing) and then deliver extra power during higher power modes (such as transmission) for one or more high power mode(s) (such as transmission of RF communications). Such power optimization, in one or more embodiments, may be performed by power management circuitry.

In one or more embodiments, more than one fundamental energy harvesting principle may be combined within a single power array.

In one or more embodiments, an array such as a sensor array, a power array, or an SPSA, may be directly connected to a drillstring. In one or more embodiments, an array such as a sensor array, a power array, or an SPSAs, may be attached to or be part of a sub, such as crossover sub, that may be inserted into a drillstring.

Figures 9A, 9B, 9C, 9D:
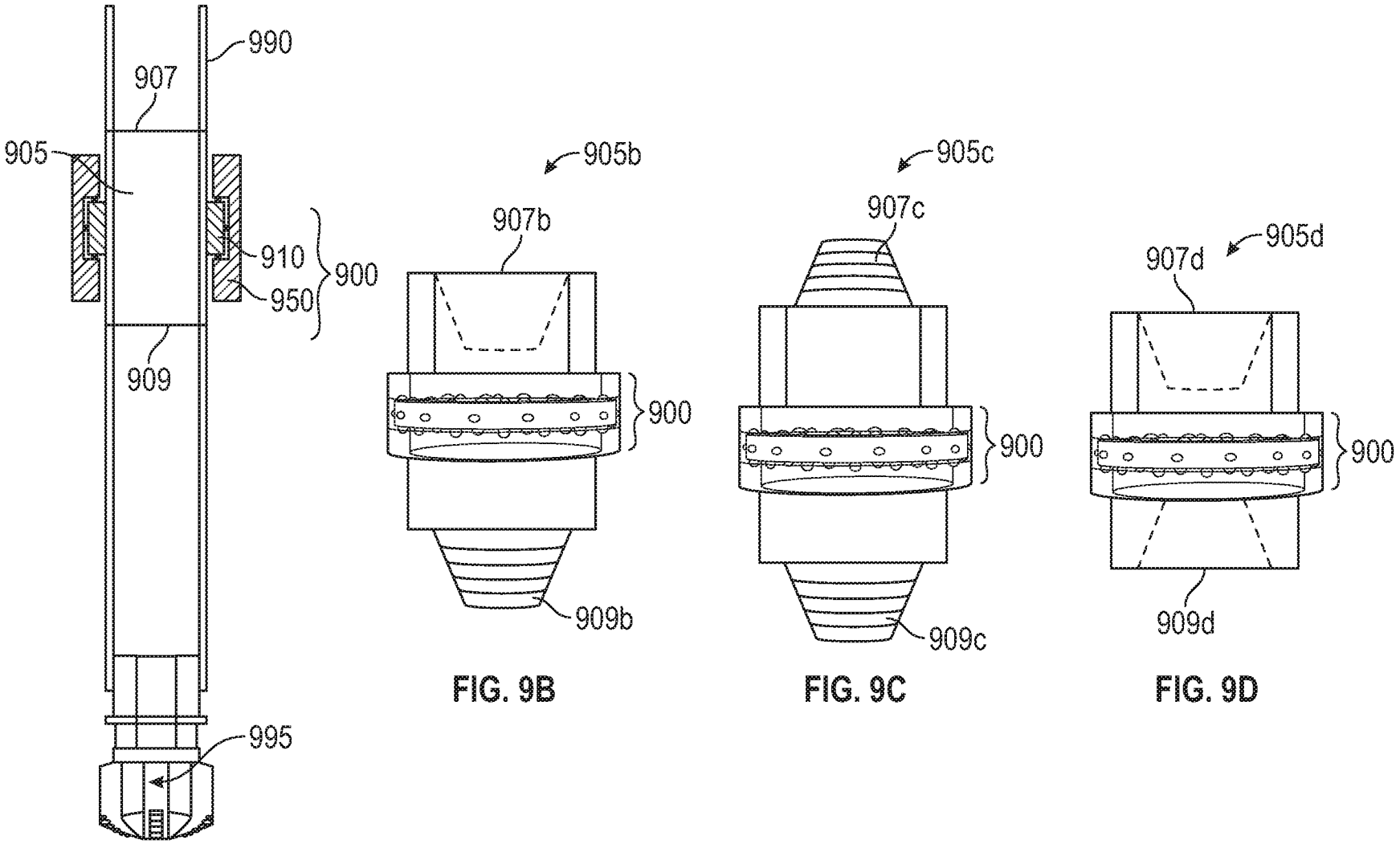
FIG. 9A-9D depicts embodiments of an array along a drillstring.

FIG. 9A depicts an array 900 such as a sensor array, a power array, or an SPSAs arranged around a drillstring 990 atop drill bit 995. Array 900 includes inner ring 910 and outer collar 950. Array 900 is attached to sub 905. Sub 905 is connected to drillstring 990 via a first connector 907 and a second connector 909.

FIGS. 9B-9D depicts how array 900 may be connected to a drillstring 990 via a crossover sub 905. In some embodiments, said crossover sub may be a pin-box type sub (FIG. 9B), pin-pin type sub (FIG. 9C), or box-box type sub (FIG. 9D).

FIG. 9B depicts sub 905*b* including array 900. First connector 907*b* is a pin-type connector. Second connector 909*b* is a box-type connector. Thus, sub 905*b* is a pin-box type sub.

FIG. 9C depicts sub 905*c* including array 900. First connector 907*c* is a pin-type connector. Second connector 909*c* is a pin-type connector. Thus, sub 905*c* is a pin-pin type sub.

FIG. 9D depicts sub 905*d* including array 900. First connector 907*d* is a box-type connector. Second connector 909*d* is a box-type connector. Thus, sub 905*d* is a box-box type sub.

Figure 10:
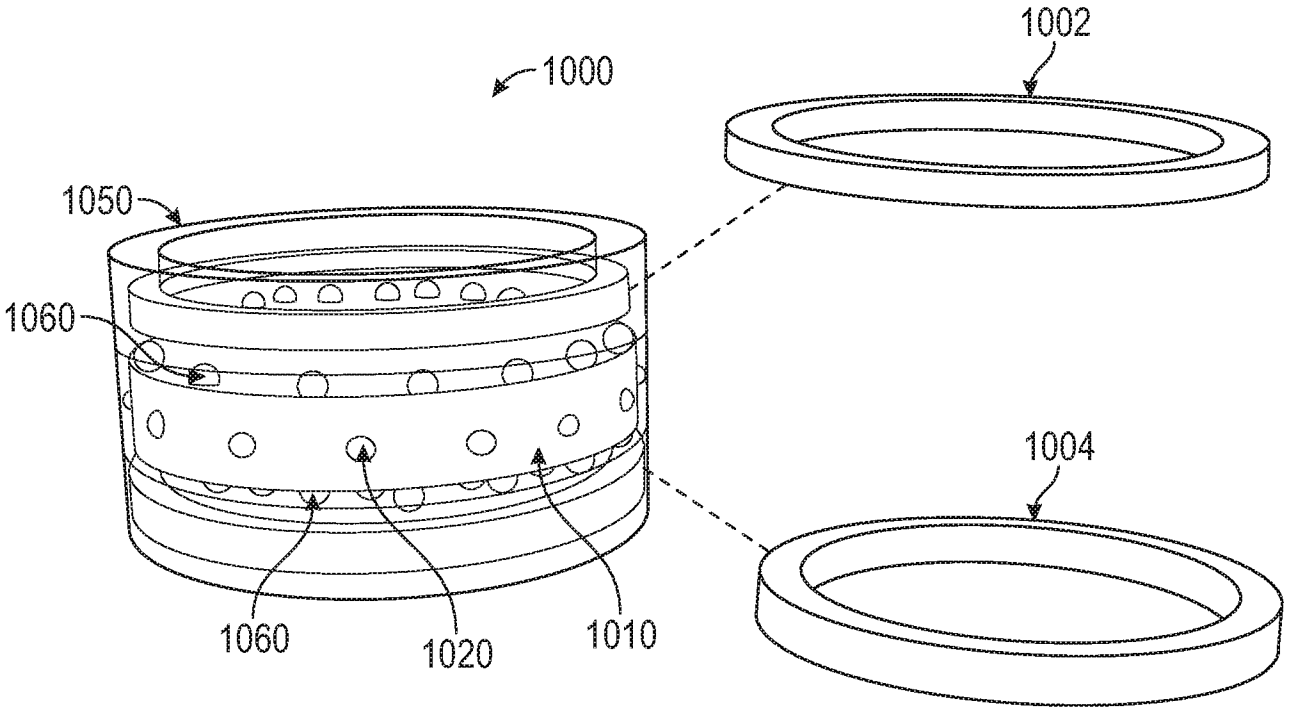
FIG. 10 depicts an embodiment of an array.
Figure 14:
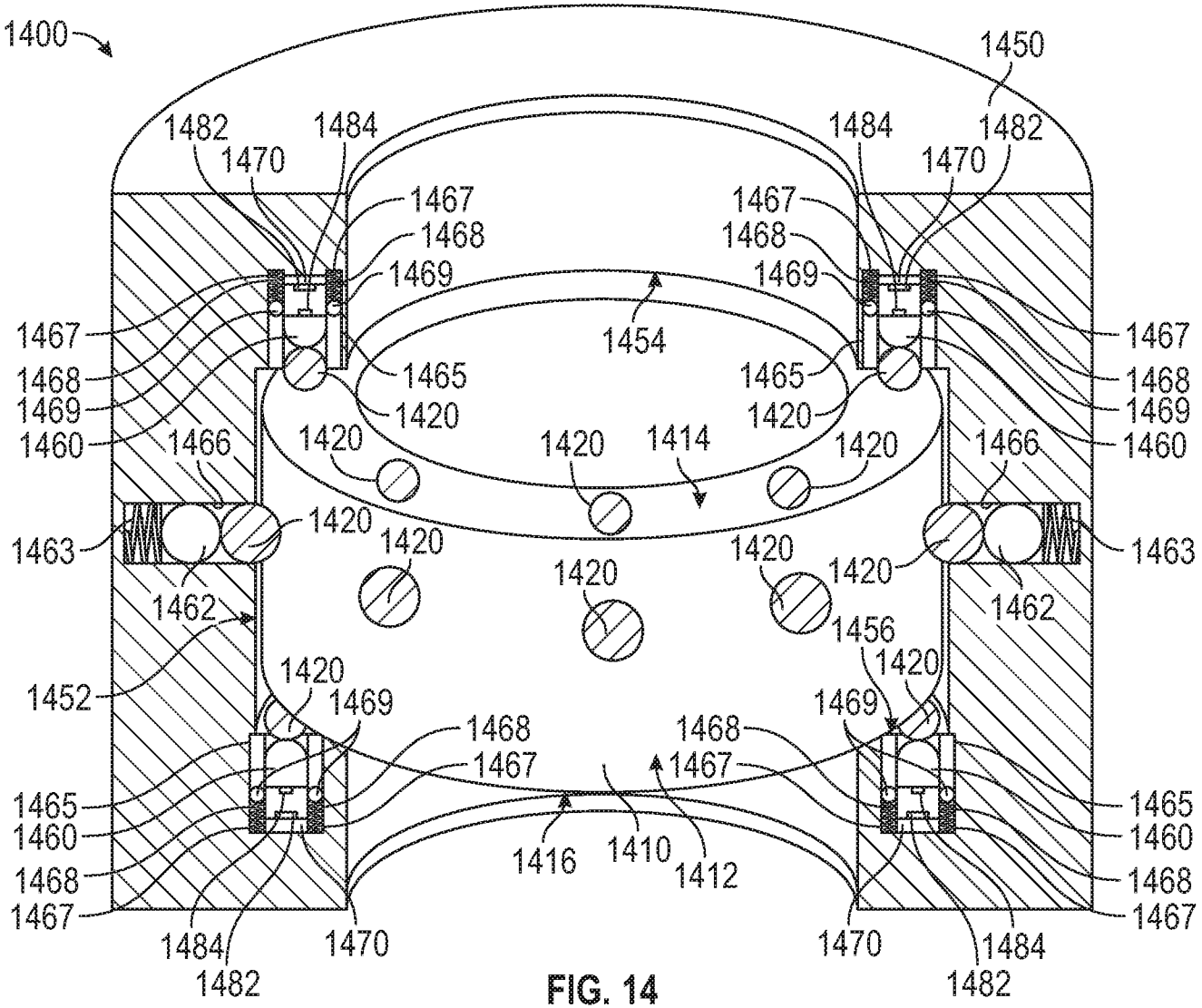
FIG. 14 depicts a cross section of an embodiment of a power array.

Consider FIG. 10, which depicts additional potential components of an array 1000 of any type disclosed herein, including a sensor array (FIG. 2), a power array (FIG. 7), or an SPSA (FIG. 14). FIG. 10 depicts array 1000, including inner ring 1010 with bearings 1020 and outer collar 1050 with moveable members 1060 (either sensor or power moveable members).

As depicted, in one or more embodiments, communication device 1002 and electronics 1004 may be folded within and carried by outer collar 1050. In one or more embodiments, communication device 1002, electronics 1004, or both may be carried by outer collar 1050. In one or more embodiments, communication device 1002, electronics 1004, or both may be folded within outer collar 1050.

In one or more embodiments, distance sensors, additional sensors, instrumentation, and signal processing circuits of array 1000 may be included in electronics 1004. In one or more embodiments, electronics 1004 may be fabricated on a flexible substrate and thus may be flexible. One or more embodiments of electronics 1004 may be fabricated from one or more of metal-polymer conductors, organic polymers, printable polymers, metal foils, transparent thin-film materials, glasses, 2D materials (such as graphene and MXene), silicon, fractal metal dendrites, or derivatives, alloys, composites, and combinations thereof.

In one or more embodiments, output of a power array (FIG. 7) may be a digital signal. In one or more embodiments, this digital signal may be stored in a power storage unit, such as a regular dielectric capacitor de-rated for use at high temperatures, a ceramic, an electrolytic, or a super capacitor. By storing the generated energy in a power storage unit, power may be provided continuously to any components requiring outside power, such as distance sensors, other sensors, instrumentation, and communication devices.

In one or more embodiments, power storage unit(s) (not depicted) may provide power to one or more devices such as low power signal processing circuitry. In one or more embodiments, this low power signal processing circuitry may perform a number of tasks, including conditioning the data, storing the data in local memory, performing power management, or a combination of tasks. In one or more embodiments, power management may include interfacing with the power array and storage unit to deliver the appropriate system voltages and load currents to the circuit blocks in an efficient manner.

In one or more embodiments, electronics 1004 may include low power signal processing circuitry. In one or more embodiments, the low power signal processing circuitry included in electronics 1004 may be CMOS-based, microcontroller-based, digital signal processor (DSP)-based, field programmable gate array (FPGA)-based, application-specific integrated circuit (ASIC)-based, complex programmable logic device (CPLD)-based, system-on-chip (SoC)-based, or a combination thereof.

Array 1000 may further include the ability to wirelessly communicate with other components, such as with other arrays (FIG. 11) along a drillstring, with a receiver, or both. In some embodiments, the receiver (not depicted) may be located apart from the array(s), such as at the surface of the wellbore. Wireless technologies such as Wi-Fi, Bluetooth, Bluetooth Low Energy, or ZigBee may be employed for high speed data transfer due to the amount of power that may be generated and stored by a power array in a downhole drilling environment.

In one or more embodiments, array 1000 may include one or more communications device 1002. In one or more embodiments, communications device 1002 may include an antenna. In one or more embodiments, communications device 1002 may include a communications module with electronics or a processor for running communications device 1002. In one or more embodiments, electronics 1004 may include circuitry necessary for communications device 1002.

In one or more embodiments, communications device 1002 may transmit and receive data from downhole to uphole and uphole to downhole. In one or more embodiments, an antenna may transmit and receive data from downhole to uphole and uphole to downhole.

In one or more embodiments, communications device 1002 may include a transceiver (not depicted). In one or more embodiments, the transceiver may employ one or more low-power wireless communication technologies, such as low-power Wi-Fi, Bluetooth, Bluetooth Low Energy, ZigBee, or other low-power wireless technologies known in the art.

One having skill in the art will appreciate how higher frequencies allow for a better quality signal and a longer transmission distance. However, higher frequency communication signals also may have higher attenuation and higher power requirements. Here, "higher frequency" is intended to mean frequencies of up to 1 gigahertz (GHz). Also, the communication frequency of antenna within communications device 1002 may require optimization to ensure both high quality data transmission and appropriate power requirements. In one or more embodiments, the communication signal transmitted by antenna 1002 may have a higher frequency.

Given the power constraints of array 1000, one or more embodiments of array 1000 may include power management of communications device 1002 including antenna, electronics, processor, and other components of communications device 1002.

In one or more embodiments, array 1000 may not be continuously broadcasting from communications device 1002. In one or more embodiments, array 1000 may not simultaneously broadcast from communications device 1002 and perform the sensing operations discussed previously (FIG. 6A-6F).

In one or more embodiments, communications device 1002 may have an "active" mode, a "stand by" mode, a "sleep" mode, or a combination of these. In one or more embodiments, "active" mode may be when communications device 1002 transmits data, receives data, or both via an antenna. In some embodiments, "active" mode may have a short duration, since there may only be a few short tasks. In one or more embodiments, "stand-by" mode may be when communications device 1002 is ready to re-enter "active" mode, but is not actively transmitting from the antenna. In some embodiments, "stand by" mode may have a longer duration than "active" mode. In one or more embodiments, "sleep" mode may be when communications device 1002 is not prepared to transmit via the antenna and thus may have a very low power consumption. In some embodiments, "sleep" mode may have a longer duration than "stand by" mode. In some embodiments, communications device 1002 may be in "sleep" mode while performing the sensing operations discussed previously (FIG. 6A-6C).

In one or more embodiments, the energy saved during "stand by" mode, "sleep" mode, or both may be use to power communication module (not depicted) in "active" mode.

In one or more embodiments, an antenna within communications device 1002 may transmit/receive a signal from downhole to uphole and uphole to downhole. In one or more embodiments, the signal may be received by the antenna within communications device 1002. In one or more embodiments, this signal may be transmitted in a continuous mode (such as during drilling), semi-continuous mode (such as on a periodic or intermittent basis), a burst mode (such as if data is stored locally, then transmitted in large packets), or other communication modes known in the art.

Figure 11:
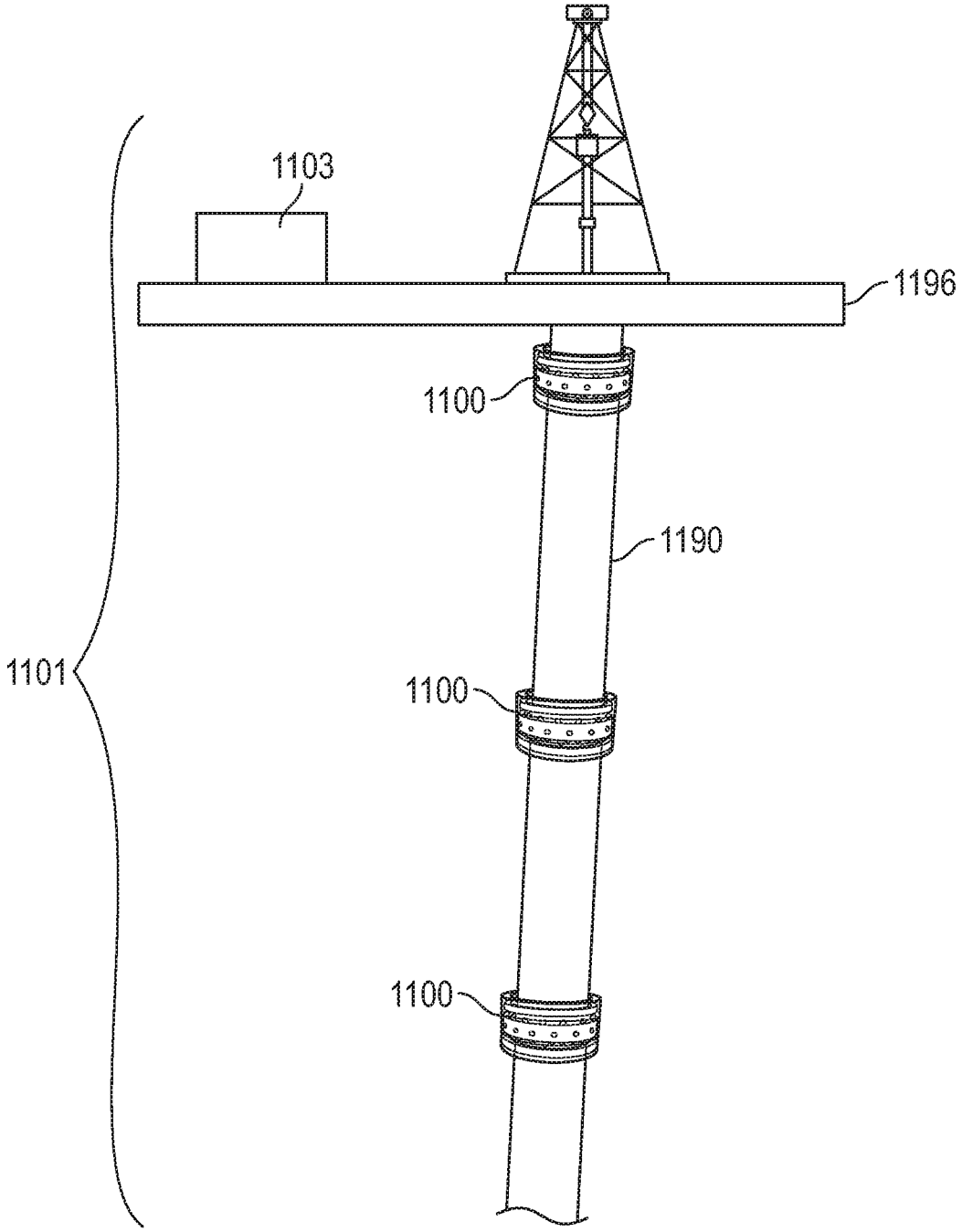
FIG. 11 depicts an embodiment of a system having arrays along a drillstring.

FIG. 11 depicts a sensing system 1101 including a receiver 1103 and multiple arrays 1100 that may be placed all along drillstring 1190. In one or more embodiments, system 1101 includes components both above and below ground 1196. In one or more embodiments, each of the arrays 1100 may be a sensor array, a power array, an SPSA, or a combination therein. In FIG. 11, three arrays 1100 are depicted on drillstring 1190.

In one or more embodiments, arrays 1100 may be located at particular intervals along drillstring 1190. Locating arrays 1100 along drillstring 1190, in some embodiments, may help obtain real-time distributed data via sensors that incorporate distance sensors with SMM in one or more of arrays 1100.

There may be data that could be transmitted along the drillstring 1090 wirelessly. One or more embodiments of arrays 1100 may wirelessly move data along drillstring 1090. In one or more embodiments, arrays 1100 may serve as nodes within a relay formed from sensing system 1101. In such a system according to one or more embodiments, data may be transmitted along drillstring 1090 between arrays 1100 serving as nodes from the bottom to the surface and from the surface to the bottom. In such a system according to one or more embodiments, data may be transmitted along drillstring 1090 between arrays 1100 serving as nodes and receiver 1103.

In one or more embodiments, arrays 1100 may be located along drillstring 1190 at intervals based on the maximum distance data may be transmitted from one array 1100 to another array 1100. In one or more embodiments, transmission between arrays 1100 along the length of drillstring method of transmitting data along drillstring 1195 may be independent of drilling.

In one or more embodiment, sensing system 1101 may further include smart, miniature mobile devices (MMD) (not depicted) having a communication module that can be injected into wells to carry commanding signals to downhole equipment such as arrays 1100. Such miniature mobile devices may carry commanding signals to arrays 1100 to activate/configure to arrays 1100 as well as read data outputs from to arrays 1100. In one or more embodiments, MMDs may interface or improve the signal between arrays 1100 and receiver 1103.

Figure 12A:
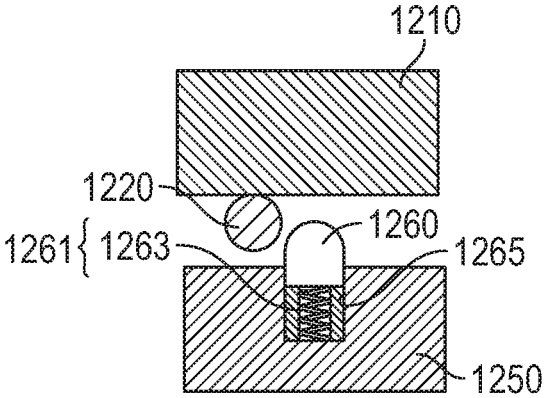
FIGS. 12A-12D depict cross sections of multiple embodiment of a moveable member.
Figure 12B:
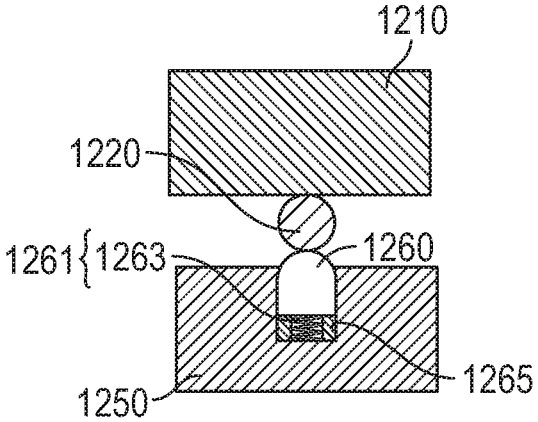
Figure 12C:
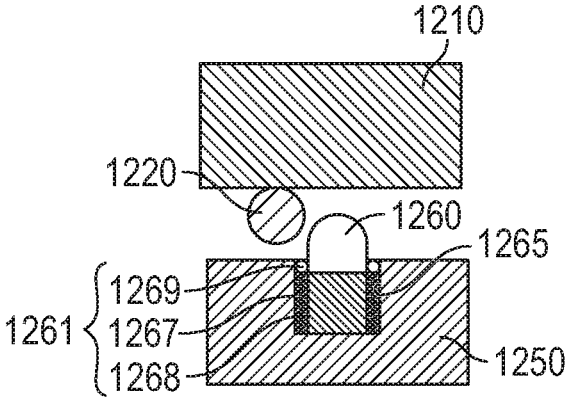
Figure 12D:
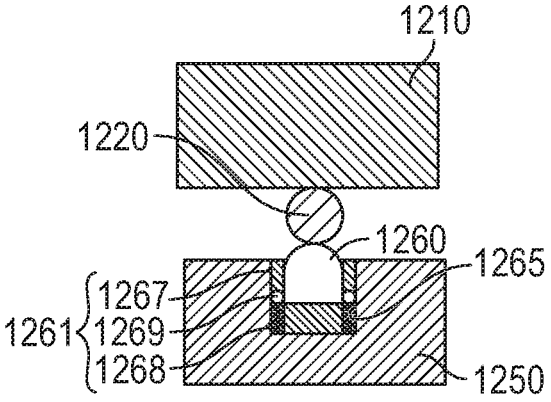
Figure 12E:
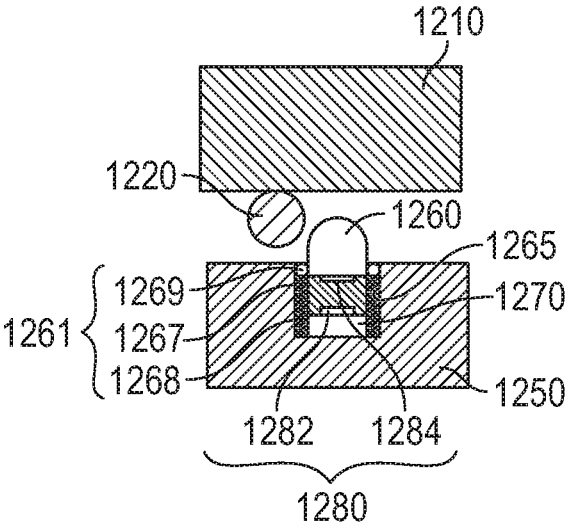
FIGS. 12E-12F depict cross sections of multiple embodiment of a sensor moveable member.
Figure 12F:
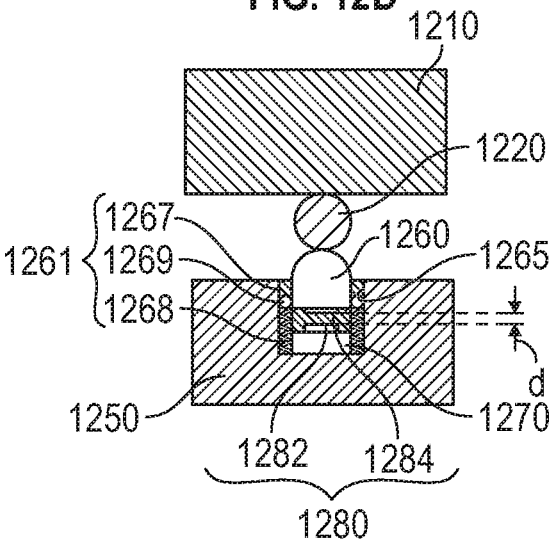

FIGS. 12A-12F depict a cross section of an array (FIG. 1) having an outer collar 1250 having a moveable member 1260 (either a sensor moveable member or a power moveable member) within a moveable member retainer 1265. FIGS. 12A and 12B; FIGS. 12C and 12D; and FIGS. 12E and 12F each depict an extension mechanism 1261 for applying a biasing force to return moveable member 1260 to the original, extended position when not pushed by bearing 1220 into moveable member retainer 1265. FIGS. 12E and 12F depict the same extension mechanisms 1261 as in FIGS. 12C and 12D, however moveable member 1260 is in the form of a sensor moveable member. FIGS. 12A, 12C, and 12E depict moveable member 1260 in the original, extended position, prior to (or following) engagement with bearing 1220. FIGS. 12B, 12D, and 12F depict the same moveable member 1260 as in FIGS. 12A, 12C, and 12E respectively at the point of maximum engagement with bearing 1220.

In FIGS. 12A and 12B, moveable member 1260 is connected to moveable member retainer 1265 with an extension mechanism 1261 in the form of a large spring 1263. Thus, the biasing force is generated by large spring 1263. In FIG. 12A, large spring 1263 is fully extended prior to (or following) engagement between bearing 1220 and moveable member 1260. Thus, moveable member 1260 is in the original, extended position. In FIG. 12B, upon engagement between moveable member 1260 and bearing 1220, large spring 1263 is elastically compressed into moveable member retainer 1265. This compression of large spring 1263 generates potential energy that is stored in large spring 1263. Once bearing 1220 moves past (and is thus no longer in contact with) moveable member 1260, the extension of large spring 1263 causes moveable member 1260 to return to the original, extended position. Further, large spring 1263 may make the up and down movement of moveable member 1260 within moveable member retainer 1265 smooth. Since the compression and release of large spring 1263 may be assumed to be entirely elastic, this compression cycle of large spring 1263 may be repeated a very large number of times. In some embodiments, large spring 1263 may further constrain moveable member 1260 within moveable member retainer 1265. In some embodiments, large spring 1263 may be the mechanism to keep moveable member 1260 in the original, extended position when not pushed by bearing 1220 into moveable member retainer 1265.

In FIGS. 12C-12F, moveable member 1260 is connected to moveable member retainer 1265 by an extension mechanism 1261 that includes movement tracks 1267, movement track bearings 1269, and small springs 1268. Two or more movement tracks 1267 are located on the interior sides of moveable member retainer 1265. Such movement tracks 1267 connect moveable member 1260 to moveable member retainer 1265. Further, movement track bearings 1269 may make the up and down movement of moveable member 1260 within moveable member retainer 1265 smooth. In some embodiments, movement track(s) 1267 may further constrain moveable member 1260 within moveable member retainer 1265. In some embodiments, the connection between moveable member 1260 and movement tracks 1267 may include movement track bearing(s) 1269. In some embodiments, moveable member 1260 may be located on one or more movement tracks 1267 along an inner surface(s) of moveable member retainer 1665. In some embodiments, movement track bearing(s) 1269 may be located between moveable member 1260 and movement track(s) 1267.

In FIGS. 12C and 12D, within each movement track 1267 is a small spring 1268 and a movement track bearing 1269 attached to moveable member 1260. Thus, the biasing force is generated by small springs 1268. In FIG. 12C, the small springs 1268 are fully extended prior to (or following) engagement between bearing 1220 and moveable member 1260. Thus, moveable member 1260 is in the original, extended position. In FIG. 12D, upon engagement between moveable member 1260 and bearing 1220, each small spring 1268 is elastically compressed within movement track 1267 by movement track bearing 1269. This compression of small spring 1268 generates potential energy that is stored in small spring 1268. Once bearing 1220 moves past (and is thus no longer in contact with) moveable member 1260, the extension of each of the small springs 1268 within movement track 1267 pushes movement track bearing 1269, ultimately causing moveable member 1260 to return to the original, extended position. Since the compression and release of small springs 1268 may be assumed to be entirely elastic, this compression cycle of small springs 1268 may be repeated a very large number of times.

FIGS. 12E-12F depict a similar extension mechanism 1261 that includes a pair of movement tracks 1267 (including small springs 1268 and movement track bearings 1269) as in FIGS. 12C and 12D. Again, the biasing force is generated by small springs 1268. However, these moveable member 1260 are in the form of a sensor moveable member 660, such as those discussed previously and depicted in FIGS. 6A-6F. FIG. 12E depicts sensor moveable member 1260 prior to (or following) engagement with a bearing 1220, while FIG. 12F depicts sensor moveable member 1260 at the point of maximum engagement between sensor moveable member 1260 and bearing 1220. A distance sensor 1280 includes a target 1284 and a detector 1282. Target 1284 is on a base of sensor moveable member 1260 and detector 1282 is on top of a shape memory material element 1270 within moveable member retainer 1265. Target 1284 and detector 1282 may be of any type known in the art, such as those depicted in FIGS. 6A-6F and discussed previously. Extension distance d between the components of distance sensor 1280 is indicated in FIG. 12F.

In some embodiments, the stiffness of small spring(s) 1268, the geometry of movement track 1267, or both may constrain sensor moveable member 1260 to only move within moveable member retainer 1265 toward and away from shape memory material element 1270. In one or more embodiments, for a set expansion of shape memory material element 1270, the maximum and minimum extension distance d may be dictated by the stiffness of small spring(s) 1268, the geometry of (such as the length and the position of) movement track 1267, or both.

In one or more embodiments, extension distance d may be non-zero when shape memory material element 1270 is maximally expanded in response to environmental parameters. Thus, in one or more embodiments, there may be no contact between the components of distance sensor 1280 (meaning between target 1284 and detector 1282), even when shape memory material base 1270 is maximally expanded in response to environmental parameters. In some embodiments, the stiffness of small spring(s) 1268, the geometry of movement track 1267, or both may prevent contact between the components of distance sensor 1280, meaning between target 1284 and detector 1282. In some embodiments, the stiffness of small spring(s) 1268, the geometry of movement track 1267, or both may dictate a minimum extension distance d when shape memory material element 1270 is maximally expanded in response to environmental parameters.

In some embodiments, small spring(s) 1268 and/or large spring(s) 1263 may have any size or shape. In some embodiments, the stiffness of small spring(s) 1268 and/or large spring(s) 1263 may be optimized to maximize the up and down motion within moveable member retainer 1265. In some embodiments, small spring(s) 1268 and/or large spring(s) 1263 may minimize motion retardation and experience compression and extension at the same time. In some embodiments, small spring(s) 1268 and/or large spring(s) 1263 may be any type of spring, such as a compression spring, an extension spring, a torsion spring, a Belville spring, or a combination. In some embodiments, small spring(s) 1268 and/or large spring(s) 1263 may be formed from one or more elastic materials. In some embodiments, small spring(s) 1268 and/or large spring(s) 1263 may have any spring constant. In some embodiments, small spring(s) 1268 and/or large spring(s) 1263 of a power moveable member may contribute to the momentum of frictional material A contacting frictional material B therefore, thereby increasing the charge transfer between frictional material A and frictional material B.

In some embodiments, small spring(s) 1268 and/or large spring(s) 1263 may store mechanical energy in the form of potential energy and release it as the restorative force, resulting in a constant spring coefficient. In some embodiments, small spring(s) 1268 and/or large spring(s) 1263 may produce restorative forces directly proportional to the spring 1268, 1263 displacement. Thus, in some embodiments, small spring(s) 1268 and/or large spring(s) 1263 may generally obey Hook's law.

In some embodiments, small spring(s) 1268 and/or large spring(s) 1263 may produce restorative forces that are not proportional to the displacement of the spring 1268, 1263. In some embodiments, small spring(s) 1268 and/or large spring(s) 1263 may store mechanical energy in the form of potential energy and provide restorative forces according to the needs of particular embodiment(s). In some embodiments, small spring(s) 1268 and/or large spring(s) 1263 may produce restorative forces that are not directly proportional to their displacement. Thus, in some embodiments, small spring(s) 1268 and/or large spring(s) 1263 may generally not obey Hook's law.

One having skill in the art will appreciate additional mechanisms that may be used to return moveable member 1260 to the original, extended position when not engaged with bearing 1220.

Figure 13A:
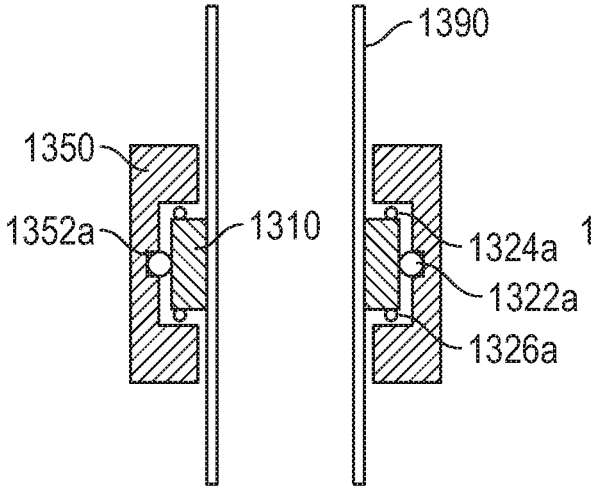
FIGS. 13A and 13B depict a cross section of embodiments of an array around a drillstring.

FIG. 13A depicts a cross section of an array (FIG. 1) having an inner ring 1310 and outer collar 1350 arranged around drillstring 1390. Inner ring 1310 has bearings on three surfaces of inner ring 1310: a first fraction of bearings 1322*a* on a middle outer surface; a second fraction of bearings 1324*a* on a top outer surface; and a third fraction of bearings 1346*a* on a bottom outer surface. First fraction of bearings 1322*a* is within a raceway 1352*a* located on the middle inner surface of outer collar 1350. First fraction of bearings 1322*a* within raceway 1352*a* serves to frictionlessly couple and maintain proper alignment of inner ring 1310 and outer collar 1350. Raceway 1352*a* does not contain moveable members of either type. Second fraction of bearings 1324*a* and third fractions of bearings 1326*a* are not located within a raceway. However, the paths of second fraction of bearings 1324*a* and third fractions of bearings 1326*a* do contain moveable members, either sensor moveable members, power moveable members, or both.

Figure 13B:
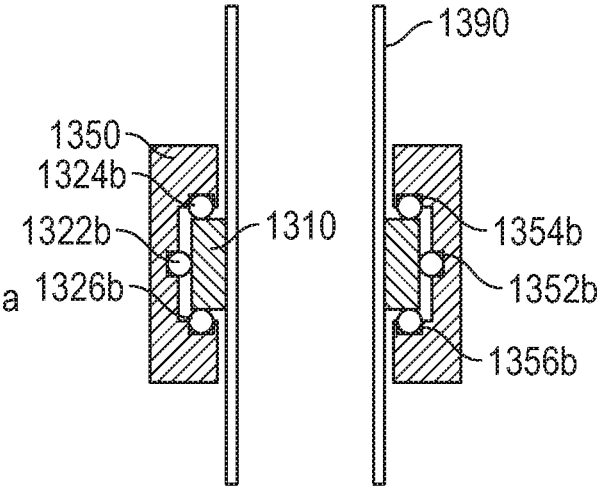

FIG. 13B depicts a cross section of an array (FIG. 1) having an inner ring 1310 and outer collar 1350 arranged around drillstring 1390. Inner ring 1310 has bearings on three surfaces of inner ring 1310: a first fraction of bearings 1322*b* on a middle outer surface; a second fraction of bearings 1324*b* on a top outer surface; and a third fraction of bearings 1346*b* on a bottom outer surface. First fraction of bearings 1322*b* is within a first raceway 1352*b* located on the middle inner surface of outer collar 1350. Second fraction of bearings 1324*b* is within a second raceway 1354*b* located on the top inner surface of outer collar 1350. Third fraction of bearings 1326*b* is within a third raceway 1356*b* located on the top inner surface of outer collar 1350. First fraction of bearings 1322*b* within first raceway 1352*b*, second fraction of bearings 1324*b* within second raceway 1354*b*, and third fraction of bearings 1326*b* within third raceway 1356*b* all serve to frictionlessly couple and maintain proper alignment of inner ring 1310 and outer collar 1350. Any or all of first raceway 1352*b*, second raceway 1354*b*, and third raceway 1356*b* may contain moveable members, either sensor moveable members, power moveable members, or both.

In one or more embodiments, bearings on inner ring may be within a corresponding raceway on outer collar. In one or more embodiments, bearings on inner ring may not be located within a corresponding raceway on outer collar. In one or more embodiments, raceways may have moveable members (of any type) that extend into the path of bearings. In one or more embodiments, raceways lack moveable members. In one or more embodiments, a raceway may contain either sensor moveable members or power moveable members. In one or more embodiments, a raceway may contain both sensor moveable members and power moveable members. In one or more embodiments, raceway(s) may serve to frictionlessly couple inner ring to outer collar. In one or more embodiments, arrays may include one or more raceways. In one or more embodiments, arrays may not include a raceway. In one or more embodiments, inner ring may be frictionlessly coupled to outer collar via some other method known in the art.

In one or more embodiments, bearings that move within a raceway may have a first diameter and bearings that move without a raceway may have a second diameter, where the first and second diameters are unequal. In one or more embodiments, the first bearing diameter (for bearings that move within a raceway) may be greater than a second bearing diameter (for bearings that do not move within a raceway).

In one or more embodiments, a raceway on the bottom inner surface may help prevent vibration or shock from damaging the array.

In one or more embodiments, a raceway on the middle inner surface may be beneficial when the array is in a deviated or horizontal orientation.

FIG. 14 depicts an embodiment of an SPSA 1400, which may be seen as a combination of a sensor array and a power array. FIG. 14 depicts SPSA 1400 where half of outer collar 1450 is cut away. SPSA 1400 includes two forms of moveable members: sensor moveable members 1460 and power moveable members 1462. In some embodiments, sensor moveable members 1460 and power moveable members 1462 may have convex surfaces for contact with bearings 1420.

Each sensor moveable member 1460 is moveably located within a moveable member retainer in the form of a sensor moveable member retainer 1465. Also within each sensor moveable member retainer 1465 is a shape memory material element 1470.

Additionally, within each sensor moveable member retainer 1465 is a distance sensor that includes a first sensing element in the form of a detector 1482 and a second sensing element in the form of a target 1484. Detector 1482 and target 1484 are arranged in opposing relation. Detector 1482 and target 1484 are separated by a gap 675 (FIGS. 6A-6F) that is responsive to a shape change of the shape memory material element 1470 and a displacement of the respective sensor moveable member 1460.

Each sensor moveable member 1460 is connected to sensor moveable member retainer 1465 with an extension mechanism that includes movement tracks 1467, movement track bearings 1469, and small springs 1468. Such an extension mechanism is depicted in FIGS. 12C-12F and described previously. Two movement tracks 1467 are located on the interior sides of sensor moveable member retainer 1465. Such movement tracks 1467 connect sensor moveable member 1460 to sensor moveable member retainer 1465.

Contact between bearing 1420 and sensor moveable member 1460 displaces sensor moveable member 1460 relative to sensor moveable member retainer 1465 in response to relative rotation between inner ring 1410 and outer collar 1450. Such displacement reduces gap 675 (FIGS. 6A-6F) between detector 1482 and target 1484, which is measured by detector 1482. In the depicted embodiment, gap 675 (FIGS. 6A-6F) is measured using a magnetic distance sensor 1482 and a magnetic target 1484 as depicted in FIGS. 6A and 6B and as discussed previously. In one or more embodiments, sensor moveable members 1460 of SPSA 1400 may measure gap 675 (FIGS. 6A-6F) using one or more distance sensing methodology, such as those depicted in FIGS. 6A-6F and discussed previously.

Each power moveable member 1462 is moveably located within a moveable member retainer in the form of a power moveable member retainer 1466.

Each power moveable member 1462 is connected to power moveable member retainer 1466 with an extension mechanism in the form of a large spring 1463. Such an extension mechanism is depicted in FIGS. 12A and 12B and described previously.

Contact between bearing 1420 and power moveable member 1462 may generate energy in response to relative rotation between inner ring 1410 and outer collar 1450 in one or more ways. First, contact between bearing 1420 and power moveable member 1462 displaces the power moveable member 1462 relative to power moveable member retainer 1466. Such a displacement may be harnessed to generate electricity as depicted in FIGS. 8C-8J and discussed previously. Further, energy may be generated via friction caused by contact between bearing 1420 and power moveable member 1462. In the depicted embodiment, energy is generated via friction between power moveable members 1462 and bearings 1420 as depicted in FIGS. 8A and 8B and as discussed previously. In one or more embodiments, power moveable members 1462 of SPSA 1400 may harness the relative rotation between inner ring 1410 and outer collar 1450 to generate energy in one or more methods, such as those depicted in FIGS. 8A-8J and discussed previously.

On inner ring 1410 are bearing elements in the form of bearings 1420 located on three outer surfaces: a top outer surface 1414, a middle outer surface 1412, and a bottom outer surface 1416. Additionally, a first fraction of bearings 1420 are on middle outer surface 1412, a second fraction of bearings 1420 are on top outer surface 1414, and a third fraction of bearings 1420 are on bottom outer surface 1416.

Within outer collar 1450 are three surfaces: a top inner surface 1454, a middle inner surface 1452, and a bottom inner surface 1456. All three surfaces 1454, 1452, 1456 of outer collar 1450 have moveable members in moveable member retainers, but the type of moveable members and moveable member retainers varies. Outer collar 1450 has sensor moveable members 1460 in sensor moveable member retainers 1465 on two surfaces: top inner surface 1454 and bottom inner surface 1456. However, middle inner surface 1452 has power moveable members 1462 within power moveable member retainers 1466.

Sensor array 1400 is a combination of inner ring 1410 and outer collar 1450. Inner ring 1410 may be located radially within outer collar 1450. First fraction of bearings 1420 on middle outer surface 1412 of inner ring 1410 are opposite middle inner surface 1452 of outer collar 1450; second fraction of bearings 1420 on top outer surface 1414 of inner ring 1410 are opposite top inner surface 1454 of outer collar 1450; and third fraction of bearings 1420 on bottom outer surface 1416 of inner ring 1410 are opposite bottom inner surface 1456 of outer collar 1450. This alignment allows second fraction of bearings 1420 on top outer surface 1414 of inner ring 1410 to contact a first fraction of sensor moveable members 1460 on top inner surface 1454 of outer ring 1450. Additionally, this alignment allows a third fraction of bearings 1420 on bottom outer surface 1416 of inner ring 1410 to contact a second fraction of sensor moveable members 1460 on bottom inner surface 1456 of outer ring 1450. Finally, this alignment allows first fraction of bearings 1420 on middle outer surface 1412 of inner ring 1410 to contact a first fraction of power moveable members 1462 on middle inner surface 1452 of outer ring 1450.

Figure 15:
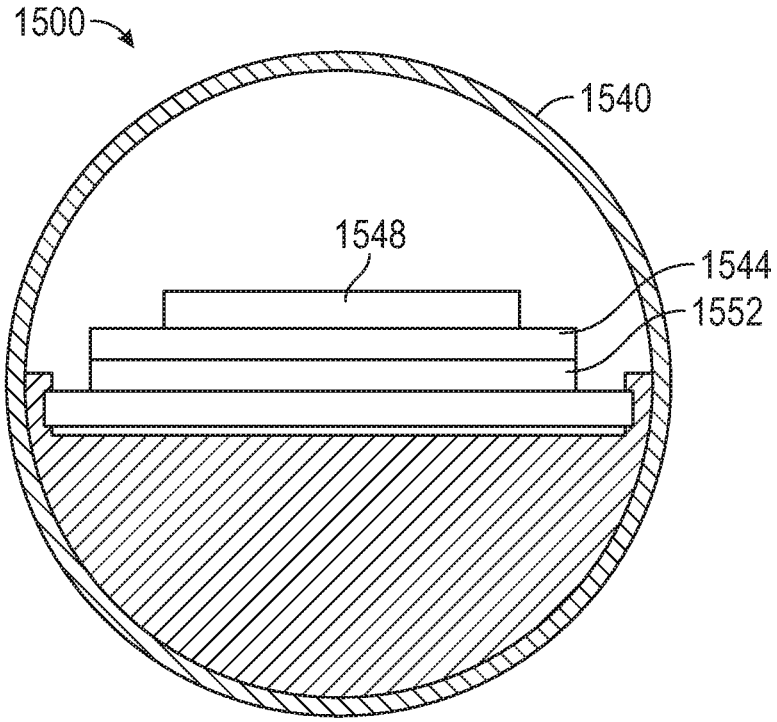
FIG. 15 depicts a cross section of an embodiment of a memory capsule.

Referring to FIG. 15, each memory capsule 1500 may include modules such as a microcontroller 1544, a transceiver 1548, and a rechargeable power source 1552. These modules may be manufactured on the same substrate to form a system-on-chip package. The package can be made very small using techniques such as segmenting and stacking of modules and interconnection of the modules with short signal paths known as through-chip via or through-silicon via. These techniques allow the same chip area to be used for all the different modules without compromises in material selection, resulting in seamless interlayer communication for interoperability of diverse modules. Transceiver 1548 allows memory capsule 1500 to communicate with SPSM 100. Rechargeable power source 1552 provides power to microcontroller 1544 and transceiver 1548. Rechargeable power source 1552 may be a capacitor-based energy storage, such as a supercapacitor. Microcontroller 1544 includes a processor, memory, and other circuitry. Memory capsule 1500 includes a protective outer shell 1540 around the electronics package. Protective shell 1540 may be a container made of a material or having an exterior coated with a material that can withstand continuous exposure to the harsh downhole environment. A protective shell can be formed with chemical coatings such as polymers and/or epoxy, resin-based materials, or any material that can withstand continuous exposure to the harsh downhole environment. Memory capsule 1500 is shown as having a spherical shape. However, memory capsule 1500 is not limited to this shape. Memory capsule 1500 could have an oblong shape or cube shape, for example. In cases where memory capsule 1500 may need to exit through a nozzle in a drill bit, capsule 1500 may be sized to pass through the nozzle of the drill bit. In some cases, capsule 1500 may be flexible so that it can be squeezed through the passage of the nozzle. This may allow memory capsule 1500 to be slightly larger than the passage diameter of the nozzle. Memory capsule 1500 has low power requirements since it only contains a transceiver, a microcontroller, and a rechargeable power storage, making capsule 1500 suitable for IoT platforms. The power storage can be recharged using energies harvested by the capsule from flowing with the drilling fluid. For example, memory capsule 1500 could include a small turbine to harvest energy.

In general, the amount of stored data in a sensor array/SPSM 100, 200, 300, 400, 700, 900, 1400 that can be transferred to a mobile memory capsule 1500 is limited. In this case, sensor array/SPSM 100, 200, 300, 400, 700, 900, 1400 can use processing-in-memory (PIM) architecture. In PIM, large volumes of data is computed, analyzed, and turned into information and real-time insights by bringing computation closer to the data, instead of moving the data across to the CPU. This way, the data needed to be transferred from a SPSM to a memory capsule could be largely reduced along with the required power for data transmission. The data from the different sensors in sensor array/SPSM 100, 200, 300, 400, 700, 900, 1400 may be stored in the SPSM memory separated by unique headers that identify the source of the sensor data. Not all the sensor data has to be transferred to the memory capsule. Instead, a snapshot of the data, such as maximum, minimum, average values or anomalies that would still provide valuable data to the driller at the surface, may be transferred. The data in the memory capsules can be static random-access memory (SRAM), where the data will remain as long as the capsules are powered. They can be integrated on-chip as random access memory (RAM) or cache memory in microcontrollers, Application Specific Integrated Circuits (ASICS), Field Programmable Gate Arrays (FPGAs), or Complex programmable logic devices (CPLDs).

For the purpose of data gathering by the memory capsules, the transceivers in sensor array/SPSM 100, 200, 300, 400, 700, 900, 1400 preferably support short-range wireless data transfer with ultra-low latency and ultra-low power requirements. Some methods include ultra-wideband (UWB) communication with short pulses rather than carrier frequencies. The electric and/or magnetic dipole antennas are also optimized for ultra-low latency and ultra-low power data transfer. Examples include, wide-band microstrip, wide-band monopole antenna over a plate, wide-slot UWB antenna, stacked patch UWB antenna, taper slot (TSA) UWB antenna, elliptical printed monopole UWB antenna, metamaterial (MTM) structure UWB antennas, and dielectric resonator antennas (DRAs).

Prior to data transfer from sensor array/SPSMs 100, 200, 300, 400, 700, 900, 1400 to memory capsules 1500, a command may be sent from the surface to change antennas in the array of sensor arrays/SPSMs 100, 200, 300, 400, 700, 900, 1400 into transmit mode to enable transfer of data from sensor arrays/SPSMs 100, 200, 300, 400, 700, 900, 1400 to memory capsules 1500 when memory capsules 1500 are flowing with drilling fluid inside the well. Alternatively, specific capsules may be deployed into the well ahead of data gathering memory capsules. The specific capsules may send commands to SPSMs 100, 200, 300, 400, 700, 900, 1400 from inside the well to change antennas in SPSMs into transmit mode. The data gathering memory capsules can then flow past SPSMs 100, 200, 300, 400, 700, 900 and collect data from the SPSMs. Some methods may also include ultra-fast wake up and data transfer times so that a memory capsule can send a signal to change the transceiver status of a sensor array/SPSM 100, 200, 300, 400, 700, 900, 1400 to 'active' from its 'sleep' status and then obtain data. The memory capsules 'listen' to the data transmission to receive and store the data in their internal memories and then travel back to the surface with the data.

Returning to FIG. 1. One or more embodiments of array 100 may be designed so as not to allow outside fluids to flow into the spacing or voids between inner ring 110 and outer collar 160. One having skill in the art will appreciate the many methods to prevent fluids from going inside the system comprising inner ring 110 and outer collar 160, such as may be used in existing downhole friction bearing designs.

In one or more embodiments, inner ring 110 and/or outer collar 150 may be formed using multiple parts, enabling inner ring 110 to be disposed within outer collar 150. In one or more embodiments, inner ring 110 and/or outer collar 150 may be flexible, enabling inner ring 110 to be disposed within outer collar 150.

Embodiments of inner ring 210, 310, 410, 510, 610, 710, 810, 910, 1210, 1310, 1410 depicted herein include bearing elements in the form of bearings 220, 320, 420, 520, 620, 720, 820, 920, 1220, 1320, 1420 with a roughly spherical geometry (meaning, ball bearings). However, one having skill in the art will appreciate any shape or geometry of bearing elements may be employed. In one or more embodiments, bearings 220, 320, 420, 520, 620, 720, 820, 920, 1220, 1320, 1420 within inner ring 210, 310, 410, 510, 610, 710, 810, 910, 1210, 1310, 1410 may include any combination of ball bearing(s), roller bearing(s) including cylindrical roller(s), taper roller(s), spherical roller(s), or any other bearing geometry well known in the art.

Returning to FIG. 2A, in some embodiments, inner ring 210 may have any number of bearings 220 on any outer surface. In some embodiments, inner ring 210 may have bearings 220 on top outer surface 214, middle outer surface 212, or bottom outer surface 216, or any combination of these outer surfaces 214, 212, 216.

In one or more embodiments, a first fraction of bearings 220 may be on a first surface and a second fraction of bearings 220 may be on a second surface. In one or more embodiments, a first fraction of bearings 220 may be on a first surface, a second fraction of bearings 220 may be on a second surface, and a third fraction of bearings 220 may be on a third surface.

In one or more embodiments, a first fraction of bearings 220 may be on middle outer surface 212. In one or more embodiments, a first fraction of bearings 220 may be on middle outer surface 212, a second fraction of bearings 220 may be on top outer surface 214, and a third fraction of bearings 220 may be on bottom outer surface 216.

In one or more embodiments, a fraction of a total number of bearings 220 located on each surface may be equal. In one or more embodiments, a fraction of a total number of bearings 220 located on each surface may be unequal. In one or more embodiments, a fraction of a total number of bearings 220 located on two or more surfaces may be equal.

In one or more embodiments, a fraction of a total number of bearings 220 located on two or more surfaces may be unequal.

In one or more embodiments, bearings 220 on each surface may be evenly spaced. In one or more embodiments, bearings 220 on each surface may be unevenly spaced. In one or more embodiments, bearings 220 on one or more surface may be evenly spaced. In one or more embodiments, bearings 220 on one or more surface may be unevenly spaced.

In FIG. 2A, bearings 220 on top outer surface 214, middle outer surface 212, and bottom outer surface 216 are roughly radially aligned. In one or more embodiments, bearings may be roughly radially aligned. In one or more embodiments, bearings may not be roughly radially aligned. In one or more embodiments, bearings on a first and a second surface may be roughly radially aligned, while bearings on a third surface may not be roughly aligned. In one or more embodiments, bearings on some surface(s) may be roughly radially aligned, while bearings on other surface(s) may not be roughly aligned.

In one or more embodiments, a fraction of a total number of moveable members (of any type) located on each surface may be equal. In one or more embodiments, a fraction of a total number of moveable members (of any type) located on each surface may be unequal. In one or more embodiments, a fraction of a total number of moveable members (of any type) located on two or more surfaces may be equal. In one or more embodiments, a fraction of a total number of moveable members (of any type) located on two or more surfaces may be unequal.

In one or more embodiments, moveable members (of any type) on each surface may be evenly spaced. In one or more embodiments, moveable members (of any type) on each surface may be unevenly spaced. In one or more embodiments, moveable members (of any type) on one or more surface may be evenly spaced. In one or more embodiments, moveable members (of any type) on one or more surface may be unevenly spaced.

In FIG. 2A, moveable members 260 on top inner surface 254, middle inner surface 252, and bottom inner surface 256 are roughly radially aligned. In one or more embodiments, moveable members (of any type) may be roughly radially aligned. In one or more embodiments, moveable members (of any type) may not be roughly radially aligned. In one or more embodiments, moveable members (of any type) on a first and a second surfaces may be roughly radially aligned, while moveable members (of any type) on a third surface may not be roughly aligned. In one or more embodiments, moveable members (of any type) on some surfaces may be roughly radially aligned, while moveable members (of any type) on a third surface may not be roughly aligned.

In one or more embodiments, moveable members on each surface may be either sensor moveable members or power moveable members. In one or more embodiments, moveable members on each surface may be both sensor moveable members and power moveable members. In one or more embodiments, moveable members on a first surface may be sensor moveable members and moveable members on a second surface may be power moveable members. In one or more embodiments, moveable members on a first surface may be sensor moveable members; moveable members on a second surface may be power moveable members; and a third surface may have a raceway for aligning the inner ring and the outer collar that contain no moveable members. In one or more embodiments, moveable members on a top inner surface and a bottom inner surface may be sensor moveable members and moveable members on a middle inner surface may be power moveable members.

One or more embodiments of inner ring 210 and outer ring 250 may be formed of the same material(s). In one or more embodiments, inner ring 210 and outer ring 250 may each be formed of different materials.

One or more embodiments of inner ring 210 may each be formed of two or more materials. One or more embodiments of outer ring 250 may each be formed of two or more materials.

One or more embodiments of inner ring 210 and outer ring 250 may include one or more partial or complete coatings. Such a coating may, for instance, increase wear resistance for higher-friction region(s) such as raceway(s).

One or more embodiments depicted here have bearings 220 on inner ring 210 and moveable members 260 on outer collar 250. In one or more embodiments, the bearings may be on the inner ring, while the moveable members (of any type) may be on the outer collar. In one or more embodiments, the bearings may be on the outer collar, while the moveable members (of any type) may be on the inner ring. In one or more embodiments, the bearings may be on both the inner ring and on the outer collar. In one or more embodiments, the moveable members (of any type) may be on both the inner ring and on the outer collar. In one or more embodiments, the moveable members of one type may be on the inner ring and the moveable members of the other type may be on the outer collar.

FIG. 2A depicts inner ring 210 roughly shaped as an open cylinder, also known as a hollow cylinder. In one or more embodiments, the inner ring may be roughly shaped as an open cylinder. In one or more embodiments, the inner ring may be roughly shaped as a torus or a toroid having any polygonal cross section, such as a triangular toroid, a square toroid, a rectangular toroid, or a hexagonal toroid. One having skill in the art will appreciate the corresponding shape of the outer collar needed to accommodate each of these shapes. Also, one having skill in the art will appreciate that the number of outer surfaces of the inner ring and the number of inner surfaces of the outer ring may depend on the shape of the inter ring.

One or more embodiments depicted here have an inner ring with three outer surfaces and an outer collar with three inner surfaces. One having skill in the art will appreciate that one or more embodiments the inter ring having an alternative geometry may have a different number of outer surfaces. Also one or thus the outer collar may similarly have a different number of inner surfaces).

One or more embodiments depicted here have an inner ring with three outer surfaces and an outer collar with three inner surfaces, where the number of surfaces is equal. One or more embodiments will have an inner ring and an outer collar with an equal number of surfaces. One or more embodiments will have an inner ring and an outer collar with a different number of surfaces.

Returning to FIGS. 3A and 3B, sensor array 300 as depicted is located outside of drillstring 390. One or more embodiments of sensor array 300 may be located inside drillstring 390 with either inner ring 310 or outer collar 350 connected to the inside of drillstring 390. One having skill in the art will appreciate how the geometry and relative orientations of inner ring 310 and outer collar 350 change when sensor array 300 is located within drillstring 390.

One or more embodiments depicted here have inner ring 310 located between outer collar 350 and drillstring 390. One or more embodiments with sensor array 300 outside wellbore 390 have inner ring 310 located outside of outer collar 350 and drillstring 390, thus towards the wellbore. One or more embodiments with sensor array 300 inside wellbore 390 have inner ring 310 located outside of outer collar 350 and drillstring 390, thus towards the fluid flow.

Frequently, the radial space in a wellbore outside the drillstring may be moderately or significantly constrained. Further, a sensor array with a small radial thickness may enable maximum fluid bypass, prevent the accumulation of cuttings, or both. In one or more embodiments, inner ring 310 and outer collar 350 may not significantly extend radially outwards from the drillstring assembly. (To that end, the diagrams depicted herein are not to scale and may be enlarged in the radial direction for visual clarity.) One or more embodiments of sensor array 300 may be configured to allow maximum drilling fluid bypass, thus minimizing the impact on drilling fluid flow through the borehole past sensor array 300.

One or more embodiments of outer collar 350 may include flutes on one or more fluid-exposed surfaces. Such flutes may allow cuttings to pass through without obstruction.

In one or more embodiments, moveable members (of any type) may not be significantly compressible. In one or more embodiments, moveable members (of any type) may be formed of one or more materials able to withstand the downhole environment. Some important features of the material(s) forming moveable members (of any type) may include the ability to operate at high temperature (>150° C.), the ability to operate at high pressure (>5000 psi), high abrasion resistance, or high wear resistance. Some example materials for a moveable member (of any type) may include steel, titanium, silicon carbide, aluminum silicon carbide, Inconel, Pyroflask, any thermally-stable polymer, or any alloys, composites, derivatives, or analogues therein.

In one or more embodiments, bearings may not be significantly compressible. In one or more embodiments, bearings may be formed of one or more materials able to withstand the downhole environment. Some important features of the material(s) forming bearings 420 may include the ability to operate at high temperature (>150° C.), the ability to operate at high pressure (>5000 psi), high abrasion resistance, or high wear resistance. Some example materials for bearings may include steel, titanium, silicon carbide, aluminum silicon carbide, Inconel, Pyroflask, any thermally-stable polymer, or any alloys, composites, derivatives, or analogues therein.

Returning to FIG. 4A, sensor array 400 may have space restrictions. Additionally, undesirable interference may occur if a single shape memory material element 470 is attempting to measure more than one environmental parameter. Also, SMMs and thus, shape memory material element 470, do not require application of an external power source such as a battery for operation. Thus, each shape memory material base 470 may be small in size. Consequently, one or more embodiments of sensor array 400 may include multiple shape memory material elements 470 formed from a variety of SMM materials. In such a system, each shape memory material element 470 may measure a specific environmental parameter. Consequently, one or more embodiments of sensor array 400 may follow the following general confirmations:

i) In one or more embodiments, sensor array 400 may be formed such that every shape memory material element 470 is formed of the same SMM to measure a single environmental parameter. Also, in one or more embodiments of sensor array 400, every distance sensor 480 may employ the same distance sensing methodology.

ii) In one or more embodiments, sensor array 400 may be formed such that every shape memory material element 470 is formed of the same SMM to measure a single environmental parameter. Also, in one or more embodiments of sensor array 400, distance sensors 480 may employ more than one distance sensing methodology. Using multiple distance sensing methodologies may allow for improved data correlation and greater redundancy, which may result in more accurate measurement of the single environmental parameter.

iii) In one or more embodiments, sensor array 400 may be formed such that multiple SMMs are used to form the shape memory material elements 470. In one or more embodiments, each SMM, and thus each shape memory material elements 470, may measure one specific environmental parameter. Additionally, one or more embodiments of sensor array 400 may measure multiple environmental parameters by including multiple shape memory material elements 470. Also, in one or more embodiments of sensor array 400, every distance sensor 480 may employ the same distance sensing methodology.

iv) In one or more embodiments, sensor array 400 may be formed such that multiple SMMs are used to form the shape memory material elements 470. In one or more embodiments, each SMM, and thus each shape memory material element 470, may measure one specific environmental parameter. Additionally, one or more embodiments of sensor array 400 may measure multiple environmental parameters by including multiple shape memory material elements 470. Also, in one or more embodiments of sensor array 400, distance sensors 480 may employ more than one distance sensing methodology.

As an illustrative example of configuration (iv) above, consider one or more embodiments of sensor array 400 having 12 slots arranged around outer collar 450. Here, "a slot" refers to the repeated combination of components arranged around outer collar 450 that are housed within each of the plurality of moveable member retainers 465, such as a moveable member in the form of a sensor moveable member 460, a distance sensor 480, and a shape memory material element 470. Each shape memory material element 470 may be formed of a single SMM selected to deform in response to a single environmental parameter. In one or more embodiments, outer collar 450 may accommodate the following 12 slots within sensor array 400:

Slot 1: SMM 1 for detecting environmental parameter 1 using distance sensing methodology 1;
Slot 2: SMM 1 for detecting environmental parameter 1 using distance sensing methodology 2;
Slot 3: SMM 1 for detecting environmental parameter 1 using distance sensing methodology 3;
Slot 4: SMM 2 for detecting environmental parameter 2 using distance sensing methodology 1;
Slot 5: SMM 2 for detecting environmental parameter 2 using distance sensing methodology 2;
Slot 6: SMM 2 for detecting environmental parameter 2 using distance sensing methodology 3;
Slot 7: SMM 3 for detecting environmental parameter 3 using distance sensing methodology 1;
Slot 8: SMM 3 for detecting environmental parameter 3 using distance sensing methodology 2;
Slot 9: SMM 3 for detecting environmental parameter 3 using distance sensing methodology 3;
Slot 10: SMM 4 for detecting environmental parameter 4 using distance sensing methodology 1;
Slot 11: SMM 4 for detecting environmental parameter 4 using distance sensing methodology 2; and Slot 12: SMM 4 for detecting environmental parameter 4 using distance sensing methodology 3.

For sensor array 400 to detect an environmental parameter, shape memory material element 470 may need to be directly or indirectly exposed to that environmental parameter. However, uncontrolled exposure of the interior of sensor array 400 to the environmental parameter may be detrimental to some components. One or more embodiments of sensor array 400 may allow direct exposure of shape memory material element 470 to the environmental parameter in a controlled manner. Such controlled exposure may help protect all components while allowing sufficient exposure of shape memory material element 470 by the environmental parameter. One or more embodiments of sensor array 400 may include housing design elements or other means of controlled conveyance of the environmental parameter that are well known in the art.

In one or more embodiments, sensor array 400 may include small ports or openings into outer collar 450 to allow environmental parameter (for example, a gas or liquid) to be conveyed to shape memory material element 470. In one or more embodiments, outer collar 450 may include a gas inlet, a gas outlet, and a membrane between the inlet and the outlet to allow the environmental parameter (for example, a gas or a liquid) to be conveyed to shape memory material element 470. In one or more embodiments, a part of outer collar 450 forming the base of moveable member retainer 465 may be formed of a gas permeable membrane atop which shape memory material element 470 may be located. In one or more embodiments, the part of outer collar 450 forming the base of moveable member retainer 465 may include a port atop a gas permeable membrane located atop shape memory material element 470.

Some other methods of controlled exposure of shape memory material element 470 to the environmental parameter may include a thin membrane; a protruded port; a protruded port with a thin membrane at the tip; a protruded membrane; an additional material inside a port to indirectly transfer an environmental parameter like temperature or vibration; a liquid material inside a port to indirectly transfer an environmental parameter like temperature or vibration; or a liquid material sensitive to an environmental parameter like temperature sandwiched between a membrane and a solid material also sensitive to the environmental parameter. In one or more embodiments, sensor array 400 may not directly expose shape memory material element 470 to the stimulus but still may be able to transfer the stimulus to shape memory material element 470.

Returning to FIGS. 5A-5E, in one or more embodiments, a second stimulus may also impact the shape of shape memory material element 570, potentially to a lesser degree, in addition to the shape change due to the first, intended external stimulus. In one or more embodiments, if a change in minimum extension distance (say, from d1 to d2) may be due to a first, intended external stimulus and a second, unintended external stimulus, sensor array 500 may apply a calibration factor to correct each measured minimum extension distance (meaning, both d1 and d2) so the extension distances only reflect the first, intended external stimulus. In such a situation, one or more embodiments of sensor array 500 may apply a calibration to the output from distance 580 that removes the impact of the second stimulus.

Consider as an illustrative example, one or more embodiments of sensor array 500 having a shape memory material element 570 formed from a shape memory material that experiences a significant shape change with the application of an external gas pressure. Thus, pressure is the first, intended external stimulus this shape memory material was selected to reflect. Additionally, like most materials, this shape memory material also volumetrically expands when it experiences an increase in temperature due to an increase in the kinetic energy of the atoms within the material. The degree of volumetric expansion of shape memory material due to increased temperature may be experimentally determined for a pressure-sensitive shape memory material element 570, in order to generate a temperature calibration. One or more embodiments of sensor array 500 may also include a device that is able to measure the temperature, such as a solid state temperature sensor or a second shape memory material element 570, distance sensor 580, and sensor moveable member 560 configuration intended to measure temperature. Thus, one or more embodiments of sensor array 500 may apply a temperature calibration for the pressure-sensitive shape memory material element 570 in order to remove the effects of the external temperature on the size of gap 575 from the minimum extension distance d1, d2 determined by distance sensor 580.

In one or more embodiments, the shape change of shape memory material element 570 may be an expansion or a contraction with an increase of an environmental parameter, depending upon the shape memory properties of the shape memory material used to form shape memory material element 570. In one or more embodiments, increase of an environmental parameter may cause an expansion of shape memory material base 570 that decreases a minimum extension distance. In one or more embodiments, increase of an environmental parameter may cause a contraction of shape memory material element 570 that increases a minimum extension distance. In one or more embodiments, change of an environmental parameter may cause an expansion of shape memory material element 570 that decreases gap 575 and decreases a minimum extension distance, such as depicted in FIGS. 5A and 5B from d1 to d2. In one or more embodiments, change of an environmental parameter may cause an contraction of shape memory material element 570 that increases a minimum extension distance.

Returning to FIGS. 6A-6C: One or more embodiments of detector 682*a*, 682*c*, 682*e* may be linked directly to shape memory member base 670, such as directly attached. One or more embodiments of detector 682*a*, 682*c*, 682*e* may be linked indirectly to shape memory member base 670, such as having one or more intermediate layers between detector 682*a*, 682*c*, 682*e* and shape memory member base 670.

In one or more embodiment, one or more distance sensors 680*a*, 682*c*, 682*e* may be low-power sensors.

Embodiments herein depict an array as including a single inner ring and a single outer ring. One or more embodiments of the array may include more than one inner ring within a single outer ring. One or more embodiments of the array may include more than one inner ring and more than one outer ring, with each inner ring disposed radially within a single outer ring. One or more embodiments of the array may include more than one inner ring and more than one outer ring, with one or more inner rings disposed radially within each outer ring. Such a device may be said to have multiple layers, with each layer including a single outer ring and one or more inner rings disposed within the outer ring. One or more embodiments of a sensor array having multiple layers may be configured such that each layer of the sensor array detects a specific parameter at many radial positions around the wellbore.

One or more embodiments of an array may include mounts, springs, rubber/elastomer/foam pads, wire ropes, or a combination of these to mitigate or isolate vibrations in the housing containing the shape memory material element, the distance sensor, or both. One or more embodiments may employ different methods to isolate vibrations from sensors and instrumentation, such as those employed by measurement and logging while drilling (MWD/LWD) systems.

One or more embodiments of an array may include an accelerometer, a gyroscope, or both. Such components may detect the position, vibration, orientation, or a combination of these of the system. In some embodiments, parameters such as system position, vibration, or orientation may be used to distinguish between tripping in/out and drilling. During tripping in/out, a command may be provided to the microcontroller/microprocessor to provide regulated power from the capacitor, or any type of storage, to the sensor module.

In one or more embodiment, an array may further include additional sensors to measure temperature, pressure, vibration, strain, magnetic field, electric field, or a combination. In one or more embodiment, one or more of these additional sensors may any type known in the art, such as solid-state sensors or MEMS sensors. In one or more embodiment, output from one or more of these additional sensors may be used to apply calibrations that remove the impact of secondary, unintended external parameters on shape memory material elements.

One or more embodiments of an array may include a microcontroller. One or more embodiments of the array may include an internal clock. In one or more embodiments of a sensor array, data derived from a signal from distance sensors (FIGS. 6A-6C) may be tagged, such as including unique headers or stamps for different sources. In one or more embodiments of a sensor array, data derived from a signal from distance sensors (FIGS. 6A-6C) time stamping that may be synchronized with GPS time stamping. Such GPS time stamping is frequently employed at drilling locations, such as on drilling rigs.

Returning to FIG. 7, in some embodiments, inner ring 710 may have any number of bearings 720 on any outer surface. In some embodiments, inner ring 710 may have bearings 720 on top outer surface 714, middle outer surface 712, or bottom outer surface 716, or any combination of the outer surfaces.

In one or more embodiments, a first fraction of bearings 720 may be on a first surface and a second fraction of bearings 720 may be on a second surface. In one or more embodiments, a first fraction of bearings 720 may be on a first surface, a second fraction of bearings 720 may be on a second surface, and a third fraction of bearings 720 may be on a third surface.

In one or more embodiments, a first fraction of bearings 720 may be on middle outer surface 712. In one or more embodiments, a first fraction of bearings 720 may be on middle outer surface 712, a second fraction of bearings 720 may be on top outer surface 714, and a third fraction of bearings 720 may be on bottom outer surface 716.

Returning to FIG. 10, in one or more embodiments, antenna within communications device 1002 may be polymer-based, paper-based, PET-based, textile-based, carbon nanotube (CNT)-based, artificial magnetic conductor-based, kapton-based, nickel-based metamaterial, or a combination.

In one or more embodiments, antenna within communications device 1002 may be directional, omni-directional, or point-to-point.

In one or more embodiments, antenna within communications device 1002 may be a planar antenna, such as a monopole, a dipole, an inverted, a ring, a spiral, a meander, or a patch antenna.

In one or more embodiments, antenna within communications device 1002 may be a compact antenna on a flexible substrate. In one or more embodiments, antenna within communications device 1002 may be used to transmit and receive sensor information. In one or more embodiments, the transmitted data may include raw distance sensor data, environmental parameter data, or both.

In one or more embodiments, sensitive components of sensor array 1000 may be housed in a separate compartment or area of sensor array 1000. In one or more embodiments, electronics 1004 may be housed in a separate compartment or area of sensor array 1000. Such separation may help ensure sensitive components such as electronics 1004 are not influenced by, damaged by, or both influenced and damaged by exposure to the environmental parameter(s).

In one or more embodiments, contact between the outer collar and the borehole may help enhance the relative motion between the inner ring and the outer collar because the outer collar may experience more friction. Moreover, in one or more embodiments, the inner ring and the drillstring assembly would be "on top" of the outer collar, which may increase this relative motion.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A sensor array for sensing environmental parameters along a drillstring, the sensor array comprising:

an outer collar having a plurality of moveable member retainers formed therein;

a plurality of moveable members movably disposed in the plurality of moveable member retainers;

an inner ring rotatably supported within the outer collar;

a plurality of bearing elements retained on an outer surface of the inner ring, the plurality of bearing elements positioned to displace the plurality of moveable members relative to the plurality of moveable member retainers in response to relative rotation between the inner ring and the outer collar;

a plurality of shape memory material elements, each shape memory material element arranged in one of the plurality of moveable member retainers; and a plurality of distance sensors, each distance sensor disposed in a respective moveable member retainer of the plurality of moveable member retainers and between a respective shape memory material element in the respective moveable member retainer and a respective moveable member movably disposed in the moveable member retainer, each distance sensor comprising a first sensing element and a second sensing element arranged in opposing relation, the first sensing element and the second sensing element separated by a gap that is responsive to a shape change of a respective shape memory material element and a displacement of the respective moveable member.

2. The sensor array according to claim 1, wherein the shape change of each shape memory material element reflects the environmental parameters.

3. The sensor array according to claim 1, wherein the plurality of shape memory material elements are formed of multiple shape memory materials having different responses to the environmental parameters.

4. The sensor array according to claim 1, wherein the first sensing element comprises a magnetic detector and the second sensing element comprises a magnetic target, wherein the magnetic detector is configured to detect a magnetic field across the gap between the magnetic detector and the magnetic target, and wherein an output of the magnetic detector is a function of the magnetic field.

5. The sensor array according to claim 1, wherein the first sensing element comprises a ground electrode detector and the second sensing element comprises a drive electrode target, wherein the ground electrode detector is configured to detect a capacitance across the gap between the ground electrode detector and the drive electrode target, and wherein an output of the ground electrode detector is a function of the capacitance.

6. The sensor array according to claim 1, wherein the first sensing element comprises an optical transducer detector and the second sensing element comprises an optical reflector target, wherein the optical transducer detector is configured to generate an emitted optical signal, the emitted optical signal traverses the gap, the emitted optical signal is reflected from the optical reflector target, the reflected optical signal traverses the gap, and the optical transducer detector detects the emitted optical signal after an optical elapsed time; and wherein an output of the optical transducer detector is a function of the optical elapsed time.

7. The sensor array according to claim 1, wherein the first sensing element is an acoustic transducer detector and the second sensing element is an acoustic reflector target, and wherein the acoustic transducer detector is configured to generate an emitted acoustic signal, the emitted acoustic signal traverses the gap, the emitted acoustic signal is reflected from the acoustic reflector target, the emitted acoustic signal traverses the gap, and the acoustic transducer detector detects the reflected acoustic signal after an acoustic elapsed time, and wherein an output of the acoustic transducer detector is a function of the acoustic elapsed time.

8. The sensor array according to claim 1, further comprising a plurality of extension mechanisms positioned in each of the plurality of moveable member retainers, each extension mechanism configured to return the respective moveable member to an extended position after contact between one of the plurality of bearing elements and the respective moveable member is released.

9. A self-powered sensor array for sensing environmental parameters along a drillstring, the self-powered sensor array comprising:

an outer collar having a plurality of moveable member retainers formed therein;

a plurality of moveable members movably disposed in the plurality of moveable member retainers;

an inner ring rotatably supported within the outer collar;

a plurality of bearing elements retained on an outer surface of the inner ring, each bearing element positioned to displace the moveable members relative to the moveable member retainers in response to relative rotation between the inner ring and the outer collar;

a plurality of shape memory material elements, each shape memory material element arranged in a respective moveable member retainer of a first fraction of the plurality of moveable member retainers;

a plurality of distance sensors, each distance sensor disposed in the respective moveable member retainer and between the shape memory material element in the respective moveable member retainer and a respective moveable member movably disposed in the respective moveable member retainer, each distance sensor comprising a first sensing element and a second sensing element arranged in opposing relation, the first sensing element and the second sensing element separated by a gap that is responsive to a shape change of the respective shape memory material element and a displacement of the respective moveable member; and a plurality of power generation components, each power generation component arranged in relation to one of a second fraction of the plurality of moveable member retainers, the power generation component configured such that, in response to the relative rotation, the plurality of bearing elements displace a particular moveable member into a particular moveable member retainer, generating an electric charge.

10. The self-powered sensor array according to claim 9, wherein each of the plurality of shape memory material elements are formed of shape memory materials comprising at least one of a shape-memory alloy, a shape-memory polymer, a shape-memory gel, a shape-memory ceramic, a liquid crystal elastomer, or MXene, or combinations thereof.

11. The self-powered sensor array according to claim 9, wherein the shape change of each shape memory material element reflects the environmental parameters.

12. The self-powered sensor array according to claim 9, wherein the plurality of shape memory material elements are formed of multiple shape memory materials having different responses to the environmental parameters.

13. The self-powered sensor array according to claim 9, wherein the plurality of distance sensors are comprised of one or more of:

a magnetic distance sensor comprising a magnetic detector and a magnetic target arranged in opposing relation, the magnetic distance sensor configured to detect a magnetic field across the gap and to generate an output of the magnetic distance sensor that is a function of the magnetic field;

a capacitive distance sensor comprising a ground electrode detector and a drive electrode target, the capacitive distance sensor configured to detect a capacitance across the gap and to generate an output of the capacitive distance sensor that is a function of the capacitance;

an acoustic distance sensor comprising an acoustic transducer detector and an acoustic reflector target, the acoustic distance sensor configured to measure an acoustic elapsed time across the gap and to generate an output of the acoustic distance sensor that is a function of the acoustic elapsed time; or an optical distance sensor comprising an optical transducer detector and an optical reflector target, the optical distance sensor configured to measure an optical elapsed time across the gap and to generate an output of the optical distance sensor that is a function of the optical elapsed time.

14. The self-powered sensor array according to claim 9, wherein the plurality of power generation components are comprised of one or more of:

a first triboelectric module comprising the plurality of bearing elements formed of or coated with a first frictional material and the particular moveable member formed of or coated with a second frictional material, that generates the electric charge via contact between the first frictional material and the second frictional material having different polarities;

a second triboelectric module comprising the particular moveable member formed of or coated with the first frictional material and the particular moveable member retainer formed of or coated with the second frictional material, that generates the electric charge via contact between the first frictional material and the second frictional material having different polarities;

a third triboelectric module comprising the particular moveable member retainer and the particular moveable member are each formed of or coated with alternating segments of the first frictional material and the second frictional material, that generates the electric charge via contact between the first frictional material and the second frictional material having different polarities;

a piezoelectric base disposed in the particular moveable member retainer that generates the electric charge when compressed by the particular moveable member;

a piezoelectric nanoribbon base disposed in the particular moveable member retainer that generates the electric charge when compressed or flexed by the particular moveable member; or a magnetostrictive base disposed in the particular moveable member retainer that generates the electric charge when compression of the magnetostrictive base by the particular moveable member generates a magnetic field and the magnetic field is converted to the electric charge by a planar pick-up coil or a solenoid disposed near the magnetostrictive base.

15. The self-powered sensor array according to claim 9, wherein the first fraction of the plurality of moveable member retainers are disposed on a top inner surface of the outer collar and a bottom inner surface of the outer collar, and wherein the second fraction of the plurality of moveable member retainers is disposed on a middle inner surface of the outer collar.

16. The self-powered sensor array according to claim 15, wherein a first fraction of the plurality of shape memory material elements disposed in the plurality of moveable member retainers located on the top inner surface of the outer collar comprises a first shape memory material having a first response to the environmental parameters; and wherein a second fraction of the plurality of shape memory material elements disposed in the plurality of moveable member retainers located on the bottom inner surface of the outer collar comprises a second shape memory material having a second response to the environmental parameters.

17. A sensing system for sensing environmental parameters along a drillstring, the system comprising:

a plurality of self-powered sensor arrays, each of the plurality of self-powered sensor arrays comprising:

an outer collar having a plurality of moveable member retainers formed therein;

a plurality of moveable members movably disposed in the plurality of moveable member retainers;

an inner ring rotatably supported within the outer collar;

a plurality of bearing elements retained on an outer surface of the inner ring, each bearing element positioned to displace the moveable members relative to the moveable member retainers in response to relative rotation between the inner ring and the outer collar;

a plurality of shape memory material elements, each shape memory material element arranged in a respective moveable member retainer of a first fraction of the plurality of moveable member retainers;

a plurality of distance sensors, each distance sensor disposed in the respective moveable member retainer and between the shape memory material element in the respective moveable member retainer and a respective moveable member movably disposed in the respective moveable member retainer, each distance sensor comprising a first sensing element and a second sensing element arranged in opposing relation, the first sensing element and the second sensing element separated by a gap that is responsive to a shape change of the respective shape memory material element and a displacement of the respective moveable member;

a plurality of power generation components, each power generation component arranged in relation to one of a second fraction of the plurality of moveable member retainers, the power generation component configured such that, in response to the relative rotation, the plurality of bearing elements displace a particular moveable member into a particular moveable member retainer, generating an electric charge; and a communications device that transmits a signal that includes the gap of each distance sensor; and a receiver that receives the signal from the communications device within each of the plurality of sensor arrays.

18. The system according to claim 17, wherein each of the plurality of self-powered sensor arrays serves as a node within a sensor network such that the nodes relay information between the plurality of self-powered sensor arrays and the receiver.

19. A method for sensing of environmental parameters, the method comprising:

disposing a plurality of self-powered sensor arrays on a drillstring, wherein each of the self-powered sensor arrays comprise an outer collar and an inner ring;

disposing the drillstring with the plurality of self-powered sensor arrays in a wellbore;

rotating the outer collar with respect to the inner ring of each of the plurality of self-powered sensor arrays;

producing mechanical energy in each of the plurality of self-powered sensor arrays by bearing elements of each of the plurality of self-powered sensor arrays that physically interact with movable members of the self-powered sensor array as a result of the relative rotation between the outer collar and the inner ring of each of the plurality of self-powered sensor arrays; and generating an output reflecting gaps probed by distance sensors in each of the plurality of self-powered sensor arrays, where the gaps are responsive to shape changes of shape memory material elements resulting from environmental parameters within the wellbore and displacements of moveable members resulting from the relative rotation between the outer collar and the inner ring of each of the plurality of self-powered sensor arrays.

20. The method of claim 19, further comprising storing electrical energy in one or more power storage units in each of the plurality of self-powered sensor arrays and powering the plurality of distance sensors with at least a portion of the electrical energy stored in the one or more power storage units of each respective self-powered sensor array.

* * * * *